US010100847B2

(12) United States Patent
Wu

(10) Patent No.: US 10,100,847 B2
(45) Date of Patent: Oct. 16, 2018

(54) SHOVEL

(71) Applicant: SUMITOMO HEAVY INDUSTRIES, LTD., Tokyo (JP)

(72) Inventor: Chunnan Wu, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 145 days.

(21) Appl. No.: 15/015,212

(22) Filed: Feb. 4, 2016

(65) Prior Publication Data

US 2016/0153473 A1 Jun. 2, 2016

Related U.S. Application Data

(63) Continuation of application No. PCT/JP2014/069313, filed on Jul. 22, 2014.

(30) Foreign Application Priority Data

Aug. 5, 2013 (JP) ..... 2013-162600
Aug. 5, 2013 (JP) ..... 2013-162601
Aug. 5, 2013 (JP) ..... 2013-162602

(51) Int. Cl.
*F15B 11/08* (2006.01)
*F15B 21/14* (2006.01)
(Continued)

(52) U.S. Cl.
CPC ..... *F15B 11/08* (2013.01); *E02F 9/123* (2013.01); *E02F 9/2217* (2013.01); *E02F 9/2296* (2013.01); *F15B 1/024* (2013.01); *F15B 1/04* (2013.01); *F15B 21/14* (2013.01); *F15B 2201/00* (2013.01); *F15B 2211/20546* (2013.01); *F15B 2211/212* (2013.01); *F15B 2211/611* (2013.01); *F15B 2211/6306* (2013.01); *F15B 2211/6309* (2013.01); *F15B 2211/6313* (2013.01); *F15B 2211/7053* (2013.01); *F15B 2211/7058* (2013.01);
(Continued)

(58) Field of Classification Search
CPC ..... F15B 1/024; F15B 21/14; E02F 9/2217
USPC ..... 60/414, 416
See application file for complete search history.

(56) References Cited

U.S. PATENT DOCUMENTS 4,674,280 A * 6/1987 Stuhr ..... F16H 61/4096 180/165
4,731,997 A * 3/1988 Hagin ..... B60K 6/12 60/405
(Continued)

FOREIGN PATENT DOCUMENTS

EP 2420681 A2 2/2012
JP H05-287774 11/1993
(Continued)

OTHER PUBLICATIONS

International Search Report dated Sep. 22, 2014.

*Primary Examiner* — Thomas E Lazo
(74) *Attorney, Agent, or Firm* — IPUSA, PLLC

(57) ABSTRACT

A shovel includes a main pump, a hydraulic actuator, and an accumulator part. The hydraulic actuator is configured to be driven with hydraulic oil discharged by the main pump. The accumulator part is configured to store the hydraulic oil discharged from the hydraulic actuator and discharge the hydraulic oil to the intake side of the main pump.

19 Claims, 24 Drawing Sheets

(51) Int. Cl.

| | |
|---|---|
| ***F15B 1/02*** | (2006.01) |
| ***E02F 9/12*** | (2006.01) |
| ***E02F 9/22*** | (2006.01) |
| ***F15B 1/04*** | (2006.01) |

(52) U.S. Cl.
CPC ..... *F15B 2211/7128* (2013.01); *F15B 2211/7135* (2013.01); *F15B 2211/88* (2013.01)

(56) References Cited

U.S. PATENT DOCUMENTS

| | | | | |
|---|---|---|---|---|
| 6,655,136 | B2 * | 12/2003 | Holt | E02F 9/2207 60/414 |
| 6,981,371 | B2 * | 1/2006 | Imanishi | E02F 9/2225 60/420 |
| 7,124,576 | B2 * | 10/2006 | Cherney | E02F 9/2217 60/414 |
| 7,269,944 | B2 * | 9/2007 | Zhang | E02F 9/2217 60/414 |
| 7,823,379 | B2 * | 11/2010 | Hamkins | E02F 9/2217 60/414 |
| 7,908,852 | B2 * | 3/2011 | Zhang | E02F 9/2217 60/414 |
| 8,776,511 | B2 * | 7/2014 | Zhang | F15B 21/14 60/410 |
| 2001/0035011 | A1 | 11/2001 | Endo et al. | |
| 2006/0048508 | A1 | 3/2006 | Nakamura et al. | |
| 2007/0074509 | A1 | 4/2007 | Zhang et al. | |
| 2009/0000290 | A1 | 1/2009 | Brinkman | |
| 2012/0151904 | A1 * | 6/2012 | Shang | E02F 9/123 60/327 |
| 2013/0000289 | A1 * | 1/2013 | Zhang | F15B 1/02 60/327 |
| 2013/0081704 | A1 * | 4/2013 | Opdenbosch | E02F 9/2217 137/14 |
| 2013/0195597 | A1 * | 8/2013 | Imura | E02F 9/123 414/744.2 |

FOREIGN PATENT DOCUMENTS

| | | |
|---|---|---|
| JP | 2003-222105 | 8/2003 |
| JP | 2004-278678 | 10/2004 |
| JP | 2009-510358 | 3/2009 |
| JP | 2011-514954 | 5/2011 |
| JP | 2012-102881 | 5/2012 |

* cited by examiner

FIG.5

| | TURNING PRESSURE STORAGE | HYDRAULIC CYLINDER PRESSURE STORAGE | UPSTREAM SIDE PRESSURE DISCHARGE | DOWNSTREAM SIDE PRESSURE DISCHARGE | TANK SUPPLY | STANDBY |
|---|---|---|---|---|---|---|
| FIRST SELECTOR VALVE | (1) OR (3) | (2) | (2) | (2) | (2) | (2) |
| SECOND SELECTOR VALVE | (1) | (2) | (1) | (1) | (1) | (1) |
| THIRD SELECTOR VALVE | (1) | (1) | (1) | (2) | (1) | (1) |
| FOURTH SELECTOR VALVE | (1) | (1) | (2) | (1) | (1) | (1) |

FIG.9

| | TURNING DISCHARGE FLOW UPSTREAM SIDE REGENERATION | TURNING DISCHARGE FLOW DOWNSTREAM SIDE REGENERATION | HYDRAULIC CYLINDER DISCHARGE FLOW UPSTREAM SIDE REGENERATION | HYDRAULIC CYLINDER DISCHARGE FLOW DOWNSTREAM SIDE REGENERATION |
|---|---|---|---|---|
| FIRST SELECTOR VALVE | (1) OR (3) | (1) OR (3) | (2) | (2) |
| SECOND SELECTOR VALVE | (1) | (1) | (2) | (2) |
| THIRD SELECTOR VALVE | (1) | (2) | (1) | (2) |
| FOURTH SELECTOR VALVE | (2) | (1) | (2) | (1) |
| ACCUMULATOR SELECTOR VALVE | (1) | (1) | (1) | (1) |

FIG.13

| | TURNING PRESSURE STORAGE | HYDRAULIC CYLINDER PRESSURE STORAGE | PUMP PRESSURE DISCHARGE | MOTOR PRESSURE DISCHARGE | TANK SUPPLY | STANDBY |
|---|---|---|---|---|---|---|
| ACCUMULATOR SELECTOR VALVE | (2) | (2) | (2) | (2) | (1) | (1) |
| FIRST SELECTOR VALVE | (1) OR (3) | (2) | (2) | (2) | (2) | (2) |
| SECOND SELECTOR VALVE | (1) | (2) | (1) | (1) | (1) | (1) |
| THIRD SELECTOR VALVE | (1) | (1) | (2) | (1) | (1) | (1) |
| FOURTH SELECTOR VALVE | (1) | (1) | (2) | (1) | (1) | (1) |
| PUMP MOTOR | STOP | STOP | PUMP | MOTOR | STOP | STOP |

FIG.21

| | FIRST STATE LOW-PRESSURE A PRESSURE DISCHARGE HIGH-PRESSURE A PRESSURE STORAGE (SIMULTANEOUS REGENERATION) | SECOND STATE LOW-PRESSURE A PRESSURE DISCHARGE HIGH-PRESSURE A PRESSURE STORAGE (TURNING REGENERATION) | THIRD STATE LOW-PRESSURE A PRESSURE DISCHARGE HIGH-PRESSURE A PRESSURE STORAGE (HYDRAULIC CYLINDER REGENERATION) | FOURTH STATE LOW-PRESSURE A PRESSURE DISCHARGE HIGH-PRESSURE A DOWNSTREAM SIDE PRESSURE DISCHARGE | FIFTH STATE LOW-PRESSURE A PRESSURE STORAGE HIGH-PRESSURE A UPSTREAM SIDE PRESSURE DISCHARGE | SIXTH STATE LOW-PRESSURE A PRESSURE DISCHARGE HIGH-PRESSURE A INTERRUPTION | SEVENTH STATE (STANDBY) |
|---|---|---|---|---|---|---|---|
| FIRST SELECTOR VALVE | (1) OR (3) | (1) OR (3) | (2) | (2) | (2) | (2) | (2) |
| SECOND SELECTOR VALVE | (2) | (1) | (2) | (1) | (1) | (1) | (1) |
| THIRD SELECTOR VALVE | (1) | (1) | (1) | (2) | (1) | (1) | (1) |
| FOURTH SELECTOR VALVE | (1) | (1) | (1) | (1) | (2) | (1) | (1) |
| FIFTH SELECTOR VALVE | (1) | (1) | (1) | (1) | (1) | (1) | (2) |

A: ACCUMULATOR, UPSTREAM SIDE: PUMP INTAKE SIDE,
DOWNSTREAM SIDE: PUMP DISCHARGE SIDE

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2014/069313, filed on Jul. 22, 2014 and designating the U.S., which claims priority to Japanese Patent Application Nos. 2013-162600, 2013-162601, and 2013-162602, filed on Aug. 5, 2013. The entire contents of the foregoing applications are incorporated herein by reference.

BACKGROUND

Technical Field

The present invention relates to a shovel including an accumulator.

Description of Related Art

A hydraulic swing motor control system using an accumulator has been known.

SUMMARY

According to an aspect of the present invention, a shovel includes a main pump, a hydraulic actuator, and an accumulator part. The hydraulic actuator is configured to be driven with hydraulic oil discharged by the main pump. The accumulator part is configured to store the hydraulic oil discharged from the hydraulic actuator and discharge the hydraulic oil to the intake side of the main pump.

BRIEF DESCRIPTION OF THE DRAWINGS

FIG. 5 is a correspondence table illustrating a correspondence between the state of the hydraulic circuit of FIG. 3 and the state of selector valves;

FIG. 9 is a correspondence table illustrating a correspondence between the state of the hydraulic circuit of FIG. 7 and the state of selector valves;

FIG. 13 is a correspondence table illustrating a correspondence between the state of the hydraulic circuit of FIG. 11 and the state of selector valves;

FIG. 21 is a correspondence table illustrating a correspondence between the state of the hydraulic circuit of FIG. 19 and the state of selector valves;

DETAILED DESCRIPTION

According to a hydraulic swing motor control system using an accumulator, when decelerating a hydraulic swing motor, hydraulic fluid exiting from the hydraulic swing motor is stored in the accumulator in order to convert kinetic energy due to the inertia action of the hydraulic swing motor into hydraulic energy. Furthermore, according to this hydraulic swing motor control system, when accelerating the hydraulic swing motor, the hydraulic fluid stored in the accumulator is discharged to the hydraulic swing motor in order to use the hydraulic energy due to the conversion as kinetic energy.

According to this hydraulic swing motor control system, however, the hydraulic fluid stored in the accumulator is used only for driving the hydraulic swing motor. Therefore, when the pressure of the accumulator is low, the hydraulic fluid stored in the accumulator is prevented from being discharged to the hydraulic swing motor. Accordingly, the accumulator is not efficiently used.

According to an aspect of the present invention, a shovel that makes more efficient use of an accumulator is provided.

A description is given, with reference to the drawings, of embodiments of the present invention.

Figure 1:
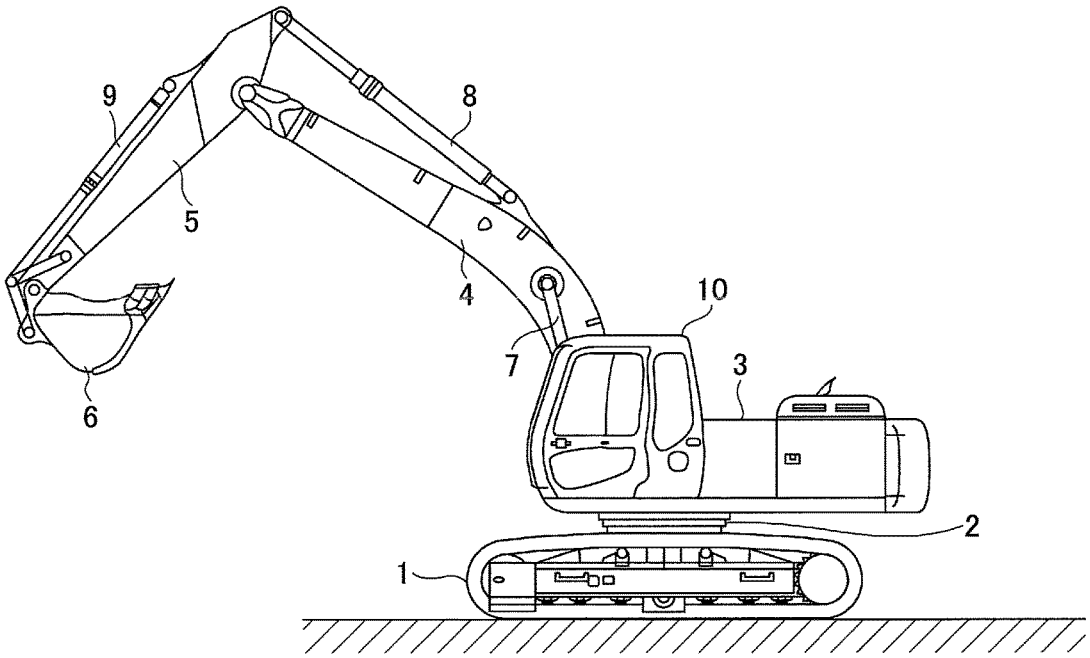
FIG. 1 is a side view of a hydraulic shovel according to an embodiment of the present invention.

FIG. 1 is a side view of a hydraulic shovel according to an embodiment of the present invention. An upper-part turning body 3 is mounted on a lower-part traveling body 1 of the hydraulic shovel via a turning mechanism 2. A boom 4 is attached to the upper-part turning body 3. An arm 5 is attached to an end of the boom 4, and a bucket 6 is attached to an end of the arm 5. The boom 4, the arm 5, and the bucket 6 form an attachment, and are hydraulically driven by a boom cylinder 7, an arm cylinder 8, and a bucket cylinder 9, respectively, which are hydraulic cylinders. A cabin 10 is provided and power sources such as an engine are mounted on the upper-part turning body 3.

Figure 2:
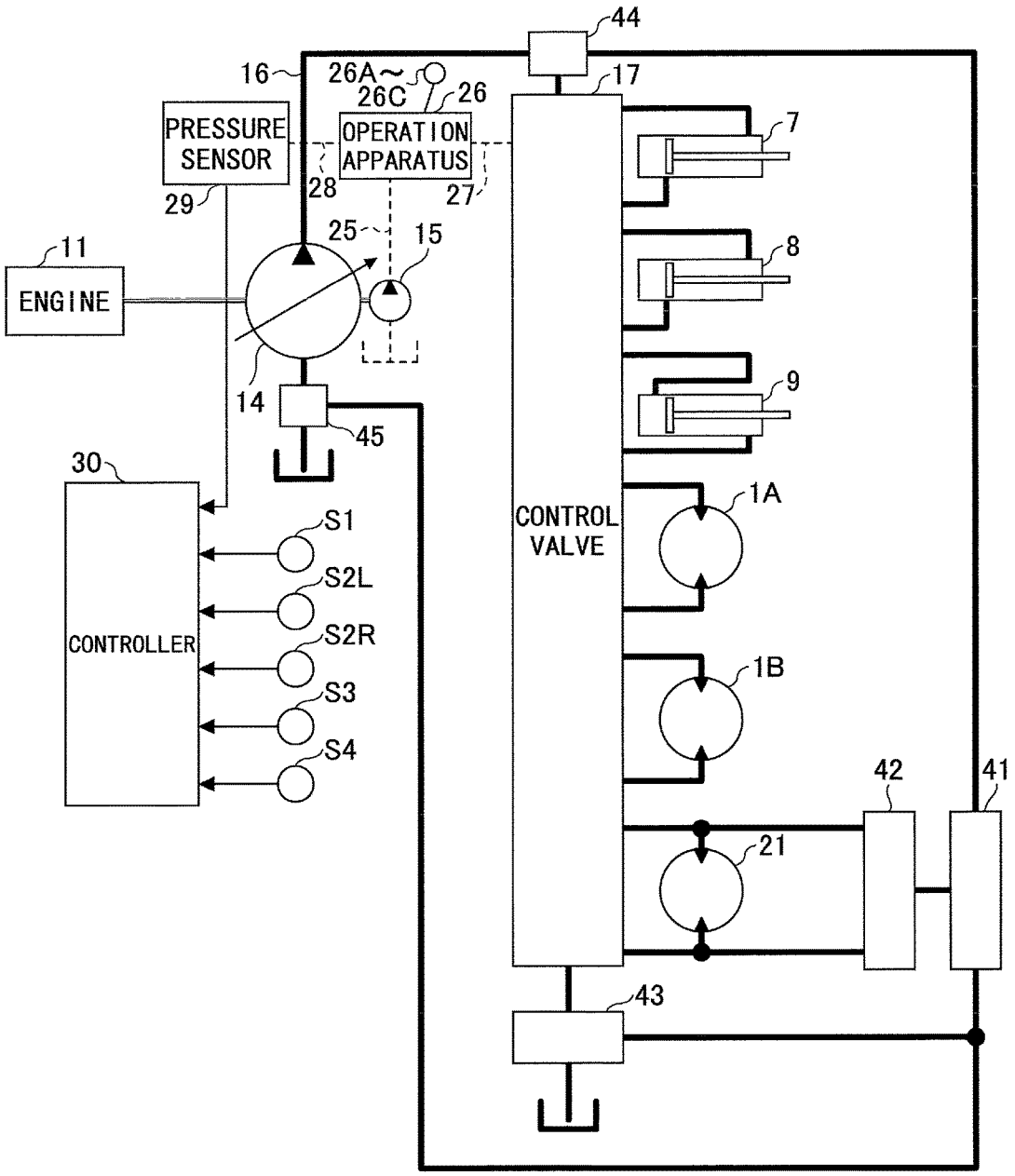
FIG. 2 is a block diagram illustrating a configuration of a drive system of the hydraulic shovel of FIG. 1.

FIG. 2 is a block diagram illustrating a configuration of a drive system of the hydraulic shovel of FIG. 1. In FIG. 2, a mechanical power system, a high-pressure hydraulic line, a pilot line, and an electric drive and control system are indicated by a double line, a thick solid line, a broken line, and a thin solid line, respectively.

A main pump 14 serving as a variable displacement hydraulic pump and a pilot pump 15 serving as a fixed displacement hydraulic pump are connected to the output shaft of an engine 11 serving as a mechanical drive part. A control valve 17 is connected to the main pump 14 via a high-pressure hydraulic line 16 and a first pressure discharge part 44. Furthermore, an operation apparatus 26 is connected to the pilot pump 15 via a pilot line 25.

The control valve 17 is a device that controls a hydraulic system in the hydraulic shovel. Hydraulic actuators such as a traveling hydraulic motor 1A (right), a traveling hydraulic motor 1B (left), the boom cylinder 7, the arm cylinder 8, the bucket cylinder 9, and a turning hydraulic motor 21 are connected to the control valve 17 via high-pressure hydraulic lines.

The operation apparatus 26 includes a lever 26A, a lever 26B, and a pedal 26C. The lever 26A, the lever 26B, and the pedal 26C are connected to the control valve 17 and a pressure sensor 29 via hydraulic lines 27 and 28, respectively.

The pressure sensor 29 is a sensor for detecting what an operator's operation is using the operation apparatus 26. The pressure sensor 29, for example, detects the direction of operation and the amount of operation of a lever or pedal of the operation apparatus 26 corresponding to each hydraulic actuator in the form of pressure, and outputs a detected value to a controller 30. What an operation of the operation apparatus 26 is may be detected using a sensor other than a pressure sensor.

The controller 30 is a controller serving as a main control part that controls the driving of the hydraulic shovel. The controller 30 is composed of a processing unit that includes a CPU (Central Processing Unit) and an internal memory, and controls the driving of the hydraulic shovel by causing the CPU to execute a drive control program stored in the internal memory.

A pressure sensor S1 is a sensor that detects the discharge pressure of the main pump 14, and outputs a detected value to the controller 30.

A pressure sensor S2L is a sensor that detects the pressure of hydraulic oil on the first port side of the turning hydraulic motor 21, and outputs a detected value to the controller 30.

A pressure sensor S2R is a sensor that detects the pressure of hydraulic oil on the second port side of the turning hydraulic motor 21, and outputs a detected value to the controller 30.

A pressure sensor S3 is a sensor that detects the pressure of hydraulic oil of an accumulator part 41 (hereinafter referred to as "accumulator pressure"), and outputs a detected value to the controller 30.

A pressure sensor S4 is a sensor that detects the pressure of hydraulic oil of the bottom-side oil chamber of the boom cylinder 7, and outputs a detected value to the controller 30.

The accumulator part 41 is a hydraulic circuit element that stores hydraulic oil in a hydraulic circuit and discharges the stored hydraulic oil as required.

A first pressure storage part 42 is a hydraulic circuit element that controls a flow of hydraulic oil between the turning hydraulic motor 21 and the accumulator part 41.

A second pressure storage part 43 is a hydraulic circuit element that controls a flow of hydraulic oil between the control valve 17 and the accumulator part 41.

The first pressure discharge part 44 is a hydraulic circuit element that controls a flow of hydraulic oil among the main pump 14, the control valve 17, and the accumulator part 41.

A second pressure discharge part 45 is a hydraulic circuit element that controls a flow of hydraulic oil among the main pump 14, a tank, and the accumulator part 41.

A description is given in detail below of the accumulator part 41, the first pressure storage part 42, the second pressure storage part 43, the first pressure discharge part 44, and the second pressure discharge part 45.

Figure 3:
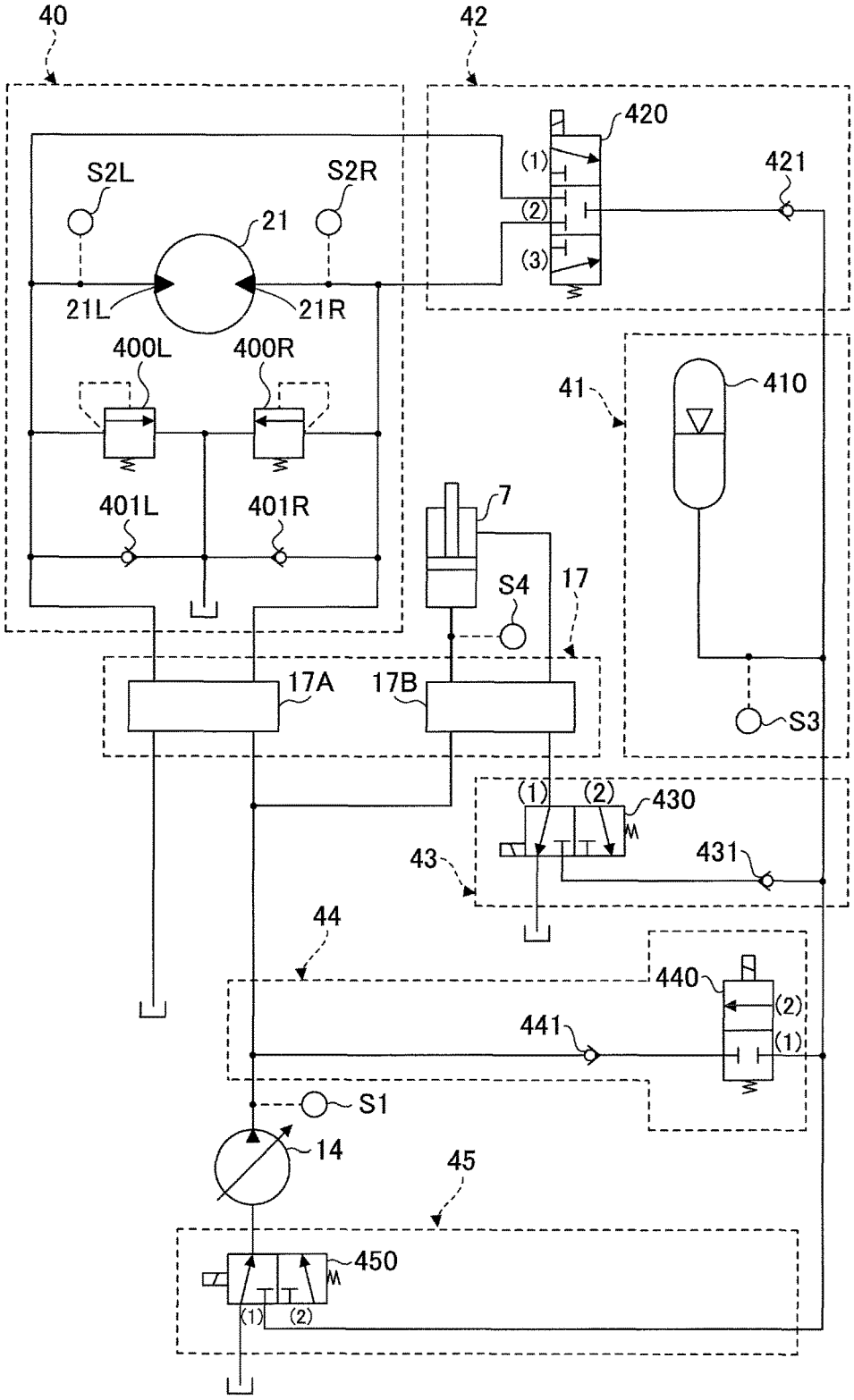
FIG. 3 is a diagram illustrating a configuration of part of a hydraulic circuit.

Next, a description is given, with reference to FIG. 3, of the pressure storing and the pressure discharge of the accumulator part 41 provided in the hydraulic shovel of FIG. 1. FIG. 3 illustrates a configuration of part of a hydraulic circuit provided in the hydraulic shovel of FIG. 1.

The hydraulic circuit illustrated in FIG. 3 mainly includes a turning control part 40, the accumulator part 41, the first pressure storage part 42, the second pressure storage part 43, the first pressure discharge part 44, and the second pressure discharge part 45.

The turning control part 40 mainly includes the turning hydraulic motor 21, relief valves 400L and 400R, and check valves 401L and 401R.

The relief valve 400L is a valve for preventing the pressure of hydraulic oil on the first port 21L side of the turning hydraulic motor 21 from exceeding a predetermined turning relief pressure. Specifically, when the pressure of hydraulic oil on the first port 21L side reaches a predetermined relief pressure, the relief valve 400L discharges the hydraulic oil on the first port 21L side to the tank.

Likewise, the relief valve 400R is a valve for preventing the pressure of hydraulic oil on the second port 21R side of the turning hydraulic motor 21 from exceeding a predetermined turning relief pressure. Specifically, when the pressure of hydraulic oil on the second port 21R side reaches a predetermined relief pressure, the relief valve 400R discharges the hydraulic oil on the second port 21R side to the tank.

The check valve 401L is a valve for preventing the pressure of hydraulic oil on the first port 21L side from falling below a tank pressure. Specifically, when the pressure of hydraulic oil on the first port 21L side decreases to a tank pressure, the check valve 401L supplies hydraulic oil in the tank to the first port 21L side.

Likewise, the check valve 401R is a valve for preventing the pressure of hydraulic oil on the second port 21R side from falling below a tank pressure. Specifically, when the pressure of hydraulic oil on the second port 21R side decreases to a tank pressure, the check valve 401R supplies hydraulic oil in the tank to the second port 21R side.

The accumulator part 41 is a hydraulic circuit element that stores hydraulic oil in the hydraulic circuit and discharges the stored hydraulic oil as required. Specifically, the accumulator part 41 stores hydraulic oil on the braking side (discharge side) of the turning hydraulic motor 21 during turning speed reduction. Furthermore, the accumulator part 41 stores hydraulic oil that the boom cylinder 7 discharges during a boom lowering operation. The accumulator part 41 discharges the stored hydraulic oil to the upstream side (intake side) or the downstream side (discharge side) of the main pump 14 when a hydraulic actuator is operated.

According to this embodiment, the accumulator part 41 mainly includes an accumulator 410. The accumulator 410 is a device that stores hydraulic oil in the hydraulic circuit, and discharges the stored hydraulic oil as required. According to this embodiment, the accumulator 410 is a spring accumulator that uses the restoring force of a spring.

The first pressure storage part 42 is a hydraulic circuit element that controls a flow of hydraulic oil between the turning control part 40 (the turning hydraulic motor 21) and the accumulator part 41. According to this embodiment, the first pressure storage part 42 mainly includes a first selector valve 420 and a first check valve 421.

The first selector valve 420 is a valve that controls a flow of hydraulic oil from the turning control part 40 to the accumulator part 41 at the time of the pressure storing (regenerative) operation of the accumulator part 41. According to this embodiment, the first selector valve 420 is a three-port, three-position selector valve, for which a solenoid valve that switches valve positions in accordance with a control signal from the controller 30 is used. Alternatively, a proportional valve using a pilot pressure may be used. Specifically, the first selector valve 420 has a first position, a second position, and a third position as valve positions. In the drawing, parenthesized numbers indicate the numbers of valve positions. The same is the case with other selector valves.

The first position is a valve position that causes the first port 21L to communicate with the accumulator part 41. The second position is a valve position that interrupts the communication between the turning control part 40 and the accumulator part 41. The third position is a valve position that causes the second port 21R to communicate with the accumulator part 41.

The first check valve 421 is a valve that prevents hydraulic oil from flowing from the accumulator part 41 to the turning control part 40.

The second pressure storage part 43 is a hydraulic circuit element that controls a flow of hydraulic oil between the control valve 17 and the accumulator part 41. According to this embodiment, the second pressure storage part 43 is disposed among a boom cylinder flow control valve 17B, the tank, and the accumulator part 41, and mainly includes a second selector valve 430 and a second check valve 431. The boom cylinder flow control valve 17B may be one or more of the other flow control valves such as an arm cylinder flow control valve.

The second selector valve 430 is a valve that controls a flow of hydraulic oil from a hydraulic actuator to the accumulator part 41 at the time of the pressure storing (regenerative) operation of the accumulator part 41. According to this embodiment, the second selector valve 430 is a three-port, two-position selector valve, for which a solenoid valve that switches valve positions in accordance with a control signal from the controller 30 is used. Alternatively, a proportional valve using a pilot pressure may be used. Specifically, the second selector valve 430 has a first position and a second position as valve positions. The first position is a valve position that causes the discharge port of the boom cylinder flow control valve 17B to communicate with the tank and interrupts the communication between the discharge port of the boom cylinder flow control valve 17B and the accumulator part 41. Furthermore, the second position is a valve position that causes the discharge port of the boom cylinder flow control valve 17B to communicate with the accumulator part 41 and interrupts the communication between the discharge port of the boom cylinder flow control valve 17B and the tank.

The second check valve 431 is a valve that prevents hydraulic oil from flowing from the accumulator part 41 to the second selector valve 430.

The first pressure discharge part 44 is a hydraulic circuit element that controls a flow of hydraulic oil among the main pump 14, the control valve 17, and the accumulator part 41. According to this embodiment, the first pressure discharge part 44 mainly includes a third selector valve 440 and a third check valve 441.

The third selector valve 440 is a valve that controls a flow of hydraulic oil from the accumulator part 41 to a junction on the downstream side of the main pump 14 at the time of the pressure discharge (power running) operation of the accumulator part 41. According to this embodiment, the third selector valve 440 is a two-port, two-position selector valve, for which a solenoid valve that switches valve positions in accordance with a control signal from the controller 30 is used. Alternatively, a proportional valve using a pilot pressure may be used. Specifically, the third selector valve 440 has a first position and a second position as valve positions. The first position is a valve position that interrupts the communication between the junction on the downstream side of the main pump 14 and the accumulator part 41. Furthermore, the second position is a valve position that causes the junction on the downstream side of the main pump 14 to communicate with the accumulator part 41.

The third check valve 441 is a valve that prevents hydraulic oil from flowing from the main pump 14 to the accumulator part 41.

The second pressure discharge part 45 is a hydraulic circuit element that controls a flow of hydraulic oil among the tank, the main pump 14, and the accumulator part 41. According to this embodiment, the second pressure discharge part 45 mainly includes a fourth selector valve 450.

The fourth selector valve 450 is a valve that controls a flow of hydraulic oil from the accumulator part 41 to a junction on the upstream side of the main pump 14 at the time of the pressure discharge (power running) operation of the accumulator part 41. According to this embodiment, the fourth selector valve 450 is a three-port, two-position selector valve, for which a solenoid valve that switches valve positions in accordance with a control signal from the controller 30 is used. Alternatively, a proportional valve using a pilot pressure may be used. Specifically, the fourth selector valve 450 has a first position and a second position as valve positions. The first position is a valve position that causes the main pump 14 to communicate with the tank and interrupts the communication between the main pump 14 and the accumulator part 41. Furthermore, the second position is a valve position that interrupts the communication between the main pump 14 and the tank and causes the main pump 14 to communicate with the accumulator part 41.

Figure 4:
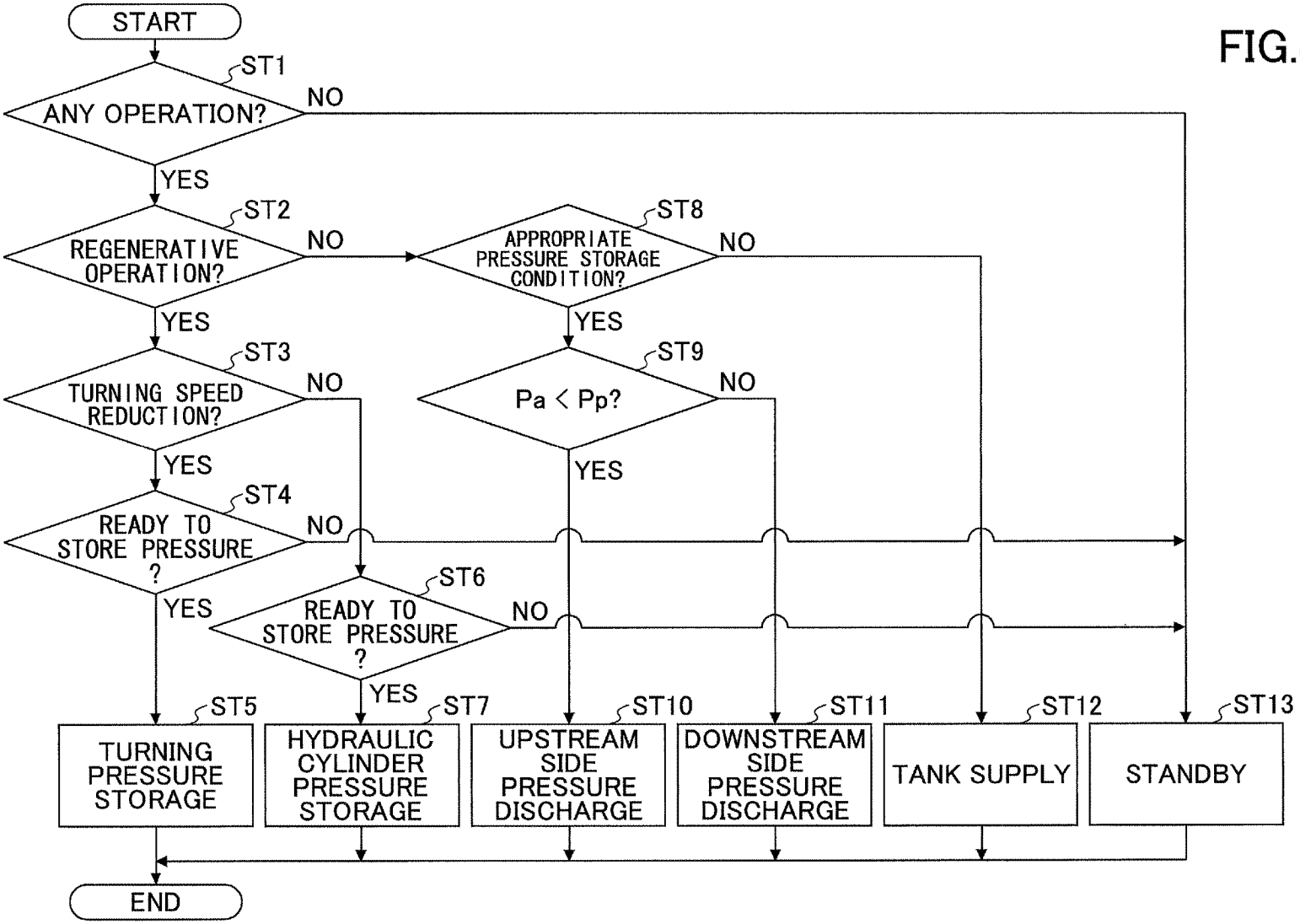
FIG. 4 is a flowchart illustrating a flow of a pressure storing and pressure discharge operation.

Here, a description is given, with reference to FIGS. 4 and 5, of the controller 30's operation of controlling the pressure storing and the pressure discharge of the accumulator part 41 (hereinafter, "pressure storing and pressure discharge operation"). FIG. 4 is a flowchart illustrating a flow of the pressure storing and pressure discharge operation, and the controller 30 repeatedly executes this pressure storing and pressure discharge operation at predetermined intervals. FIG. 5 is a correspondence table illustrating the correspondence between the state of the hydraulic circuit of FIG. 3 and the state of the selector valves.

First, the controller 30 determines whether a hydraulic actuator has been operated based on the outputs of various sensors for detecting the condition of the shovel (step ST1). According to this embodiment, the controller 30 determines whether a hydraulic actuator has been operated based on the outputs of the pressure sensor 29.

In response to determining that a hydraulic actuator has been operated (YES at step ST1), the controller 30 determines whether the operation is a regenerative operation or a power running operation (step ST2). According to this embodiment, the controller 30 determines, based on the outputs of the pressure sensor 29, whether a regenerative operation such as a turning speed reduction operation or a boom lowering operation has been performed or a power running operation such as a turning speed increasing operation or a boom raising operation has been performed.

In response to determining that a regenerative operation has been performed (YES at step ST2), the controller 30 determines whether the regenerative operation is a turning speed reduction operation or a regenerative operation other than that (step ST3).

In response to determining that the regenerative operation is a turning speed reduction operation (YES at step ST3), the controller 30 determines whether the accumulator part 41 is ready to store pressure (step ST4). According to this embodiment, the controller 30 determines whether the accumulator part 41 is ready to store pressure based on a pressure Pso on the braking side (discharge side) of the turning hydraulic motor 21, output by the pressure sensor S2L or the pressure sensor S2R, and an accumulator pressure Pa output by the pressure sensor S3. Specifically, the controller 30 determines that the accumulator part 41 is ready to store pressure if the pressure Pso exceeds the accumulator pressure Pa, and determines that the accumulator part 41 is not ready to store pressure if the pressure Pso is less than or equal to the accumulator pressure Pa.

In response to determining that the accumulator part 41 is ready to store pressure (YES at step ST4), the controller 30 sets the state of the hydraulic circuit to a state of "turning pressure storage" (step ST5).

As illustrated in FIG. 5, in the "turning pressure storage" state, the controller 30 sets the first selector valve 420 to the first position or third position so as to cause the turning control part 40 to communicate with the accumulator part 41 via the first pressure storage part 42. Furthermore, the controller 30 sets the second selector valve 430 to the first position so as to cause the discharge port of the boom cylinder flow control valve 17B to communicate with the tank and interrupt the communication between the discharge port of the boom cylinder flow control valve 17B and the accumulator part 41. Furthermore, the controller 30 sets the third selector valve 440 to the first position so as to interrupt the communication between the junction on the downstream side of the main pump 14 and the accumulator part 41. Furthermore, the controller 30 sets the fourth selector valve 450 to the first position so as to cause the main pump 14 to communicate with the tank and interrupt the communication between the main pump 14 and the accumulator part 41.

As a result, in the "turning pressure storage" state, hydraulic oil on the braking side of the turning hydraulic motor 21 flows to the accumulator part 41 via the first pressure storage part 42 so as to be stored in the accumulator 410. Furthermore, because each of the second selector valve 430, the third selector valve 440, and the fourth selector valve 450 is closed relative to the accumulator part 41, hydraulic oil on the braking side of the turning hydraulic motor 21 is prevented from flowing into locations other than the accumulator part 41.

Furthermore, in response to determining at step ST3 that the regenerative operation is a regenerative operation other than the turning speed reduction operation (NO at step ST3), the controller 30 determines whether the accumulator part 41 is ready to store pressure (step ST6). According to this embodiment, the controller 30 determines whether the accumulator part 41 is ready to store pressure based on a pressure Pbb of the bottom-side oil chamber of the boom cylinder 7, output by the pressure sensor S4, and the accumulator pressure Pa output by the pressure sensor S3. Specifically, the controller 30 determines that the accumulator part 41 is ready to store pressure if the pressure Pbb exceeds the accumulator pressure Pa, and determines that the accumulator part 41 is not ready to store pressure if the pressure Pbb is less than or equal to the accumulator pressure Pa.

In response to determining that the accumulator part 41 is ready to store pressure (YES at step ST6), the controller 30 sets the state of the hydraulic system to a state of "hydraulic cylinder pressure storage" (step ST7). According to this embodiment, the controller 30 sets the state of the hydraulic circuit to the "hydraulic cylinder pressure storage" state in response to determining that the regenerative operation is a boom lowering operation.

As illustrated in FIG. 5, in the "hydraulic cylinder pressure storage" state, the controller 30 sets the first selector valve 420 to the second position so as to interrupt the communication between the turning control part 40 and the accumulator part 41 via the first pressure storage part 42. Furthermore, the controller 30 sets the second selector valve 430 to the second position so as to cause the discharge port of the boom cylinder flow control valve 17B to communicate with the accumulator part 41 and interrupt the communication between the discharge port of the boom cylinder flow control valve 17B and the tank. A description of the states of the third selector valve 440 and the fourth selector valve 450, which are the same as the states at the time of "turning pressure storage," is omitted.

As a result, in the "hydraulic cylinder pressure storage" state, the bottom-side hydraulic oil of the boom cylinder 7 flows to the accumulator part 41 via the second pressure storage part 43 so as to be stored in the accumulator 410. Furthermore, because each of the first selector valve 420, the third selector valve 440, and the fourth selector valve 450 is closed relative to the accumulator part 41, the bottom-side hydraulic oil of the boom cylinder 7 is prevented from flowing into locations other than the accumulator part 41.

Furthermore, in response to determining at step ST2 that the operation is not a regenerative operation but a power running operation (NO at step ST2), the controller 30 determines whether the pressure storage condition of the accumulator part 41 is appropriate for pressure discharge (step ST8). According to this embodiment, the controller 30 determines whether the accumulator pressure Pa is less than a predetermined pressure Pa0 based on the output of the pressure sensor S3.

In response to determining that the pressure storage condition of the accumulator part 41 is appropriate for pressure discharge (YES at step ST8), the controller 30 determines whether the accumulator pressure Pa is less than a discharge pressure Pp that is the output of the pressure sensor S1 (step ST9). According to this embodiment, in response to determining that the accumulator pressure Pa is more than or equal to the predetermined pressure Pa0, the controller determines whether the accumulator pressure Pa is less than the discharge pressure Pp.

In response to determining that the accumulator pressure Pa is less than the discharge pressure Pp (YES at step ST9), the controller 30 sets the state of the hydraulic circuit to a state of "upstream side pressure discharge" (step ST10).

As illustrated in FIG. 5, in the "upstream side pressure discharge" state, the controller 30 sets the first selector valve 420 to the second position so as to interrupt the communication between the turning control part 40 and the accumulator part 41 via the first pressure storage part 42. Furthermore, the controller 30 sets the second selector valve 430 to the first position so as to cause the discharge port of the boom cylinder flow control valve 17B to communicate with the tank and interrupt the communication between the discharge port of the boom cylinder flow control valve 17B and the accumulator part 41. Furthermore, the controller 30 sets the third selector valve 440 to the first position so as to interrupt the communication between the junction on the downstream side of the main pump 14 and the accumulator part 41. Furthermore, the controller 30 sets the fourth selector valve 450 to the second position so as to interrupt the communication between the main pump 14 and the tank and cause the main pump 14 to communicate with the accumulator part 41.

As a result, in the "upstream side pressure discharge" state, hydraulic oil in the accumulator part 41 is discharged at the junction on the upstream side of the main pump 14 through the second pressure discharge part 45. Furthermore, because each of the first selector valve 420, the second selector valve 430, and the third selector valve 440 is closed relative to the accumulator part 41, hydraulic oil in the accumulator part 41 is prevented from being discharged at locations other than the junction on the upstream side of the main pump 14.

Furthermore, in response to determining at step ST9 that the accumulator pressure Pa is more than or equal to the discharge pressure Pp (NO at step ST9), the controller 30 sets the state of the hydraulic circuit to a state of "downstream side pressure discharge" (step ST11).

As illustrated in FIG. 5, in the "downstream side pressure discharge" state, the controller 30 sets the third selector valve 440 to the second position so as to cause the junction on the downstream side of the main pump 14 to communicate with the accumulator part 41. Furthermore, the controller 30 sets the fourth selector valve 450 to the first position so as to cause the main pump 14 to communicate with the tank and interrupt the communication between the main pump 14 and the accumulator part 41. A description of the states of the first selector valve 420 and the second selector valve 430, which are the same as the states at the time of "upstream side pressure discharge," is omitted.

As a result, in the "downstream side pressure discharge" state, hydraulic oil in the accumulator part 41 is discharged at the junction on the downstream side of the main pump 14 through the first pressure discharge part 44. Furthermore, because each of the first selector valve 420, the second selector valve 430, and the fourth selector valve 450 is closed relative to the accumulator part 41, hydraulic oil in the accumulator part 41 is prevented from being discharged at locations other than the junction on the downstream side of the main pump 14.

Furthermore, in response to determining at step ST8 that the pressure storage condition of the accumulator part 41 is not appropriate for pressure discharge (NO at step ST8), the controller 30 sets the state of the hydraulic circuit to a state of "tank supply" (step ST12), and prevents hydraulic oil from being discharged from the accumulator part 41.

As illustrated in FIG. 5, in the "tank supply" state, the controller 30 sets the third selector valve 440 to the first position so as to interrupt the communication between the junction on the downstream side of the main pump 14 and the accumulator part 41. Furthermore, the controller 30 sets the fourth selector valve 450 to the first position so as to cause the main pump 14 to communicate with the tank and interrupt the communication between the main pump 14 and the accumulator part 41. A description of the states of the first selector valve 420 and the second selector valve 430, which are the same as the states at the time of "upstream side pressure discharge," is omitted.

As a result, in the "tank supply" state, the main pump 14 supplies hydraulic oil drawn in from the tank to a hydraulic actuator in operation. Furthermore, because each of the first selector valve 420, the second selector valve 430, the third selector valve 440, and the fourth selector valve 450 is closed relative to the accumulator part 41, no hydraulic oil is stored in or discharged from the accumulator part 41. The first selector valve 420 and the second selector valve 430, however, may be switched so as to allow the accumulator part 41 to store hydraulic oil.

Furthermore, in response to determining at step ST1 that no hydraulic actuator is operated (NO at step ST1), the controller 30 sets the state of the hydraulic circuit to a state of "standby" (step ST13).

As illustrated in FIG. 5, in the "standby" state, the states of the first selector valve 420, the second selector valve 430, the third selector valve 440, and the fourth selector valve 450 are the same as the states at the time of "tank supply." As a result, in the "standby" state, no hydraulic oil is stored in or discharged from the accumulator part 41.

Furthermore, also in response to determining at step ST4 that the accumulator part 41 is not ready to store pressure (NO at step ST4), the controller 30 sets the state of the hydraulic circuit to the "standby" state (step ST13). In this case, because the first selector valve 420 is at the second position, hydraulic oil on the braking side (discharge side) of the turning hydraulic motor 21 is discharged to the tank via the relief valve 400L or the relief valve 400R.

Furthermore, also in response to determining at step ST6 that the accumulator part 41 is not ready to store pressure (NO at step ST6), the controller 30 sets the state of the hydraulic circuit to the "standby" state (step ST13). In this case, because the second selector valve 430 is at the first position, hydraulic oil in the bottom-side oil chamber of the boom cylinder 7 is discharged to the tank via the boom cylinder flow control valve 17B and the second selector valve 430.

Figure 6:
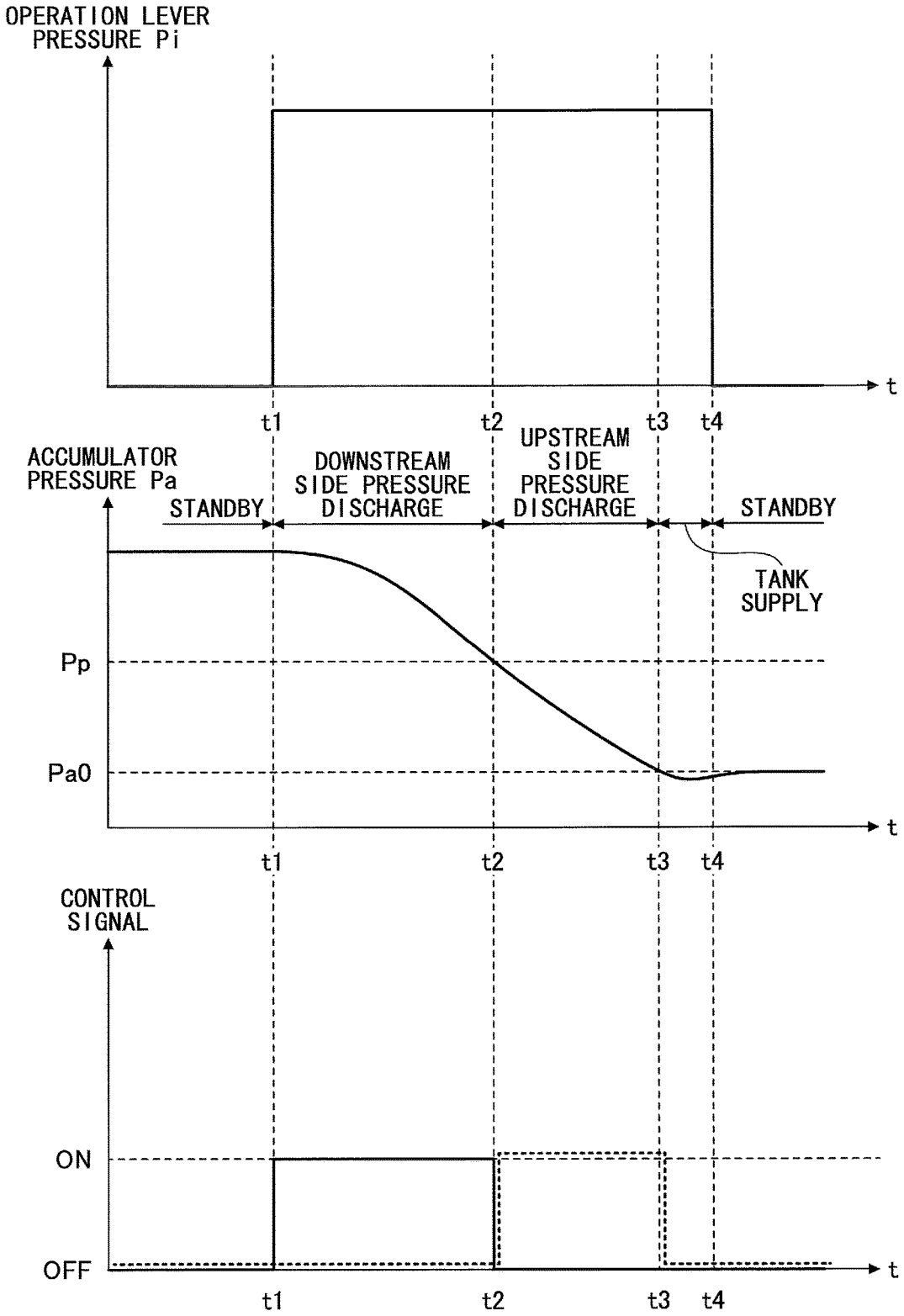
FIG. 6 is a graph illustrating temporal transitions of an operation lever pressure, an accumulator pressure, and control signals at the time of the pressure discharge of an accumulator.

Next, a description is given, with reference to FIG. 6, of the pressure discharge of the accumulator 410 provided in the shovel of FIG. 1. FIG. 6 illustrates temporal transitions of an operation lever pressure, an accumulator pressure, and control signals for the third selector valve 440 and the fourth selector valve 450 at the time of the pressure discharge of the accumulator 410. According to this embodiment, the transition of an operation lever pressure Pi at the top of FIG. 6 represents the transition of a pilot pressure that varies in accordance with the operation of a boom operation lever in a boom raising direction. Furthermore, the transition of the accumulator pressure Pa in the middle of FIG. 6 represents the transition of the detected value of the pressure sensor 83. Furthermore, the transitions of control signals at the bottom of FIG. 6 represent the transition of a control signal for the third selector valve 440 (solid line) and the transition of a control signal for the fourth selector valve 450 (dotted line).

At time t1, when the boom operation lever is tilted in the boom raising direction from a neutral position, the operation lever pressure Pi increases to a pressure commensurate to the amount of tilt of the lever.

In response to determining based on the output of the pressure sensor 29 that the boom raising operation as a power running operation has been performed, the controller 30 determines whether the accumulator pressure Pa is more than or equal to the predetermined pressure Pa0.

Then, in response to determining that the accumulator pressure Pa is more than or equal to the predetermined pressure Pa0 so as to be at a level appropriate for pressure discharge, the controller 30 causes hydraulic oil in the accumulator 410 to be discharged.

According to this embodiment, the controller 30 causes the discharge of hydraulic oil in the accumulator 410 to be started at time t1.

Specifically, as illustrated in the middle of FIG. 6, in response to determining that the accumulator pressure Pa is more than or equal to the discharge pressure Pp of the main pump 14 at time t1, the controller 30 sets the state of the hydraulic circuit to the "downstream side pressure discharge" state. According to this embodiment, the discharge pressure Pp, which is actually a variable value that varies in accordance with a load, is assumed to be a constant value for simplification of description.

To be more specific, the controller 30 sets the level of the control signal for the third selector valve 440 to ON level (a level for implementing the second position) at time t1 as illustrated at the bottom of FIG. 6. In response to receiving the ON-level control signal, the third selector valve 440 is set to the second position so as to cause the junction on the downstream side of the main pump 14 to communicate with the accumulator 410. The bottom-side oil chamber of the boom cylinder 7 directly receives hydraulic oil discharged from the accumulator 410. That is, the bottom-side oil chamber of the boom cylinder 7 receives hydraulic oil discharged from the accumulator 410 without intervention of the main pump 14 so as to expand to raise the boom 4.

Thus, at time t1, the accumulator 410 discharges hydraulic oil in the accumulator 410 to the junction on the downstream side of the main pump 14. Therefore, the accumulator pressure Pa decreases over time so as to fall below the discharge pressure Pp at time t2 as illustrated in the middle of FIG. 6.

In response to determining at time t2 that the accumulator pressure Pa is less than the discharge pressure Pp, the controller 30 sets the state of the hydraulic circuit to the "upstream side pressure discharge" state.

To be more specific, at time t2, the controller 30 sets the level of the control signal for the third selector valve 440 to OFF level (a level for implementing the first position) and sets the level of the control signal for the fourth selector valve 450 to ON level as illustrated at the bottom of FIG. 6. In response to receiving the OFF-level control signal, the third selector valve 440 is set to the first position so as to interrupt the communication between the junction on the downstream side of the main pump 14 and the accumulator 410. Meanwhile, in response to receiving the ON-level control signal, the fourth selector valve 450 is set to the second position so as to cause the junction on the upstream side of the main pump 14 to communicate with the accumulator 410. The bottom-side oil chamber of the boom cylinder 7 indirectly receives hydraulic oil discharged from the accumulator 410. That is, the bottom-side oil chamber of the boom cylinder 7 receives hydraulic oil discharged by the main pump 14 that has drawn in hydraulic oil discharged from the accumulator 410, so as to expand to continue raising the boom 4.

Thus, at time t2, the accumulator 410 stops discharging hydraulic oil in the accumulator 410 to the junction on the downstream side of the main pump 14, and discharges hydraulic oil in the accumulator 410 to the junction on the upstream side of the main pump 14. Thereafter, the accumulator pressure Pa continues to decrease over time so as to fall below the predetermined pressure Pa0 at time t3 as illustrated in the middle of FIG. 6.

In response to determining at time t3 that the accumulator pressure Pa is less than the predetermined pressure Pa0, the controller 30 sets the state of the hydraulic circuit to the "tank supply" state.

To be more specific, at time t3, the controller 30 sets the level of the control signal for the fourth selector valve 450 to OFF level as illustrated at the bottom of FIG. 6. In response to receiving the OFF-level control signal, the fourth selector valve 450 is set to the first position so as to interrupt the communication between the junction on the upstream side of the main pump 14 and the accumulator 410. That is, the controller 30 stops discharging any hydraulic oil in the accumulator 410. Then, the bottom-side oil chamber of the boom cylinder 7 receives hydraulic oil discharged by the main pump 14 that has drawn in hydraulic oil from the tank, so as to expand to further continue raising the boom 4.

At time t4, when the boom operation lever is returned to the neutral position, the boom cylinder flow control valve 17B interrupts the communication between the main pump 14 and the boom cylinder 7 so as to stop expansion of the bottom-side oil chamber of the boom cylinder 7.

According to the above-described hydraulic circuit, by the above-described configuration, it is possible to store hydraulic oil with regenerable energy discharged from a hydraulic actuator in the accumulator 410 and reuse the stored hydraulic oil. Furthermore, according to the above-described hydraulic circuit, it is made possible to use hydraulic oil in the accumulator part 41 not only when the accumulator pressure Pa is more than or equal to the discharge pressure Pp but also when the accumulator pressure Pa is less than the discharge pressure Pp. Therefore, according to the above-described circuit, it is possible to more efficiently use hydraulic energy stored in the accumulator part 41.

Specifically, according to the above-described hydraulic circuit, it is possible to cause the accumulator part 41 to perform a pressure discharge (power running) operation even when the pressure of the accumulator part 41 is lower than the drive-side pressure of a hydraulic actuator to be operated.

Furthermore, according to the above-described hydraulic circuit, hydraulic oil is prevented from flowing into the accumulator part 41 when a power running operation is to be performed. Alternatively, however, hydraulic oil may be caused to flow into the accumulator part.

Furthermore, according to the above-described hydraulic circuit, the controller 30 executes the alternative of turning pressure storage or hydraulic cylinder pressure storage. Alternatively, however, the controller 30 may execute turning pressure storage and hydraulic cylinder pressure storage simultaneously. Specifically, the controller 30 may set the second selector valve 430 to the second position while setting the first selector valve 420 to the first position or the third position.

Furthermore, according to the above-described hydraulic circuit, it is possible to store returning oil from a hydraulic actuator in the accumulator part 41 and discharge the stored hydraulic oil as required. Therefore, according to the above-described hydraulic circuit, it is possible to reduce the capacity of the tank or omit the tank itself compared with a configuration without the accumulator part 41.

Furthermore, according to the above-described hydraulic circuit, a hydraulic actuator is driven using hydraulic oil discharged by the main pump 14 or using both hydraulic oil discharged by the main pump 14 and hydraulic oil stored in the accumulator part 41. According to the above-described hydraulic circuit, however, it is also possible to allow hydraulic oil to flow from the main pump 14 to the accumulator part 41 by omitting the third check valve 441, so that hydraulic oil discharged by the main pump 14 may be stored in the accumulator part 41. Furthermore, according to the above-described hydraulic circuit, it is also possible to allow a hydraulic actuator to be driven using only hydraulic oil stored in the accumulator part 41.

Furthermore, according to the above-described hydraulic circuit, hydraulic oil from the accumulator part 41 is caused to merge at the junction on the upstream side or the junction on the downstream side of the main pump 14. The present invention, however, is not limited to this configuration. For example, the above-described hydraulic circuit may have a configuration that allows the accumulator part 41 to discharge hydraulic oil directly to a hydraulic actuator instead of the configuration of causing hydraulic oil from the accumulator part 41 to merge at the junction on the downstream side of the main pump 14. On this basis, the above-described hydraulic circuit may be configured to cause hydraulic oil from the accumulator part 41 to merge at the junction on the upstream side of the main pump 14.

Furthermore, according to the above-described hydraulic circuit, it is made possible to discharge hydraulic oil from the accumulator part 41 at the junction on the upstream side of the main pump 14. Therefore, compared with the case of drawing in relatively low-pressure hydraulic oil from the tank and discharging the drawn-in hydraulic oil, it is possible for the main pump 14 to reduce absorbed horsepower (a torque necessary to discharge a predetermined amount of hydraulic oil) and promote energy saving. Furthermore, it is possible for the main pump 14 to increase the responsiveness of discharge quantity control.

Furthermore, according to the above-described hydraulic circuit, the accumulator part 41 includes the single accumulator 410. The present invention, however, is not limited to this configuration. For example, the accumulator part 41 may include two or more accumulators connected in parallel. Furthermore, each accumulator may have any capacity. The accumulators may have the same capacity or capacities different from each other.

The accumulators may have different maximum discharge pressures in order to make it possible to select an accumulator as a supply source or a storage destination of hydraulic oil from among the accumulators that are different in maximum discharge pressure in accordance with a required discharge pressure. The "maximum discharge pressure" is a maximum pressure dischargeable by an accumulator, and is a pressure determined by the maximum pressure of the accumulator at the time of a pressure storing (regenerative) operation.

The accumulators may store or discharge pressure at respective different times. Two or more of the accumulators may store or discharge pressure at respective times that overlap or coincide with each other.

Figure 7:
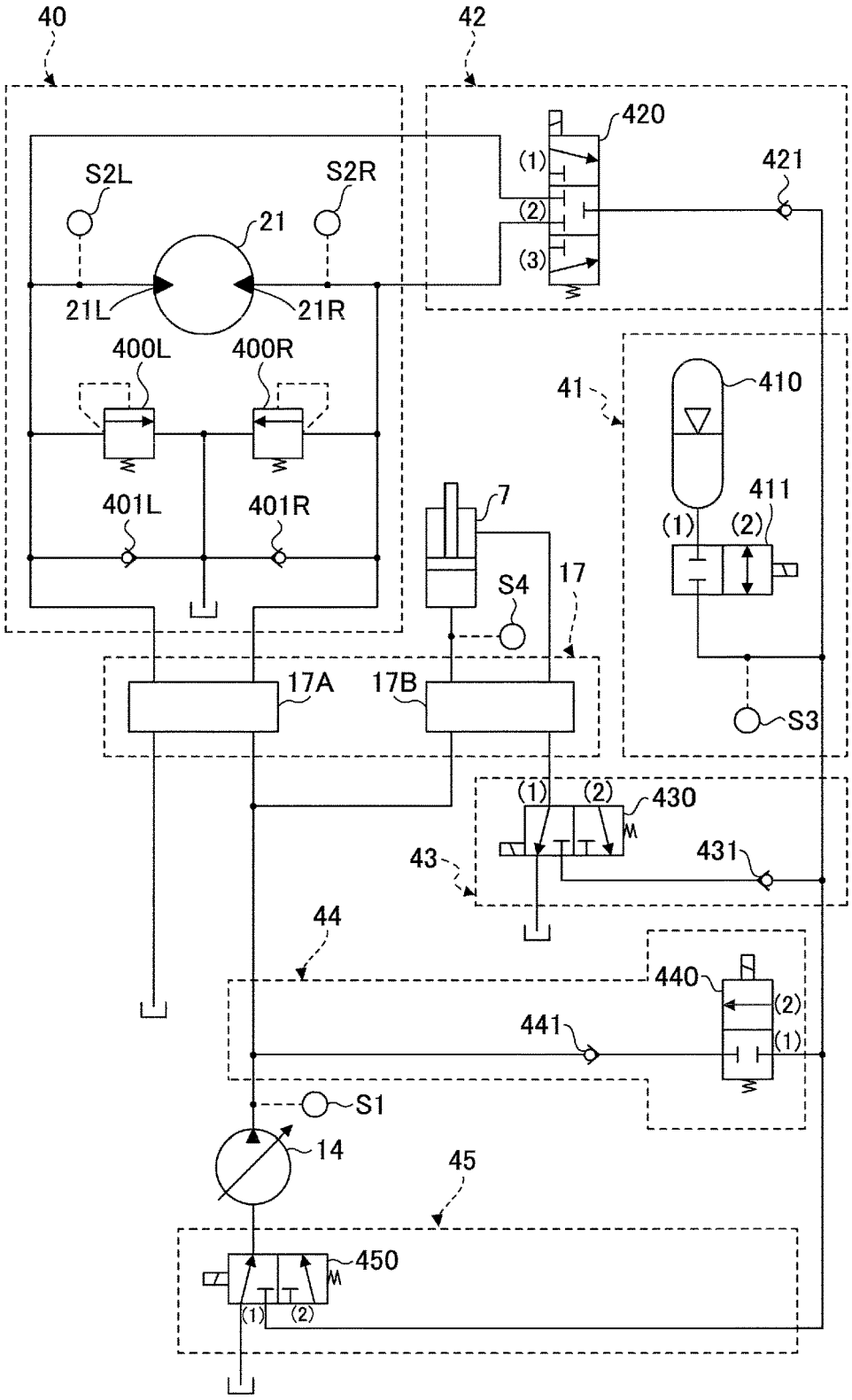
FIG. 7 is a diagram illustrating a configuration of part of a hydraulic circuit.

Next, a description is given, with reference to FIG. 7, of the pressure storage and the pressure discharge of an accumulator in another hydraulic circuit provided in the hydraulic shovel according to an embodiment of the present invention. FIG. 7 illustrates a configuration of part of another hydraulic circuit provided in the hydraulic shovel of FIG. 1.

The hydraulic circuit of FIG. 7 is different from the hydraulic circuit of FIG. 3 in including an accumulator selector valve 411, but otherwise is the same as the hydraulic circuit of FIG. 3. Therefore, a description of common points is omitted, and a description is given in detail of differences.

The accumulator selector valve 411 is a valve that controls the communication and interruption between the accumulator 410 and other parts of the hydraulic circuit. According to this embodiment, the accumulator selector valve 411 is a two-port, two-position selector valve, for which a solenoid valve that switches valve positions in accordance with a control signal from the controller 30 is used. Alternatively, a proportional valve using a pilot pressure may be used. Specifically, the accumulator selector valve 411 has a first position and a second position as valve positions. The first position is a valve position that interrupts the communication between the accumulator 410 and other parts of the hydraulic circuit. The second position is a valve position that causes the accumulator 410 to communicate with other parts of the hydraulic circuit.

This configuration makes it possible for the controller 30 to cause hydraulic oil flowing out from the turning control part 40 through the first selector valve 420 to merge with the junction on the upstream side or the downstream side of the main pump 14 without being stored in the accumulator 410.

Specifically, while setting the accumulator selector valve 411 to the first position and setting the first selector valve 420 to the first position or the third position, the controller 30 sets one of the third selector valve 440 and the fourth selector valve 450 to the second position. As a result, it is possible for the controller 30 to cause hydraulic oil flowing out from the braking side of the turning hydraulic motor 21 to merge with the junction on the upstream side or the downstream side of the main pump 14.

Likewise, it is possible for the controller 30 to cause hydraulic oil flowing out from the boom cylinder flow control valve 17B through the second selector valve 430 to merge with the junction on the upstream side or the downstream side of the main pump 14 without being stored in the accumulator 410.

Specifically, while setting the accumulator selector valve 411 to the first position and setting the second selector valve 430 to the second position, the controller 30 sets one of the third selector valve 440 and the fourth selector valve 450 to the second position. As a result, it is possible for the controller 30 to cause hydraulic oil flowing out from the bottom-side oil chamber of the boom cylinder 7 to merge with the junction on the upstream side or the downstream side of the main pump 14.

Figure 8:
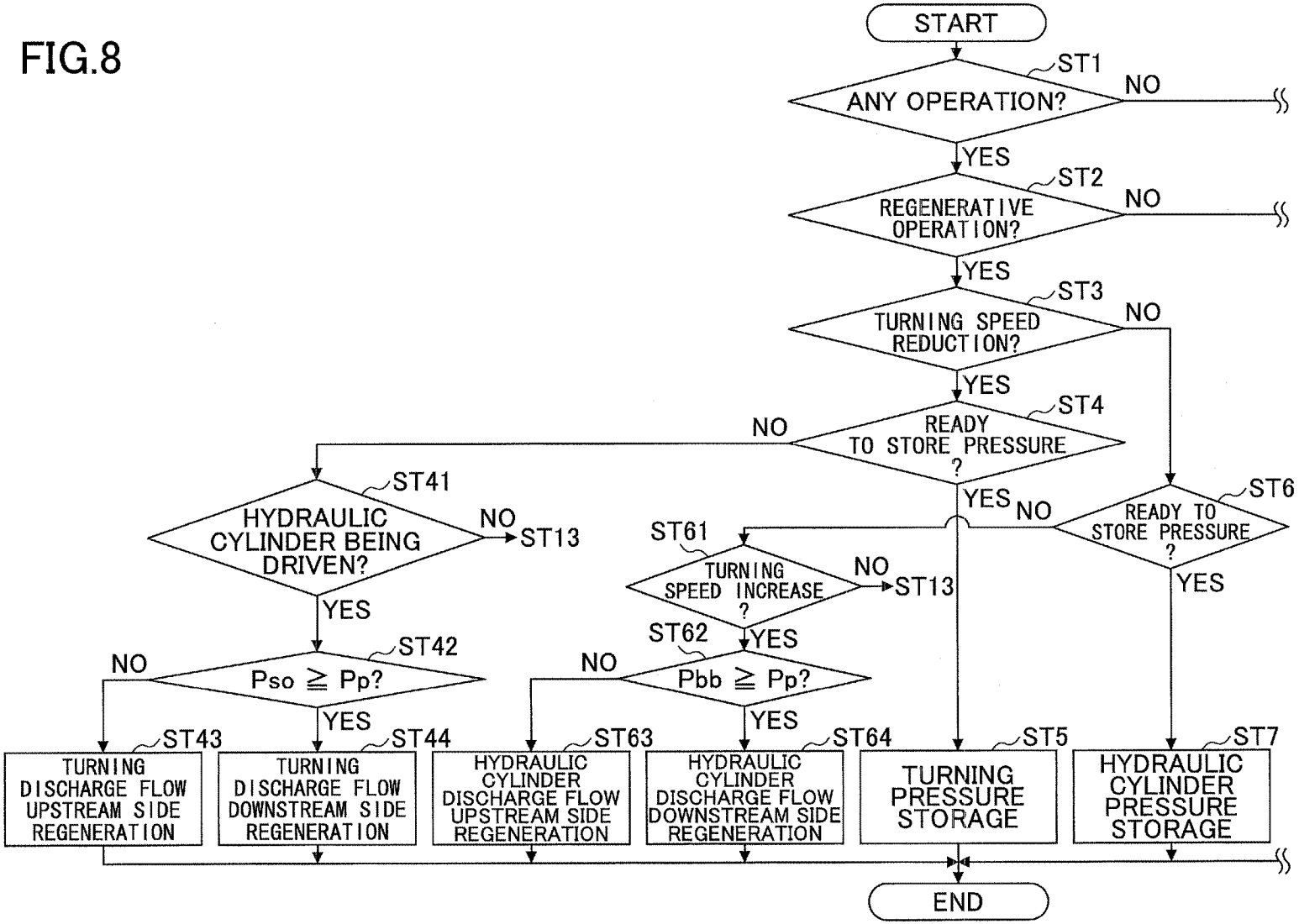
FIG. 8 is a flowchart illustrating a flow of the pressure storing and pressure discharge operation.

Here, a description is given, with reference to FIGS. 8 and 9, of the pressure storing and pressure discharge operation in the hydraulic circuit of FIG. 7. FIG. 8 is a flowchart illustrating a flow of the pressure storing and pressure discharge operation in the hydraulic circuit of FIG. 7. FIG. 9 is a correspondence table illustrating the correspondence between the state of the hydraulic circuit of FIG. 7 and the state of the selector valves. Furthermore, FIG. 8 is different from the flowchart of FIG. 4 in the processes in the case when it is determined that the accumulator part 41 is not ready to store pressure (the processes in the case of NO at step ST4 and in the case of NO at step ST6), but otherwise is the same as the flowchart of FIG. 4. Therefore, a graphical representation and description of a common portion is omitted.

In response to determining that the regenerative operation is a turning speed reduction operation (YES at step ST3), the controller 30 determines whether the accumulator part 41 is ready to store pressure (step ST4).

Then, in response to determining that the accumulator part 41 is not ready to store pressure (NO at step ST4), the controller 30 determines whether a hydraulic actuator is being driven (step ST41). According to this embodiment, the controller 30 determines, based on the output of the pressure sensor 29, whether the boom 4 is being operated, that is, whether the boom cylinder 7 is being driven.

Then, in response to determining that a hydraulic cylinder is being driven (YES at step ST41), the controller 30 determines whether the pressure Pso on the braking side (discharge side) of the turning hydraulic motor 21 is more than or equal to the discharge pressure Pp (step ST42).

Then, in response to determining that the pressure Pso is less than the discharge pressure Pp (NO at step ST42), the controller 30 sets the state of the hydraulic circuit to a state of "turning discharge flow upstream side regeneration" (step ST43).

As illustrated in FIG. 9, in the "turning discharge flow upstream side regeneration" state, the controller 30 sets the first selector valve 420 to the first position or the third position, sets the fourth selector valve 450 to the second position, and sets the accumulator selector valve 411 to the first position. As a result, while interrupting the communication between the accumulator 410 and other parts of the hydraulic circuit, the controller 30 causes the turning control part 40 to communicate with the junction on the upstream side of the main pump 14. Furthermore, the controller 30 sets the second selector valve 430 to the first position so as to cause the discharge port of the boom cylinder flow control valve 17B to communicate with the tank. Furthermore, the controller 30 sets the third selector valve 440 to the first position so as to interrupt the communication between the turning control part 40 and the junction on the downstream side of the main pump 14.

As a result, in the "turning discharge flow upstream side regeneration" state, hydraulic oil discharged from the braking side (discharge side) of the turning hydraulic motor 21 is discharged (regenerated) at the junction on the upstream side of the main pump 14 through the first pressure storage part 42 and the second pressure discharge part 45.

On the other hand, in response to determining that the pressure Pso is more than or equal to the discharge pressure Pp (YES at step ST42), the controller 30 sets the state of the hydraulic circuit to a state of "turning discharge flow downstream side regeneration" (step ST44).

As illustrated in FIG. 9, in the "turning discharge flow downstream side regeneration" state, the controller 30 sets the first selector valve 420 to the first position or the third position, sets the third selector valve 440 to the second position, and sets the accumulator selector valve 411 to the first position. As a result, while interrupting the communication between the accumulator 410 and other parts of the hydraulic circuit, the controller 30 causes the turning control part 40 to communicate with the junction on the downstream side of the main pump 14. Furthermore, the controller 30 sets the second selector valve 430 to the first position so as to cause the discharge port of the boom cylinder flow control valve 17B to communicate with the tank. Furthermore, the controller 30 sets the fourth selector valve 450 to the first position so as to interrupt the communication between the turning control part 40 and the junction on the upstream side of the main pump 14.

As a result, in the "turning discharge flow downstream side regeneration" state, hydraulic oil discharged from the braking side (discharge side) of the turning hydraulic motor 21 is discharged (regenerated) at the junction on the downstream side of the main pump 14 through the first pressure storage part 42 and the first pressure discharge part 44.

In response to determining at step ST41 that no hydraulic cylinder is being driven (NO at step ST41), the controller 30 sets the state of the hydraulic circuit to the "standby" state (step ST13). In this case, because the first selector valve 420 is at the second position, hydraulic oil on the braking side (discharge side) of the turning hydraulic motor 21 is discharged to the tank via the relief valve 400L or the relief valve 400R.

Furthermore, in response to determining at step ST3 that the regenerative operation is a regenerative operation other than the turning speed reduction operation (NO at step ST3), the controller 30 determines whether the accumulator part 41 is ready to store pressure (step ST6). According to this embodiment, in response to determining that the regenerative operation is a boom lowering operation, the controller 30 determines whether the accumulator part 41 is ready to store pressure.

Then, in response to determining that the accumulator part 41 is not ready to store pressure (NO at step ST6), the controller 30 determines whether a turning speed increasing operation is being performed (step ST61).

Then, in response to determining that a turning speed increasing operation is being performed (YES at step ST61), the controller 30 determines whether the pressure Pbb of the bottom-side oil chamber of the boom cylinder 7 is more than or equal to the discharge pressure Pp (step ST62).

Then, in response to determining that the pressure Pbb is less than the discharge pressure Pp (NO at step ST62), the controller 30 sets the state of the hydraulic circuit to a state of "hydraulic cylinder discharge flow upstream side regeneration" (step ST63).

As illustrated in FIG. 9, in the "hydraulic cylinder discharge flow upstream side regeneration" state, the controller 30 sets the second selector valve 430 to the second position, sets the fourth selector valve 450 to the second position, and sets the accumulator selector valve 411 to the first position. As a result, while interrupting the communication between the accumulator 410 and other parts of the hydraulic circuit, the controller 30 causes the bottom-side oil chamber of the boom cylinder 7 to communicate with the junction on the upstream side of the main pump 14. Furthermore, the controller 30 sets the first selector valve 420 to the second position so as to interrupt the communication between the turning control part 40 and the first pressure storage part 42. Furthermore, the controller 30 sets the third selector valve 440 to the first position so as to interrupt the communication between the bottom-side oil chamber of the boom cylinder 7 and the junction on the downstream side of the main pump 14.

As a result, in the "hydraulic cylinder discharge flow upstream side regeneration" state, hydraulic oil discharged from the bottom-side oil chamber of the boom cylinder 7 is discharged (regenerated) at the junction on the upstream side of the main pump 14 through the second pressure storage part 43 and the second pressure discharge part 45.

On the other hand, in response to determining that the pressure Pbb is more than or equal to the discharge pressure Pp (YES at step ST62), the controller 30 sets the state of the hydraulic circuit to a state of "hydraulic cylinder discharge flow downstream side regeneration" (step ST64).

As illustrated in FIG. 9, in the "hydraulic cylinder discharge flow downstream side regeneration" state, the controller 30 sets the second selector valve 430 to the second position, sets the third selector valve 440 to the second position, and sets the accumulator selector valve 411 to the first position. As a result, while interrupting the communication between the accumulator 410 and other parts of the hydraulic circuit, the controller 30 causes the bottom-side oil chamber of the boom cylinder 7 to communicate with the junction on the downstream side of the main pump 14.

Furthermore, the controller 30 sets the first selector valve 420 to the second position so as to interrupt the communication between the turning control part 40 and the first pressure storage part 42. Furthermore, the controller 30 sets the fourth selector valve 450 to the first position so as to interrupt the communication between the bottom-side oil chamber of the boom cylinder 7 and the junction on the upstream side of the main pump 14.

As a result, in the "hydraulic cylinder discharge flow downstream side regeneration" state, hydraulic oil discharged from the bottom-side oil chamber of the boom cylinder 7 is discharged (regenerated) at the junction on the downstream side of the main pump 14 through the second pressure storage part 43 and the first pressure discharge part 44.

In response to determining at step ST61 that a turning speed increasing operation is not being performed (NO at step ST61), the controller 30 sets the state of the hydraulic circuit to the "standby" state (step ST13). In this case, because the second selector valve 430 is at the first position, the hydraulic oil of the bottom-side oil chamber of the boom cylinder 7 is discharged to the tank via the boom cylinder flow control valve 17B and the second selector valve 430.

According to the above-described configuration, the hydraulic circuit of FIG. 7 produces the effect that hydraulic oil with regenerable energy discharged from a hydraulic actuator may be reused without being stored in the accumulator 410, in addition to the effect by the hydraulic circuit of FIG. 3.

A detailed description is given above of preferred embodiments of the present invention. The present invention, however, is not limited to the above-described embodiments, and variations and replacements may be added to the above-described embodiments without departing from the scope of the present invention.

For example, according to the above-described embodiments, the accumulator 410 stores hydraulic oil from the turning hydraulic motor 21 and the boom cylinder 7. The present invention, however, is not limited to this configuration. For example, the accumulator 410 may be configured to store hydraulic oil from the turning hydraulic motor 21 and other hydraulic actuators. In this case, in the hydraulic circuit of FIG. 7 in particular, when one or more hydraulic actuators perform regenerative operations and one or more other hydraulic actuators perform power running operations, hydraulic oil discharged from the hydraulic actuators that have performed regenerative operations may be merged at the junction on the upstream side or the downstream side of the main pump 14 without being stored in the accumulator 410, so as to be supplied to the hydraulic actuators that have performed power running operations. Furthermore, the accumulator 410 may also be configured to store only hydraulic oil from the turning hydraulic motor 21. In this case, the second pressure storage part 43 may be omitted. Furthermore, the accumulator 410 may also be configured to store only hydraulic oil from one or more hydraulic actuators other than the turning hydraulic motor 21. In this case, the first pressure storage part 42 may be omitted, and the turning hydraulic motor 21 may be an electric motor.

Figure 10:
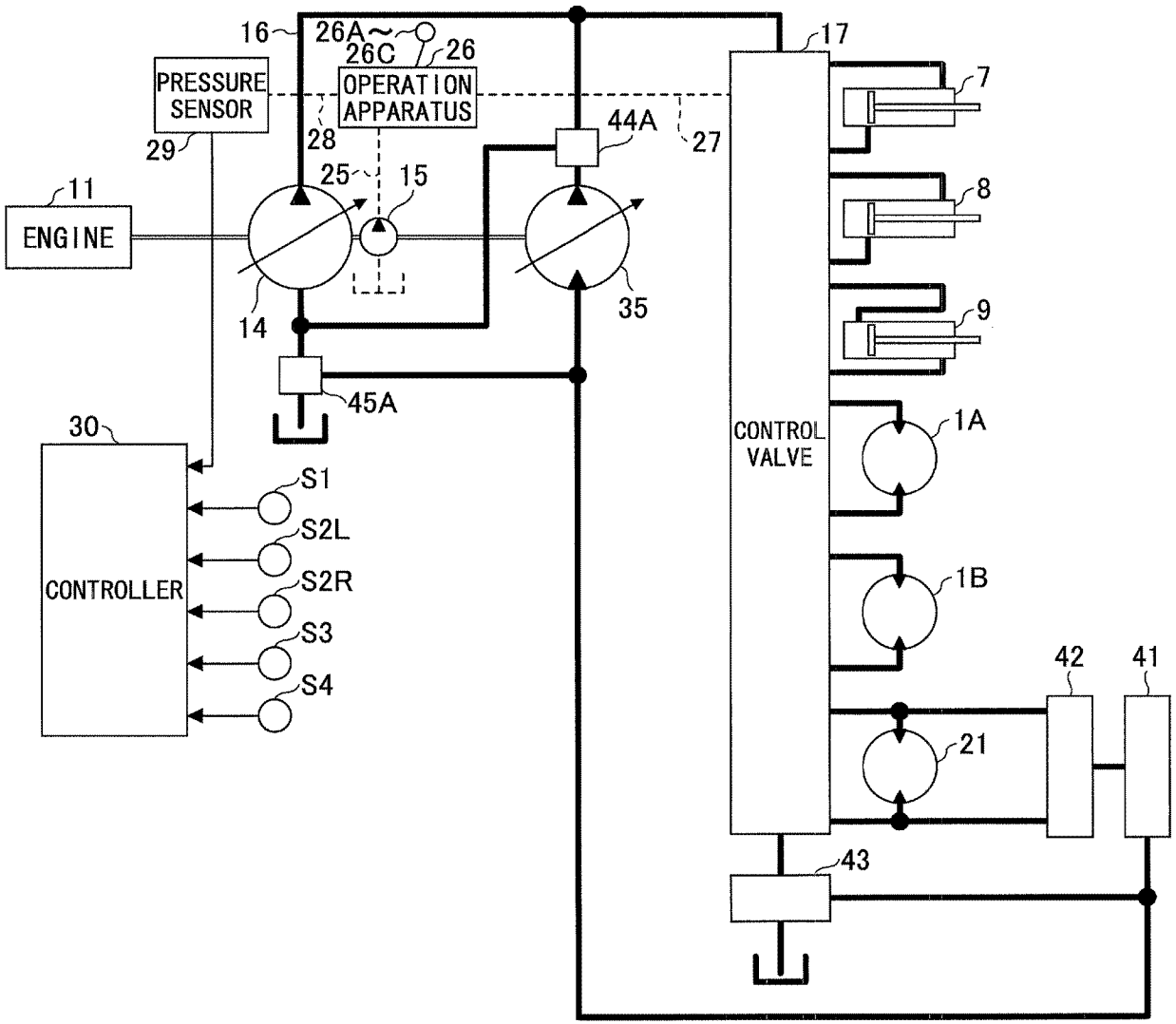
FIG. 10 is a block diagram illustrating another configuration of the drive system of the hydraulic shovel of FIG. 1.

FIG. 10 is a block diagram illustrating another configuration of the drive system of the hydraulic shovel of FIG. 1. In FIG. 10, a mechanical power system, a high-pressure hydraulic line, a pilot line, and an electric drive and control system are indicated by a double line, a thick solid line, a broken line, and a thin solid line, respectively.

The main pump 14 serving as a variable displacement hydraulic pump, the pilot pump 15 serving as a fixed displacement hydraulic pump, and a pump motor 35 as a variable displacement hydraulic pump motor are connected to the output shaft of the engine 11 serving as a mechanical drive part. The control valve 17 is connected to the main pump 14 via the high-pressure hydraulic line 16. Furthermore, the operation apparatus 26 is connected to the pilot pump 15 via the pilot line 25.

The control valve 17 is a device that controls a hydraulic system in the hydraulic shovel. Hydraulic actuators such as the traveling hydraulic motor 1A (right), the traveling hydraulic motor 1B (left), the boom cylinder 7, the arm cylinder 8, the bucket cylinder 9, and the turning hydraulic motor 21 are connected to the control valve 17 via high-pressure hydraulic lines.

The operation apparatus 26 includes the lever 26A, the lever 26B, and the pedal 26C. The lever 26A, the lever 26B, and the pedal 26C are connected to the control valve 17 and the pressure sensor 29 via the hydraulic lines 27 and 28, respectively.

The pressure sensor 29 is a sensor for detecting what an operator's operation is using the operation apparatus 26. The pressure sensor 29, for example, detects the direction of operation and the amount of operation of a lever or pedal of the operation apparatus 26 corresponding to each hydraulic actuator in the form of pressure, and outputs a detected value to a controller 30. What an operation of the operation apparatus 26 is may be detected using a sensor other than a pressure sensor.

The controller 30 is a controller serving as a main control part that controls the driving of the hydraulic shovel. The controller 30 is composed of a processing unit that includes a CPU (Central Processing Unit) and an internal memory, and controls the driving of the hydraulic shovel by causing the CPU to execute a drive control program stored in the internal memory.

The pressure sensor S1 is a sensor that detects the discharge pressure of the main pump 14, and outputs a detected value to the controller 30.

The pressure sensor S2L is a sensor that detects the pressure of hydraulic oil on the first port side of the turning hydraulic motor 21, and outputs a detected value to the controller 30.

The pressure sensor S2R is a sensor that detects the pressure of hydraulic oil on the second port side of the turning hydraulic motor 21, and outputs a detected value to the controller 30.

The pressure sensor S3 is a sensor that detects the pressure of hydraulic oil of the accumulator part 41 (hereinafter referred to as "accumulator pressure"), and outputs a detected value to the controller 30.

The pressure sensor S4 is a sensor that detects the pressure of hydraulic oil of the bottom-side oil chamber of the boom cylinder 7, and outputs a detected value to the controller 30.

The accumulator part 41 is a hydraulic circuit element that stores hydraulic oil in a hydraulic circuit and discharges the stored hydraulic oil as required.

The first pressure storage part 42 is a hydraulic circuit element that controls a flow of hydraulic oil between the turning hydraulic motor 21 and the accumulator part 41.

The second pressure storage part 43 is a hydraulic circuit element that controls a flow of hydraulic oil between the control valve 17 and the accumulator part 41.

A first pressure discharge part 44A is a hydraulic circuit element that controls a flow of hydraulic oil among the main pump 14, the control valve 17, and the accumulator part 41.

A second pressure discharge part 45A is a hydraulic circuit element that controls a flow of hydraulic oil among the main pump 14, the tank, and the accumulator part 41.

A description is given in detail below of the accumulator part 41, the first pressure storage part 42, the second pressure storage part 43, the first pressure discharge part 44A, and the second pressure discharge part 45A.

Figure 11:
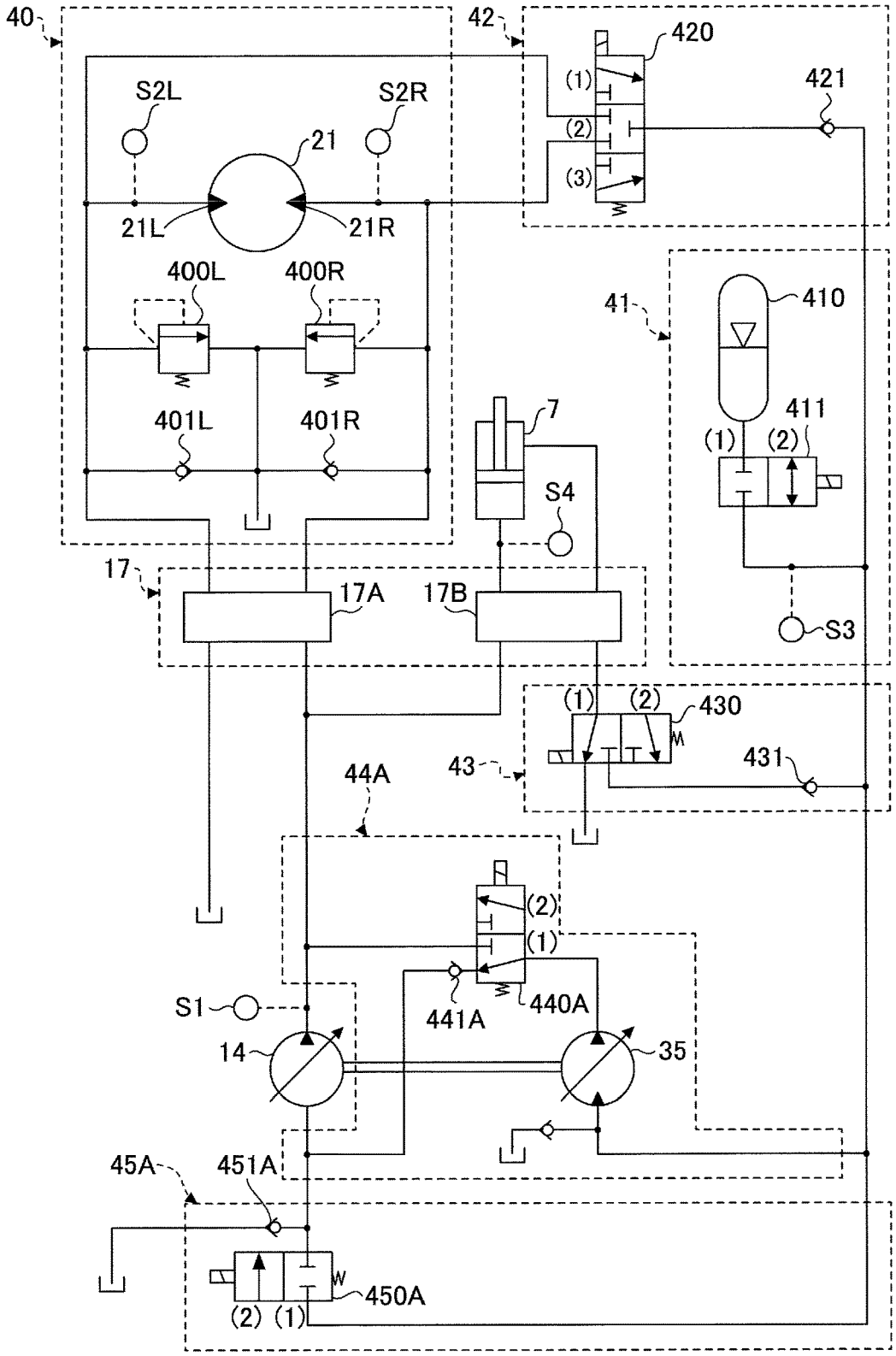
FIG. 11 is a diagram illustrating a configuration of part of a hydraulic circuit.

Next, a description is given, with reference to FIG. 11, of the pressure storing and the pressure discharge of the accumulator part 41 provided in the hydraulic shovel of FIG. 1. FIG. 11 illustrates a configuration of part of the hydraulic circuit provided in the hydraulic shovel of FIG. 1.

The hydraulic circuit illustrated in FIG. 11 mainly includes the turning control part 40, the accumulator part 41, the first pressure storage part 42, the second pressure storage part 43, the first pressure discharge part 44A, and the second pressure discharge part 45A.

The turning control part 40 mainly includes the turning hydraulic motor 21, the relief valves 400L and 400R, and the check valves 401L and 401R.

The relief valve 400L is a valve for preventing the pressure of hydraulic oil on the first port 21L side of the turning hydraulic motor 21 from exceeding a predetermined turning relief pressure. Specifically, when the pressure of hydraulic oil on the first port 21L side reaches a predetermined relief pressure, the relief valve 400L discharges the hydraulic oil on the first port 21L side to the tank.

Likewise, the relief valve 400R is a valve for preventing the pressure of hydraulic oil on the second port 21R side of the turning hydraulic motor 21 from exceeding a predetermined turning relief pressure. Specifically, when the pressure of hydraulic oil on the second port 21R side reaches a predetermined relief pressure, the relief valve 400R discharges the hydraulic oil on the second port 21R side to the tank.

The check valve 401L is a valve for preventing the pressure of hydraulic oil on the first port 21L side from falling below a tank pressure. Specifically, when the pressure of hydraulic oil on the first port 21L side decreases to a tank pressure, the check valve 401L supplies hydraulic oil in the tank to the first port 21L side.

Likewise, the check valve 401R is a valve for preventing the pressure of hydraulic oil on the second port 21R side from falling below a tank pressure. Specifically, when the pressure of hydraulic oil on the second port 21R side decreases to a tank pressure, the check valve 401R supplies hydraulic oil in the tank to the second port 21R side.

The accumulator part 41 is a hydraulic circuit element that stores hydraulic oil in the hydraulic circuit and discharges the stored hydraulic oil as required. Specifically, the accumulator part 41 stores hydraulic oil on the braking side (discharge side) of the turning hydraulic motor 21 during turning speed reduction. Furthermore, the accumulator part 41 stores hydraulic oil that the boom cylinder 7 discharges during a boom lowering operation. The accumulator part 41 discharges the stored hydraulic oil to the upstream side (intake side) or the downstream side (discharge side) of the main pump 14 when a hydraulic actuator is operated.

According to this embodiment, the accumulator part 41 mainly includes the accumulator 410 and the accumulator selector valve 411.

The accumulator 410 is a device that stores hydraulic oil in the hydraulic circuit, and discharges the stored hydraulic oil as required. According to this embodiment, the accumulator 410 is a spring accumulator that uses the restoring force of a spring.

The accumulator selector valve 411 is a valve that controls a flow of hydraulic oil between the accumulator 410 and other parts of the hydraulic circuit. According to this embodiment, the accumulator selector valve 411 is a two-port, two-position selector valve, for which a solenoid valve that switches valve positions in accordance with a control signal from the controller 30 is used. Alternatively, a proportional valve using a pilot pressure may be used. Specifically, the accumulator selector valve 411 has a first position and a second position as valve positions. In the drawing, parenthesized numbers indicate the numbers of valve positions. The same is the case with other selector valves. The first position is a valve position that interrupts the communication between the accumulator 410 and other parts of the hydraulic circuit. The second position is a valve position that causes the accumulator 410 to communicate with other parts of the hydraulic circuit. The accumulator selector valve 411 may be omitted.

The first pressure storage part 42 is a hydraulic circuit element that controls a flow of hydraulic oil between the turning control part 40 (the turning hydraulic motor 21) and the accumulator part 41. According to this embodiment, the first pressure storage part 42 mainly includes the first selector valve 420 and the first check valve 421.

The first selector valve 420 is a valve that controls a flow of hydraulic oil from the turning control part 40 to the accumulator part 41 at the time of the pressure storing (regenerative) operation of the accumulator part 41. According to this embodiment, the first selector valve 420 is a three-port, three-position selector valve, for which a solenoid valve that switches valve positions in accordance with a control signal from the controller 30 is used. Alternatively, a proportional valve using a pilot pressure may be used. Specifically, the first selector valve 420 has a first position, a second position, and a third position as valve positions.

The first position is a valve position that causes the first port 21L to communicate with the accumulator part 41. The second position is a valve position that interrupts the communication between the turning control part 40 and the accumulator part 41. The third position is a valve position that causes the second port 21R to communicate with the accumulator part 41.

The first check valve 421 is a valve that prevents hydraulic oil from flowing from the accumulator part 41 to the turning control part 40.

The second pressure storage part 43 is a hydraulic circuit element that controls a flow of hydraulic oil between the control valve 17 and the accumulator part 41. According to this embodiment, the second pressure storage part 43 is disposed among the boom cylinder flow control valve 17B, the tank, and the accumulator part 41, and mainly includes the second selector valve 430 and the second check valve 431. The boom cylinder flow control valve 17B may be one or more of the other flow control valves such as an arm cylinder flow control valve.

The second selector valve 430 is a valve that controls a flow of hydraulic oil from a hydraulic actuator to the accumulator part 41 at the time of the pressure storing (regenerative) operation of the accumulator part 41. According to this embodiment, the second selector valve 430 is a three-port, two-position selector valve, for which a solenoid valve that switches valve positions in accordance with a control signal from the controller 30 is used. Alternatively, a proportional valve using a pilot pressure may be used. Specifically, the second selector valve 430 has a first position and a second position as valve positions. The first position is a valve position that causes the discharge port of the boom cylinder flow control valve 17B to communicate with the tank and interrupts the communication between the discharge port of the boom cylinder flow control valve 17B and the accumulator part 41. Furthermore, the second position is a valve position that causes the discharge port of the boom cylinder flow control valve 17B to communicate with the accumulator part 41 and interrupts the communication between the discharge port of the boom cylinder flow control valve 17B and the tank.

The second check valve 431 is a valve that prevents hydraulic oil from flowing from the accumulator part 41 to the second selector valve 430.

The first pressure discharge part 44A is a hydraulic circuit element that controls a flow of hydraulic oil among the main pump 14, the control valve 17, and the accumulator part 41. According to this embodiment, the first pressure discharge part 44A mainly includes the pump motor 35, a third selector valve 440A and a third check valve 441A.

The pump motor 35 is a variable displacement hydraulic pump motor whose discharge flow rate varies in accordance with a control signal from the controller 30, and the minimum flow rate of the pump motor 35 can be set to be extremely small, preferably, to substantially zero. According to this embodiment, the rotating shaft of the pump motor 35 is connected to the drive shaft of the engine 11. Furthermore, the pump motor 35 is connected to the main pump 14 so that rotation may be transmitted between the pump motor 35 and the main pump 14 via the drive shaft of the engine 11. Specifically, the rotating shaft of the pump motor 35 is connected to the rotating shaft of the main pump 14 via the drive shaft of the engine 11. Alternatively, the rotating shaft of the pump motor 35 may be connected to the drive shaft of the engine 11 via a clutch mechanism, a continuously variable transmission mechanism (such as an infinitely variable transmission), or the like. In this case, the pump motor 35 does not have to be one whose minimum flow rate can be set to substantially zero. Furthermore, a makeup circuit for preventing cavitation in the pump motor 35 during its stoppage is provided on the upstream side of the pump motor 35. Alternatively, the rotating shaft of the pump motor 35 may be connected directly or connected via a clutch mechanism, a continuously variable transmission mechanism (such as an infinitely variable transmission), or the like to the rotating shaft of the main pump 14 without intervention of the drive shaft of the engine 11.

Furthermore, the pump motor 35 may operate as either a hydraulic pump or a hydraulic motor as required. According to this embodiment, the pump motor 35 operates as a hydraulic motor when the accumulator pressure Pa is more than or equal to the discharge pressure Pp of the main pump 14 and operates as a hydraulic pump when the accumulator pressure Pa is less than the discharge pressure Pp.

Specifically, the pump motor 35 operating as a hydraulic motor assists the rotation of the engine 11 using hydraulic oil in the accumulator part 41 that is at a pressure level higher than or equal to the discharge pressure Pp. Then, the pump motor 35 discharges hydraulic oil at a pressure level lower than the discharge pressure Pp, and causes the hydraulic oil to merge at a junction on the upstream side of the main pump 14. Even in the case of operating as a hydraulic motor, however, the pump motor 35 may discharge hydraulic oil at a pressure level higher than or equal to the discharge pressure Pp, and cause the hydraulic oil to merge at a junction on the downstream side of the main pump 14.

Furthermore, the pump motor 35 operating as a hydraulic pump draws in hydraulic oil in the accumulator part 41 at a pressure level lower than the discharge pressure Pp using the driving force of the engine 11. Then, the pump motor 35 discharges hydraulic oil at a pressure level higher than or equal to the discharge pressure Pp, and causes the hydraulic oil to merge at the junction on the downstream side of the main pump 14. Even in the case of operating as a hydraulic pump, however, the pump motor 35 may discharge hydraulic oil at a pressure level lower than the discharge pressure Pp, and cause the hydraulic oil to merge at the junction on the upstream side of the main pump 14.

The third selector valve 440A is a valve that controls a flow of hydraulic oil from the pump motor 35 to the junction on the upstream side or the junction on the downstream side of the main pump 14 at the time of the pressure discharge (power running) operation of the accumulator part 41. According to this embodiment, the third selector valve 440A is a three-port, two-position selector valve, for which a solenoid valve that switches valve positions in accordance with a control signal from the controller 30 is used. Alternatively, a proportional valve using a pilot pressure may be used. Specifically, the third selector valve 440A has a first position and a second position as valve positions. The first position is a valve position that causes the junction on the upstream side of the main pump 14 to communicate with the discharge port of the pump motor 35 and interrupts the communication between the junction on the downstream side of the main pump 14 and the discharge port of the pump motor 35. Furthermore, the second position is a valve position that causes the junction on the downstream side of the main pump 14 to communicate with the discharge port of the pump motor 35 and interrupts the communication between the junction on the upstream side of the main pump 14 and the discharge port of the pump motor 35.

The third check valve 441A is a valve that prevents hydraulic oil from flowing from the upstream side of the main pump 14 to the discharge port of the pump motor 35.

The second pressure discharge part 45A is a hydraulic circuit element that controls a flow of hydraulic oil among the tank, the main pump 14, and the accumulator part 41. According to this embodiment, the second pressure discharge part 45A mainly includes a fourth selector valve 450A and a fourth check valve 451A.

The fourth selector valve 450A is a valve that controls a flow of hydraulic oil from the accumulator part 41 to the junction on the upstream side of the main pump 14 at the time of the pressure discharge (power running) operation of the accumulator part 41. According to this embodiment, the fourth selector valve 450A is a two-port, two-position selector valve, for which a solenoid valve that switches valve positions in accordance with a control signal from the controller 30 is used. Alternatively, a proportional valve using a pilot pressure may be used. Specifically, the fourth selector valve 450A has a first position and a second position as valve positions. The first position is a valve position that interrupts the communication between the junction on the upstream side of the main pump 14 and the accumulator part 41. Furthermore, the second position is a valve position that causes the junction on the upstream side of the main pump 14 to communicate with the accumulator part 41.

The fourth check valve 451A is a valve that prevents hydraulic oil from flowing from the junction on the upstream side of the main pump 14 and the accumulator part 41 to the tank.

Figure 12:
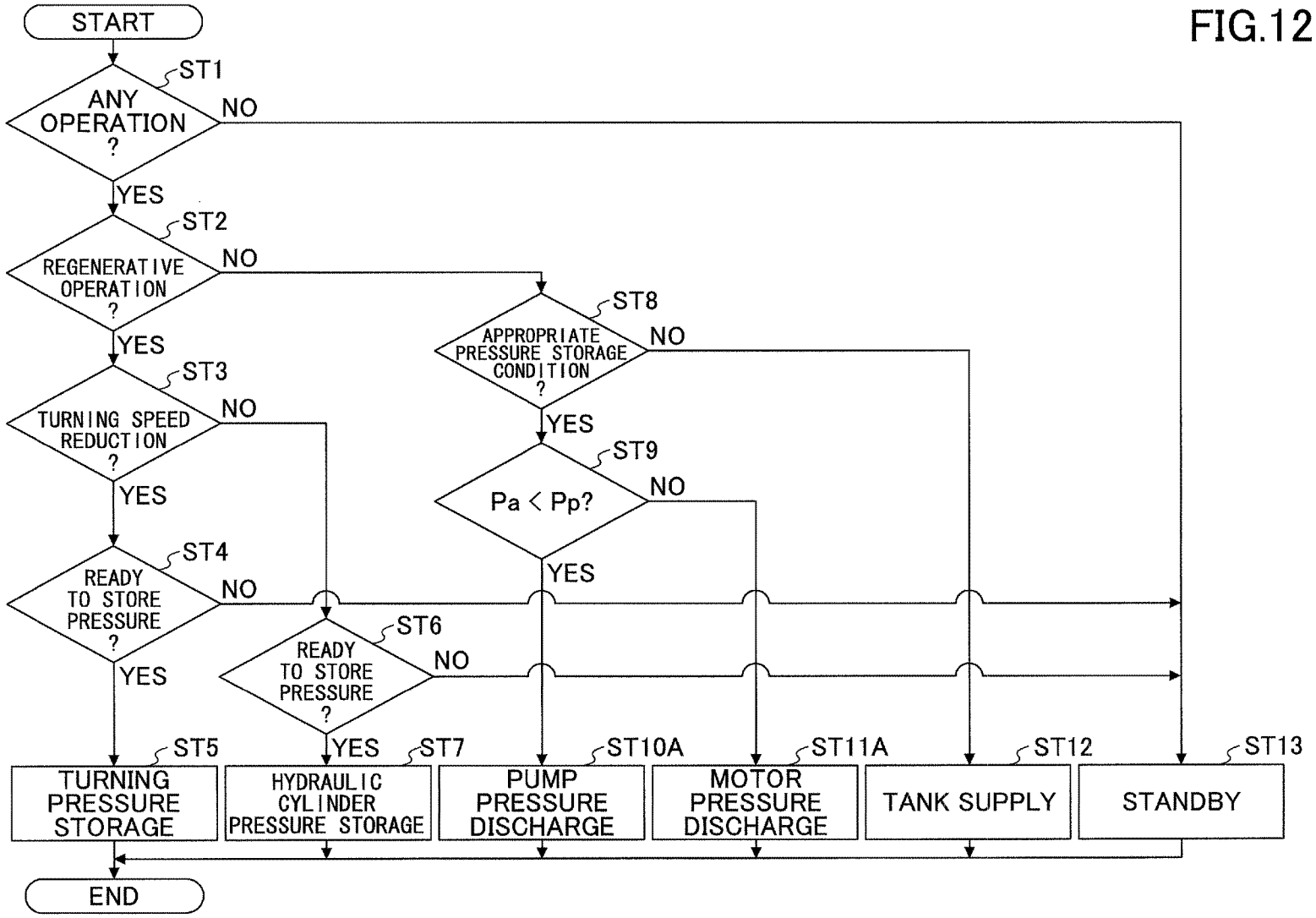
FIG. 12 is a flowchart illustrating a flow of the pressure storing and pressure discharge operation.
Figure 14:
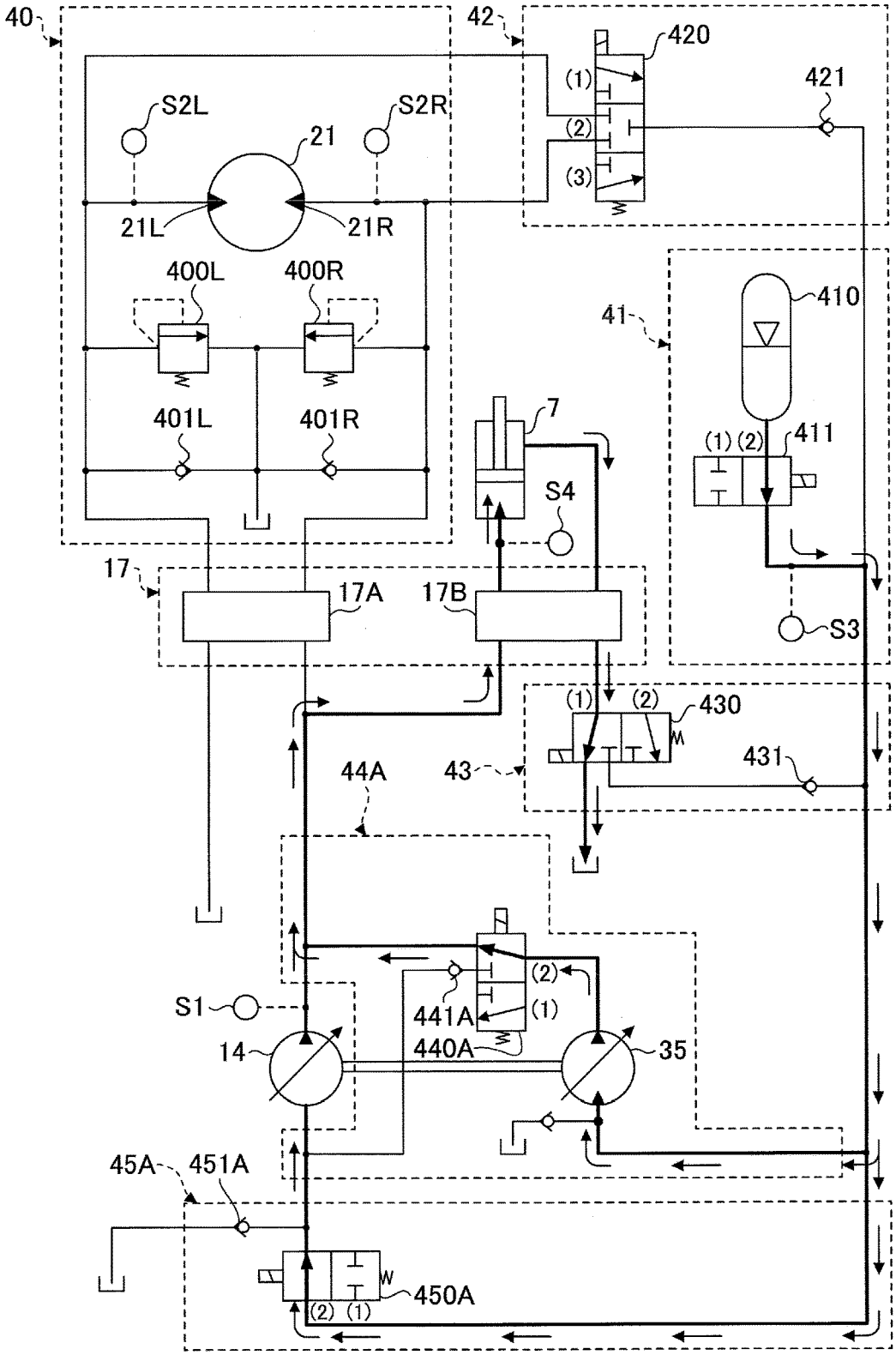
FIG. 14 is a diagram illustrating a flow of hydraulic oil from an accumulator part to a hydraulic cylinder in a pump pressure discharge state.
Figure 15:
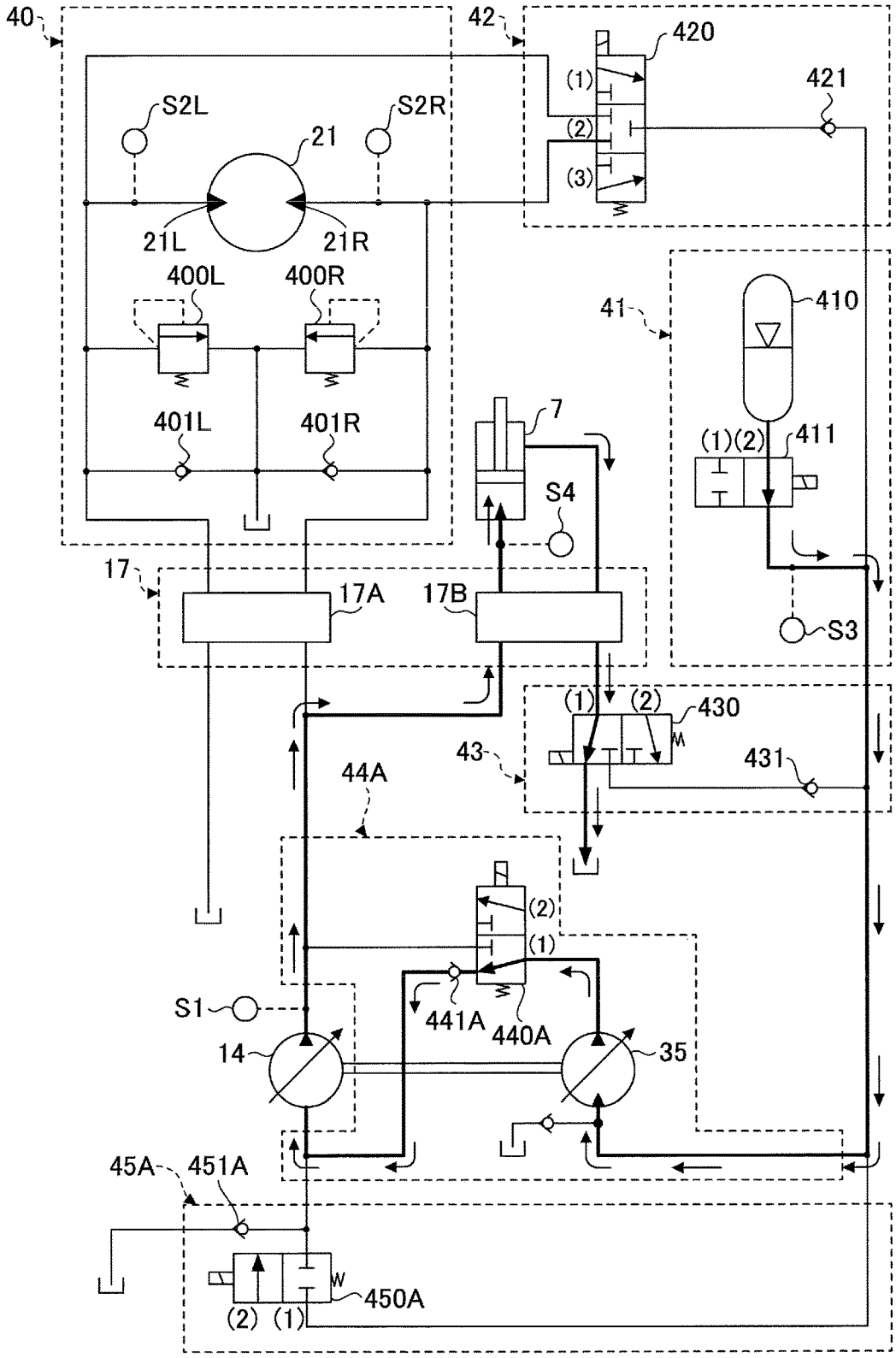
FIG. 15 is a diagram illustrating a flow of hydraulic oil from the accumulator part to the hydraulic cylinder in a motor pressure discharge state.

Here, a description is given, with reference to FIGS. 12 through 15, of the controller 30's operation of controlling the pressure storing and the pressure discharge of the accumulator part 41 (hereinafter, "pressure storing and pressure discharge operation"). FIG. 12 is a flowchart illustrating a flow of the pressure storing and pressure discharge operation, and the controller 30 repeatedly executes this pressure storing and pressure discharge operation at predetermined intervals. Furthermore, FIG. 13 is a correspondence table illustrating the correspondence between the state of the hydraulic circuit of FIG. 11 and the state of the selector valves. Furthermore, FIG. 14 illustrates the state of the hydraulic circuit in "pump pressure discharge," and FIG. 15 illustrates the state of the hydraulic circuit in "motor pressure discharge."

First, the controller 30 determines whether a hydraulic actuator has been operated based on the outputs of various sensors for detecting the condition of the shovel (step ST1). According to this embodiment, the controller 30 determines whether a hydraulic actuator has been operated based on the outputs of the pressure sensor 29.

In response to determining that a hydraulic actuator has been operated (YES at step ST1), the controller 30 determines whether the operation is a regenerative operation or a power running operation (step ST2). According to this embodiment, the controller 30 determines, based on the outputs of the pressure sensor 29, whether a regenerative operation such as a turning speed reduction operation or a boom lowering operation has been performed or a power running operation such as a turning speed increasing operation or a boom raising operation has been performed.

In response to determining that a regenerative operation has been performed (YES at step ST2), the controller 30 determines whether the regenerative operation is a turning speed reduction operation or a regenerative operation other than that (step ST3).

In response to determining that the regenerative operation is a turning speed reduction operation (YES at step ST3), it is determined whether the accumulator part 41 is ready to store pressure (step ST4). According to this embodiment, the controller 30 determines whether the accumulator part 41 is ready to store pressure based on the pressure Pso on the braking side (discharge side) of the turning hydraulic motor 21, output by the pressure sensor S2L or the pressure sensor S2R, and the accumulator pressure Pa output by the pressure sensor S3. Specifically, the controller 30 determines that the accumulator part 41 is ready to store pressure if the pressure Pso exceeds the accumulator pressure Pa, and determines that the accumulator part 41 is not ready to store pressure if the pressure Pso is less than or equal to the accumulator pressure Pa.

In response to determining that the accumulator part 41 is ready to store pressure (YES at step ST4), the controller 30 sets the state of the hydraulic circuit to the "turning pressure storage" state (step ST5).

As illustrated in FIG. 13, in the "turning pressure storage" state, the controller 30 sets the accumulator selector valve 411 to the second position so as to cause the accumulator 410 to communicate with other parts of the hydraulic circuit. Furthermore, the controller 30 sets the first selector valve 420 to the first position or third position so as to cause the turning control part 40 to communicate with the accumulator part 41 via the first pressure storage part 42. Furthermore, the controller 30 sets the second selector valve 430 to the first position so as to cause the discharge port of the boom cylinder flow control valve 17B to communicate with the tank and interrupt the communication between the discharge port of the boom cylinder flow control valve 17B and the accumulator part 41. Furthermore, the controller 30 sets the third selector valve 440A to the first position so as to cause the junction on the upstream side of the main pump 14 to communicate with the discharge port of the pump motor 35. Furthermore, the controller 30 sets the fourth selector valve 450A to the first position so as to interrupt the communication between the junction on the upstream side of the main pump 14 and the accumulator part 41. Furthermore, the controller 30 stops the pump motor 35 so as to interrupt the communication between the third selector valve 440A and the accumulator part 41. Here, stopping the pump motor 35 includes setting the minimum flow rate (for example, substantially zero), or disengaging a clutch mechanism or switching to such a transmission gear ratio as to cause the output rotational speed of a continuously variable transmission mechanism to be substantially zero. That is, the controller 30 prevents the pump motor 35 from supplying hydraulic oil in the accumulator part 41 to the upstream side and the downstream side of the main pump 14.

As a result, in the "turning pressure storage" state, hydraulic oil on the braking side of the turning hydraulic motor 21 flows to the accumulator part 41 via the first pressure storage part 42 so as to be stored in the accumulator 410. Furthermore, because each of the second selector valve 430, the third selector valve 440A, and the fourth selector valve 450A is closed relative to the accumulator part 41, hydraulic oil on the braking side of the turning hydraulic motor 21 is prevented from flowing into locations other than the accumulator part 41.

Furthermore, in response to determining at step ST3 that the regenerative operation is a regenerative operation other than the turning speed reduction operation (NO at step ST3), the controller 30 determines whether the accumulator part 41 is ready to store pressure (step ST6). According to this embodiment, the controller 30 determines whether the accumulator part 41 is ready to store pressure based on the pressure Pbb of the bottom-side oil chamber of the boom cylinder 7, output by the pressure sensor S4, and the accumulator pressure Pa output by the pressure sensor S3. Specifically, the controller 30 determines that the accumulator part 41 is ready to store pressure if the pressure Pbb exceeds the accumulator pressure Pa, and determines that the accumulator part 41 is not ready to store pressure if the pressure Pbb is less than or equal to the accumulator pressure Pa.

In response to determining that the accumulator part 41 is ready to store pressure (YES at step ST6), the controller 30 sets the state of the hydraulic system to the "hydraulic cylinder pressure storage" state (step ST7). According to this embodiment, the controller 30 sets the state of the hydraulic circuit to the "hydraulic cylinder pressure storage" state in response to determining that the regenerative operation is a boom lowering operation.

As illustrated in FIG. 13, in the "hydraulic cylinder pressure storage" state, the controller 30 sets the first selector valve 420 to the second position so as to interrupt the communication between the turning control part 40 and the accumulator part 41 via the first pressure storage part 42. Furthermore, the controller 30 sets the second selector valve 430 to the second position so as to cause the discharge port of the boom cylinder flow control valve 17B to communicate with the accumulator part 41 and interrupt the communication between the discharge port of the boom cylinder flow control valve 17B and the tank. A description of the states of the accumulator selector valve 411, the third selector valve 440A and the fourth selector valve 450A, which are the same as the states at the time of "turning pressure storage," is omitted.

As a result, in the "hydraulic cylinder pressure storage" state, the bottom-side hydraulic oil of the boom cylinder 7 flows to the accumulator part 41 via the second pressure storage part 43 so as to be stored in the accumulator 410. Furthermore, because each of the first selector valve 420, the third selector valve 440A, and the fourth selector valve 450A is closed relative to the accumulator part 41, the bottom-side hydraulic oil of the boom cylinder 7 is prevented from flowing into locations other than the accumulator part 41.

Furthermore, in response to determining at step ST2 that the operation is not a regenerative operation but a power running operation (NO at step ST2), the controller 30 determines whether the pressure storage condition of the accumulator part 41 is appropriate for pressure discharge (step ST8). According to this embodiment, the controller 30 determines whether the accumulator pressure Pa is less than a predetermined pressure Pa0 based on the output of the pressure sensor S3.

In response to determining that the pressure storage condition of the accumulator part 41 is appropriate for pressure discharge (YES at step ST8), the controller 30 determines whether the accumulator pressure Pa is less than the discharge pressure Pp that is the output of the pressure sensor S1 (step ST9). According to this embodiment, in response to determining that the accumulator pressure Pa is more than or equal to the predetermined pressure Pa0, the controller determines whether the accumulator pressure Pa is less than the discharge pressure Pp.

In response to determining that the accumulator pressure Pa is less than the discharge pressure Pp (YES at step ST9), the controller 30 sets the state of the hydraulic circuit to a state of "pump pressure discharge" (step ST10A).

As illustrated in FIG. 13, in the "pump pressure discharge" state, the controller 30 sets the first selector valve 420 to the second position so as to interrupt the communication between the turning control part 40 and the accumulator part 41 via the first pressure storage part 42. Furthermore, the controller 30 sets the second selector valve 430 to the first position so as to cause the discharge port of the boom cylinder flow control valve 17B to communicate with the tank and interrupt the communication between the discharge port of the boom cylinder flow control valve 17B and the accumulator part 41. Furthermore, the controller 30 sets the third selector valve 440A to the second position so as to cause the junction on the downstream side of the main pump 14 to communicate with the accumulator part 41. Furthermore, the controller 30 sets the fourth selector valve 450A to the second position so as to cause the junction on the upstream side of the main pump 14 to communicate with the accumulator part 41. Furthermore, the controller 30 causes the pump motor 35 to operate as a hydraulic pump.

As a result, as illustrated in FIG. 14, in the "pump pressure discharge" state, part of the hydraulic oil in the accumulator part 41 has its pressure increased to be more than or equal to the discharge pressure Pp by the pump motor 35 and is discharged at the junction on the downstream side of the main pump 14 through the third selector valve 440A. Furthermore, another part of the hydraulic oil in the accumulator part 41 is discharged at the junction on the upstream side of the main pump 14 through the second pressure discharge part 45A, and has its pressure increased to be more than or equal to the discharge pressure Pp by the main pump 14. The hydraulic oil discharged by the main pump 14 merges with hydraulic oil from the third selector valve 440A so as to flow toward the control valve 17. Furthermore, because each of the first selector valve 420 and the second selector valve 430 is closed relative to the accumulator part 41, hydraulic oil in the accumulator part 41 is prevented from being discharged at locations other than the junction on the upstream side and the junction on the downstream side of the main pump 14.

Furthermore, in response to determining at step ST9 that the accumulator pressure Pa is more than or equal to the discharge pressure Pp (NO at step ST9), the controller 30 sets the state of the hydraulic circuit to a state of "motor pressure discharge" (step ST11A).

As illustrated in FIG. 13, in the "motor pressure discharge" state, the controller 30 sets the third selector valve 440A to the first position so as to cause the junction on the upstream side of the main pump 14 to communicate with the discharge port of the pump motor 35. Furthermore, the controller 30 sets the fourth selector valve 450A to the first position so as to interrupt the communication between the junction on the upstream side of the main pump 14 and the accumulator part 41. Furthermore, the controller 30 causes the pump motor 35 to operate as a hydraulic motor. A description of the states of the accumulator selector valve 411, the first selector valve 420, and the second selector valve 430, which are the same as the states at the time of "pump pressure discharge," is omitted.

As a result, as illustrated in FIG. 15, in the "motor pressure discharge" state, hydraulic oil in the accumulator part 41 has its pressure reduced to be less than the discharge pressure Pp by the pump motor 35, and is discharged at the junction on the upstream side of the main pump 14 through the third selector valve 440A. Furthermore, because each of the first selector valve 420, the second selector valve 430, and the fourth selector valve 450A is closed relative to the accumulator part 41, hydraulic oil in the accumulator part 41 is prevented from being discharged at locations other than the junction on the upstream side of the main pump 14.

Furthermore, in the "motor pressure discharge" state, the pump motor 35 operates as a hydraulic motor so as to assist the engine 11. Therefore, it is possible for the engine 11 to allow greater absorbed horsepower in the main pump 14, so that it is possible for the main pump 14 to increase a maximum dischargeable flow rate. Specifically, it is possible for the main pump 14 to realize a maximum allowable discharge flow rate Q2 ($=\eta\times(Te+Tm)\times N/Pp$) that is greater than a maximum allowable discharge flow rate Q1 ($=\eta\times Te\times N/Pp$) in the case without an assist from the pump motor 35, where $\eta$, Te, Tm, N, and Pp indicate efficiency, engine torque, pump motor torque, main pump rotational speed, and discharge pressure, respectively.

Furthermore, in response to determining at step ST8 that the pressure storage condition of the accumulator part 41 is not appropriate for pressure discharge (NO at step ST8), the controller 30 sets the state of the hydraulic circuit to the "tank supply" state (step ST12), and prevents hydraulic oil from being discharged from the accumulator part 41.

As illustrated in FIG. 13, in the "tank supply" state, the controller 30 sets the accumulator selector valve 411 to the first position so as to interrupt the communication between the accumulator 410 and other parts of the hydraulic circuit. Furthermore, the controller 30 sets the third selector valve 440A to the first position so as to cause the junction on the upstream side of the main pump 14 to communicate with the discharge port of the pump motor 35. Furthermore, the controller 30 sets the fourth selector valve 450A to the first position so as to interrupt the communication between the junction on the upstream side of the main pump 14 and the accumulator part 41. Furthermore, the controller 30 stops the pump motor 35 so as to interrupt the communication between the third selector valve 440A and the accumulator part 41. A description of the states of the first selector valve 420 and the second selector valve 430, which are the same as the states at the time of "pump pressure discharge," is omitted.

As a result, in the "tank supply" state, the main pump 14 supplies hydraulic oil drawn in from the tank to a hydraulic actuator in operation. Furthermore, because each of the first selector valve 420, the second selector valve 430, the third selector valve 440A, and the fourth selector valve 450A is closed relative to the accumulator part 41, no hydraulic oil is stored in or discharged from the accumulator part 41. The first selector valve 420 and the second selector valve 430, however, may be switched so as to allow the accumulator part 41 to store hydraulic oil.

Furthermore, in response to determining at step ST1 that no hydraulic actuator is operated (NO at step ST1), the controller 30 sets the state of the hydraulic circuit to the "standby" state (step ST13).

As illustrated in FIG. 13, in the "standby" state, the states of the accumulator selector valve 411, the first selector valve 420, the second selector valve 430, the third selector valve 440A, the fourth selector valve 450A, and the pump motor 35 are the same as the states at the time of "tank supply." As a result, in the "standby" state, no hydraulic oil is stored in or discharged from the accumulator part 41.

Furthermore, also in response to determining at step ST4 that the accumulator part 41 is not ready to store pressure (NO at step ST4), the controller 30 sets the state of the hydraulic circuit to the "standby" state (step ST13). In this case, because the first selector valve 420 is at the second position, hydraulic oil on the braking side (discharge side) of the turning hydraulic motor 21 is discharged to the tank via the relief valve 400L or the relief valve 400R.

Furthermore, also in response to determining at step ST6 that the accumulator part 41 is not ready to store pressure (MN at step ST6), the controller 30 sets the state of the hydraulic circuit to the "standby" state (step ST13). In this case, because the second selector valve 430 is at the first position, hydraulic oil in the bottom-side oil chamber of the boom cylinder 7 is discharged to the tank via the boom cylinder flow control valve 17B and the second selector valve 430.

Figure 16:
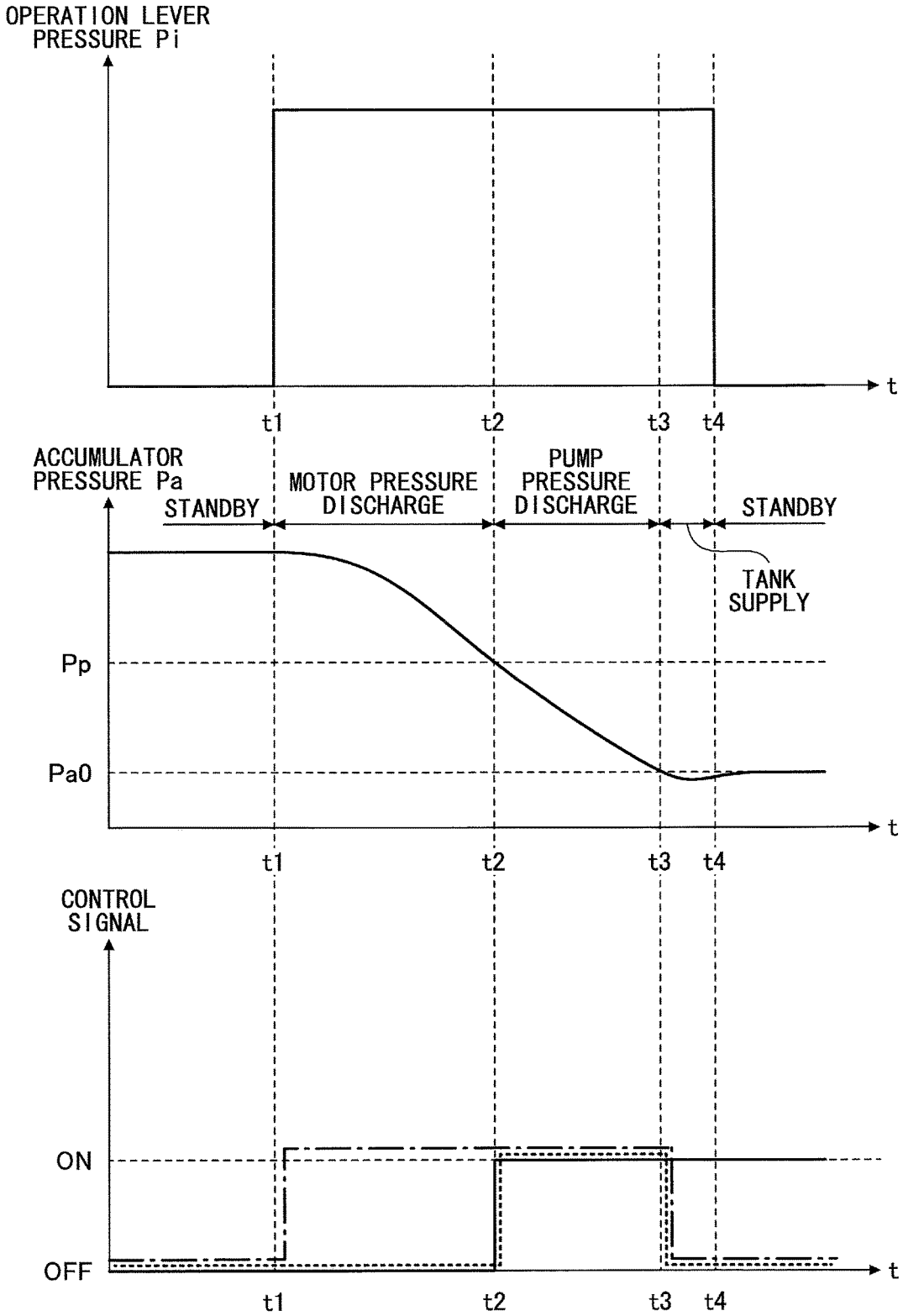
FIG. 16 is a graph illustrating temporal transitions of an operation lever pressure, an accumulator pressure, and control signals at the time of the pressure discharge of an accumulator.

Next, a description is given, with reference to FIG. 16, of the pressure discharge of the accumulator 410 provided in the shovel of FIG. 1. FIG. 16 illustrates temporal transitions of an operation lever pressure, an accumulator pressure, and control signals for the accumulator selector valve 411, the third selector valve 440A, and the fourth selector valve 450A at the time of the pressure discharge of the accumulator 410. According to this embodiment, the transition of the operation lever pressure Pi at the top of FIG. 16 represents the transition of a pilot pressure that varies in accordance with the operation of a boom operation lever in a boom raising direction. Furthermore, the transition of the accumulator pressure Pa in the middle of FIG. 16 represents the transition of the detected value of the pressure sensor S3. Furthermore, the transitions of control signals at the bottom of FIG. 16 represent the transition of a control signal for the accumulator selector valve 411 (one-dot chain line), a control signal for the third selector valve 440A (solid line), and the transition of a control signal for the fourth selector valve 450A (dotted line).

At time t1, when the boom operation lever is tilted in the boom raising direction from a neutral position, the operation lever pressure Pi increases to a pressure commensurate to the amount of tilt of the lever.

In response to determining based on the output of the pressure sensor 29 that the boom raising operation as a power running operation has been performed, the controller 30 determines whether the accumulator pressure Pa is more than or equal to the predetermined pressure Pa0.

Then, in response to determining that the accumulator pressure Pa is more than or equal to the predetermined pressure Pa0 so as to be at a level appropriate for pressure discharge, the controller 30 causes hydraulic oil in the accumulator 410 to be discharged.

According to this embodiment, the controller 30 causes the discharge of hydraulic oil in the accumulator 410 to be started at time t1.

Specifically, as illustrated in the middle of FIG. 16, in response to determining that the accumulator pressure Pa is more than or equal to the discharge pressure Pp of the main pump 14 at time t1, the controller 30 sets the state of the hydraulic circuit to the "motor pressure discharge" state. According to this embodiment, the discharge pressure Pp, which is actually a variable value that varies in accordance with a load, is assumed to be a constant value for simplification of description.

To be more specific, the controller 30 sets the level of the control signal for the accumulator selector valve 411 to ON level (a level for implementing the second position) at time t1 as illustrated at the bottom of FIG. 16. In response to receiving the ON-level control signal, the accumulator selector valve 411 is set to the second position so as to cause the accumulator 410 to communicate with other parts of the hydraulic circuit. Then, the controller 30 causes the pump motor 35 to operate as a hydraulic motor. Therefore, hydraulic oil in the accumulator part 41 has its pressure reduced to be less than the discharge pressure Pp by the pump motor 35, and is discharged at the junction on the upstream side of the main pump 14 through the third selector valve 440A at the first position. In this manner, the bottom-side oil chamber of the boom cylinder 7 receives hydraulic oil discharged from the accumulator 410 so as to expand to raise the boom 4.

Thus, at time t1, the accumulator 410 discharges hydraulic oil in the accumulator 410 to the junction on the upstream side of the main pump 14. Therefore, the accumulator pressure Pa decreases over time so as to fall below the discharge pressure Pp at time t2 as illustrated in the middle of FIG. 16.

In response to determining at time t2 that the accumulator pressure Pa is less than the discharge pressure Pp, the controller 30 sets the state of the hydraulic circuit to the "pump pressure discharge" state.

To be more specific, at time t2, the controller 30 sets the level of the control signal for the third selector valve 440A to ON level (a level for implementing the second position) and sets the level of the control signal for the fourth selector valve 450A to ON level as illustrated at the bottom of FIG. 16. In response to receiving the ON-level control signal, the third selector valve 440A is set to the second position so as to cause the junction on the downstream side of the main pump 14 to communicate with the discharge port of the pump motor 35. Meanwhile, in response to receiving the ON-level control signal, the fourth selector valve 450A is set to the second position so as to cause the junction on the upstream side of the main pump 14 to communicate with the accumulator 410. Then, the controller 30 causes the main pump 35 to operate as a hydraulic pump. Therefore, part of the hydraulic oil in the accumulator part 41 has its pressure increased to be more than or equal to the discharge pressure Pp by the pump motor 35 and is discharged at the junction on the downstream side of the main pump 14 through the third selector valve 440A. Furthermore, another part of the hydraulic oil in the accumulator part 41 is discharged at the junction on the upstream side of the main pump 14 through the second pressure discharge part 45A, and has its pressure increased to be more than or equal to the discharge pressure Pp by the main pump 14. The hydraulic oil discharged by the main pump 14 merges with hydraulic oil from the third selector valve 440A so as to flow toward the control valve 17. In this manner, the bottom-side oil chamber of the boom cylinder 7 receives hydraulic oil discharged from the accumulator 410 so as to expand to continue raising the boom 4.

Thus, at time t2, in addition to discharging part of the hydraulic oil in the accumulator 410 to the junction on the upstream side of the main pump 14, the accumulator 410 discharges another part of the hydraulic oil in the accumulator 410 to the junction on the downstream side of the main pump 14. Thereafter, the accumulator pressure Pa continues to decrease over time so as to fall below the predetermined pressure Pa0 at time t3 as illustrated in the middle of FIG. 16.

In response to determining at time t3 that the accumulator pressure Pa is less than the predetermined pressure Pa0, the controller 30 sets the state of the hydraulic circuit to the "tank supply" state.

To be more specific, at time t3, the controller 30 sets the level of the control signal for each of the accumulator selector valve 411 and the fourth selector valve 450A to OFF level as illustrated at the bottom of FIG. 16. In response to receiving the OFF-level control signal, each of the accumulator selector valve 411 and the fourth selector valve 450A is set to the first position so as to interrupt the communication between the accumulator 410 and other parts of the hydraulic circuit and interrupt the communication between the junction on the upstream side of the main pump 14 and the accumulator 410. Furthermore, the controller 30 stops the pump motor 35 so as to interrupt the communication between the junction on the downstream side of the main pump 14 and the accumulator 410. That is, the controller 30 stops discharging any hydraulic oil in the accumulator 410. Then, the bottom-side oil chamber of the boom cylinder 7 receives hydraulic oil discharged by the main pump 14 that has drawn in hydraulic oil from the tank, so as to expand to further continue raising the boom 4.

At time t4, when the boom operation lever is returned to the neutral position, the boom cylinder flow control valve 17B interrupts the communication between the main pump 14 and the boom cylinder 7 so as to stop expansion of the bottom-side oil chamber of the boom cylinder 7.

According to the above-described hydraulic circuit, by the above-described configuration, it is possible to store hydraulic oil with regenerable energy discharged from a hydraulic actuator in the accumulator 410 and reuse the stored hydraulic oil. Furthermore, according to the above-described hydraulic circuit, it is made possible to use hydraulic oil in the accumulator part 41 not only when the accumulator pressure Pa is more than or equal to the discharge pressure Pp but also when the accumulator pressure Pa is less than the discharge pressure Pp. Therefore, according to the above-described circuit, it is possible to more efficiently use hydraulic energy stored in the accumulator part 41.

Specifically, according to the above-described hydraulic circuit, it is possible to cause the accumulator part 41 to perform a pressure discharge (power running) operation even when the pressure of the accumulator part 41 is lower than the drive-side pressure of a hydraulic actuator to be operated.

Furthermore, according to the above-described hydraulic circuit, hydraulic oil is prevented from flowing into the accumulator part 41 when a power running operation is to be performed. Alternatively, however, hydraulic oil may be caused to flow into the accumulator part.

Furthermore, according to the above-described hydraulic circuit, the controller 30 executes the alternative of turning pressure storage or hydraulic cylinder pressure storage. Alternatively, however, the controller 30 may execute turning pressure storage and hydraulic cylinder pressure storage simultaneously. Specifically, the controller 30 may set the second selector valve 430 to the second position while setting the first selector valve 420 to the first position or the third position.

Furthermore, according to the above-described hydraulic circuit, it is possible to store returning oil from a hydraulic actuator in the accumulator part 41 and discharge the stored hydraulic oil as required. Therefore, according to the above-described hydraulic circuit, it is possible to reduce the capacity of the tank or omit the tank itself compared with a configuration without the accumulator part 41.

Furthermore, according to the above-described hydraulic circuit, hydraulic oil from the accumulator part 41 is caused to merge at the junction on the upstream side or the junction on the downstream side of the main pump 14. The present invention, however, is not limited to this configuration. For example, the above-described hydraulic circuit may have a configuration that allows the accumulator part 41 to discharge hydraulic oil directly to a hydraulic actuator instead of the configuration of causing hydraulic oil from the accumulator part 41 to merge at the junction on the downstream side of the main pump 14. On this basis, the above-described hydraulic circuit may be configured to cause hydraulic oil from the accumulator part 41 to merge at the junction on the upstream side of the main pump 14.

Furthermore, according to the above-described hydraulic circuit, it is made possible to discharge hydraulic oil from the accumulator part 41 at the junction on the upstream side of the main pump 14. Therefore, compared with the case of drawing in relatively low-pressure hydraulic oil from the tank and discharging the drawn-in hydraulic oil, it is possible for the main pump 14 to reduce absorbed horsepower (a torque necessary to discharge a predetermined amount of hydraulic oil) and promote energy saving. Furthermore, it is possible for the main pump 14 to increase the responsiveness of discharge quantity control.

Furthermore, according to the above-described hydraulic circuit, the accumulator part 41 includes the single accumulator 410. The present invention, however, is not limited to this configuration. For example, the accumulator part 41 may include two or more accumulators connected in parallel. Furthermore, each accumulator may have any capacity. The accumulators may have the same capacity or capacities different from each other.

The accumulators may have different maximum discharge pressures in order to make it possible to select an accumulator as a supply source or a storage destination of hydraulic oil from among the accumulators that are different in maximum discharge pressure in accordance with a required discharge pressure. The "maximum discharge pressure" is a maximum pressure dischargeable by an accumulator, and is a pressure determined by the maximum pressure of the accumulator at the time of a pressure storing (regenerative) operation.

The accumulators may store or discharge pressure at respective different times. Two or more of the accumulators may store or discharge pressure at respective times that overlap or coincide with each other.

Figure 17:
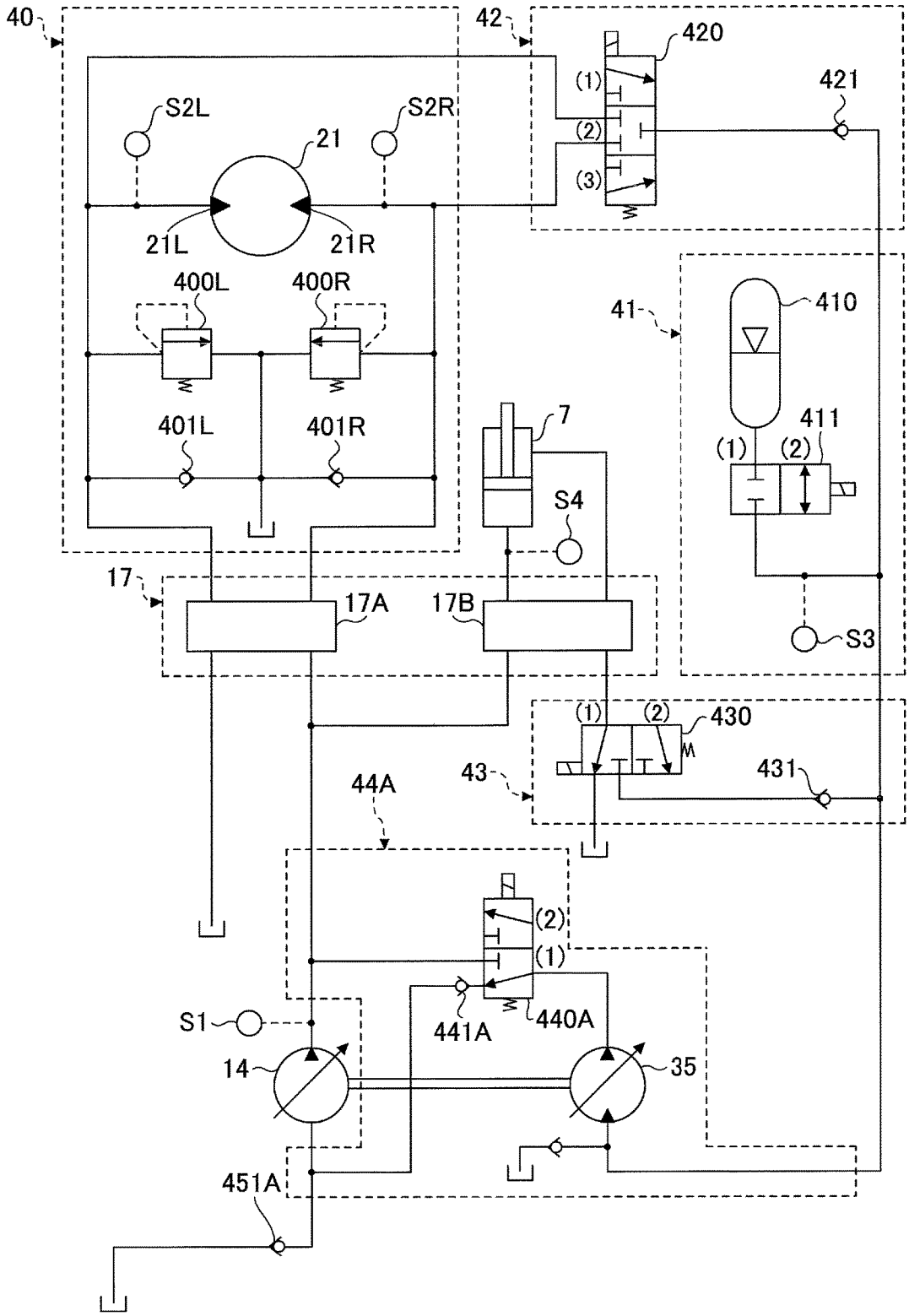
FIG. 17 is a diagram illustrating a configuration of part of a hydraulic circuit.

Next, a description is given, with reference to FIG. 17, of the pressure storage and the pressure discharge of an accumulator in yet another hydraulic circuit provided in the hydraulic shovel according to an embodiment of the present invention. FIG. 17 illustrates a configuration of part of yet another hydraulic circuit provided in the hydraulic shovel of FIG. 1.

The hydraulic circuit of FIG. 17 is different from the hydraulic circuit of FIG. 11 in omitting the fourth selector valve 450A, but otherwise is the same as the hydraulic circuit of FIG. 11.

A detailed description is given above of preferred embodiments of the present invention. The present invention, however, is not limited to the above-described embodiments, and variations and replacements may be added to the above-described embodiments without departing from the scope of the present invention.

For example, according to the above-described embodiments, the accumulator 410 stores hydraulic oil from the turning hydraulic motor 21 and the boom cylinder 7. The present invention, however, is not limited to this configuration. For example, the accumulator 410 may be configured to store only hydraulic oil from the turning hydraulic motor 21. In this case, the second pressure storage part 43 may be omitted. Furthermore, the accumulator 410 may also be configured to store only hydraulic oil from one or more hydraulic actuators other than the turning hydraulic motor 21. In this case, the first pressure storage part 42 may be omitted, and the turning hydraulic motor 21 may be an electric motor.

Figure 18:
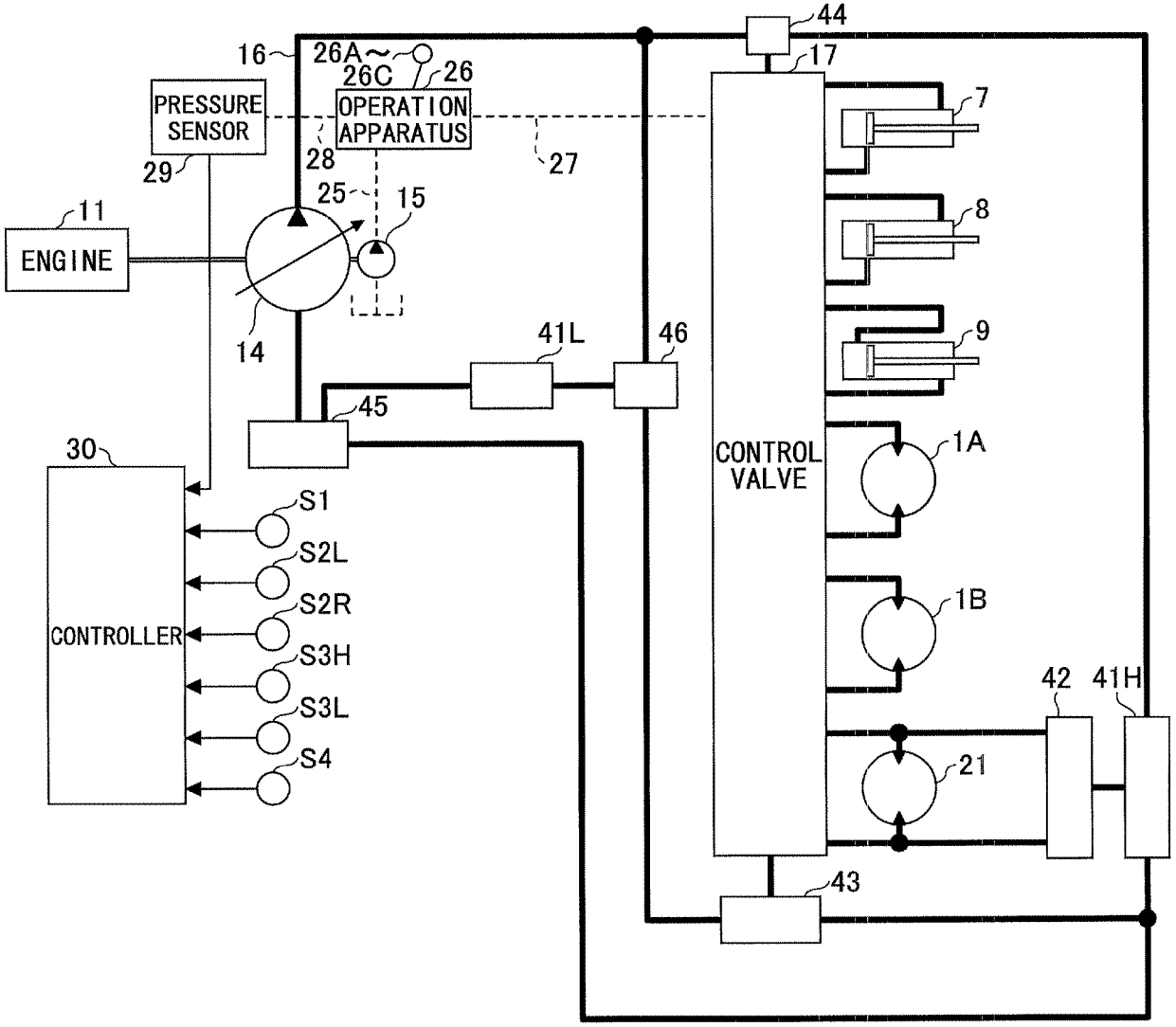
FIG. 18 is a block diagram illustrating yet another configuration of the drive system of the hydraulic shovel of FIG. 1.

FIG. 18 is a block diagram illustrating yet another configuration of the drive system of the hydraulic shovel of FIG. 1. In FIG. 18, a mechanical power system, a high-pressure hydraulic line, a pilot line, and an electric drive and control system are indicated by a double line, a thick solid line, a broken line, and a thin solid line, respectively.

The main pump 14 serving as a variable displacement hydraulic pump and the pilot pump 15 serving as a fixed displacement hydraulic pump are connected to the output shaft of the engine 11 serving as a mechanical drive part. The control valve 17 is connected to the main pump 14 via the high-pressure hydraulic line 16 and the first pressure discharge part 44. Furthermore, the operation apparatus 26 is connected to the pilot pump 15 via the pilot line 25.

The control valve 17 is a device that controls a hydraulic system in the hydraulic shovel. Hydraulic actuators such as the traveling hydraulic motor 1A (right), the traveling hydraulic motor 1B (left), the boom cylinder 7, the arm cylinder 8, the bucket cylinder 9, and the turning hydraulic motor 21 are connected to the control valve 17 via high-pressure hydraulic lines.

The operation apparatus 26 includes the lever 26A, the lever 26B, and the pedal 26C. The lever 26A, the lever 26B, and the pedal 26C are connected to the control valve 17 and the pressure sensor 29 via the hydraulic lines 27 and 28, respectively.

The pressure sensor 29 is a sensor for detecting what an operator's operation is using the operation apparatus 26. The pressure sensor 29, for example, detects the direction of operation and the amount of operation of a lever or pedal of the operation apparatus 26 corresponding to each hydraulic actuator in the form of pressure, and outputs a detected value to a controller 30. What an operation of the operation apparatus 26 is may be detected using a sensor other than a pressure sensor.

The controller 30 is a controller serving as a main control part that controls the driving of the hydraulic shovel. The controller 30 is composed of a processing unit that includes a CPU (Central Processing Unit) and an internal memory, and controls the driving of the hydraulic shovel by causing the CPU to execute a drive control program stored in the internal memory.

The pressure sensor S1 is a sensor that detects the discharge pressure of the main pump 14, and outputs a detected value to the controller 30.

The pressure sensor S2L is a sensor that detects the pressure of hydraulic oil on the first port side of the turning hydraulic motor 21, and outputs a detected value to the controller 30.

The pressure sensor S2R is a sensor that detects the pressure of hydraulic oil on the second port side of the turning hydraulic motor 21, and outputs a detected value to the controller 30.

A pressure sensor S3L is a sensor that detects the pressure of hydraulic oil of a low-pressure accumulator part 41L (hereinafter referred to as "low-pressure accumulator pressure"), and outputs a detected value to the controller 30.

A pressure sensor S3H is a sensor that detects the pressure of hydraulic oil of a high-pressure accumulator part 41H (hereinafter referred to as "high-pressure accumulator pressure"), and outputs a detected value to the controller 30.

The pressure sensor S4 is a sensor that detects the pressure of hydraulic oil of the bottom-side oil chamber of the boom cylinder 7, and outputs a detected value to the controller 30.

The low-pressure accumulator part 41L is a hydraulic circuit element that stores hydraulic oil in a hydraulic circuit and discharges the stored hydraulic oil toward the main pump 14. According to this embodiment, the low-pressure accumulator part 41L serves as a tank that stores hydraulic oil. Therefore, according to this embodiment, a tank is omitted. A tank, however, may be additionally provided.

The high-pressure accumulator part 41H is a hydraulic circuit element that stores hydraulic oil in the hydraulic circuit and discharges the stored hydraulic oil as required. According to this embodiment, the high-pressure accumulator part 41H has a maximum discharge pressure higher than the maximum discharge pressure of the low-pressure accumulator part 41L. The "maximum discharge pressure" is a maximum pressure dischargeable by an accumulator, and is a pressure determined by the maximum pressure of the accumulator at the time of a pressure storing (regenerative) operation.

The first pressure storage part 42 is a hydraulic circuit element that controls a flow of hydraulic oil between the turning hydraulic motor 21 and the high-pressure accumulator part 41H.

The second pressure storage part 43 is a hydraulic circuit element that controls a flow of hydraulic oil among the control valve 17, the low-pressure accumulator part 41L, and the high-pressure accumulator part 41H.

The first pressure discharge part 44 is a hydraulic circuit element that controls a flow of hydraulic oil among the main pump 14, the control valve 17, and the high-pressure accumulator part 41H.

The second pressure discharge part 45 is a hydraulic circuit element that controls a flow of hydraulic oil among the main pump 14, the low-pressure accumulator part 41L, and the high-pressure accumulator part 41H.

A third pressure storage part 46 is a hydraulic circuit element that controls a flow of hydraulic oil among the main pump 14, the control valve 17, and the low-pressure accumulator part 41L.

A description is given in detail below of the low-pressure accumulator part 41L, the high-pressure accumulator part 41H, the first pressure storage part 42, the second pressure storage part 43, the first pressure discharge part 44, the second pressure discharge part 45, and the third pressure storage part 46.

Figure 19:
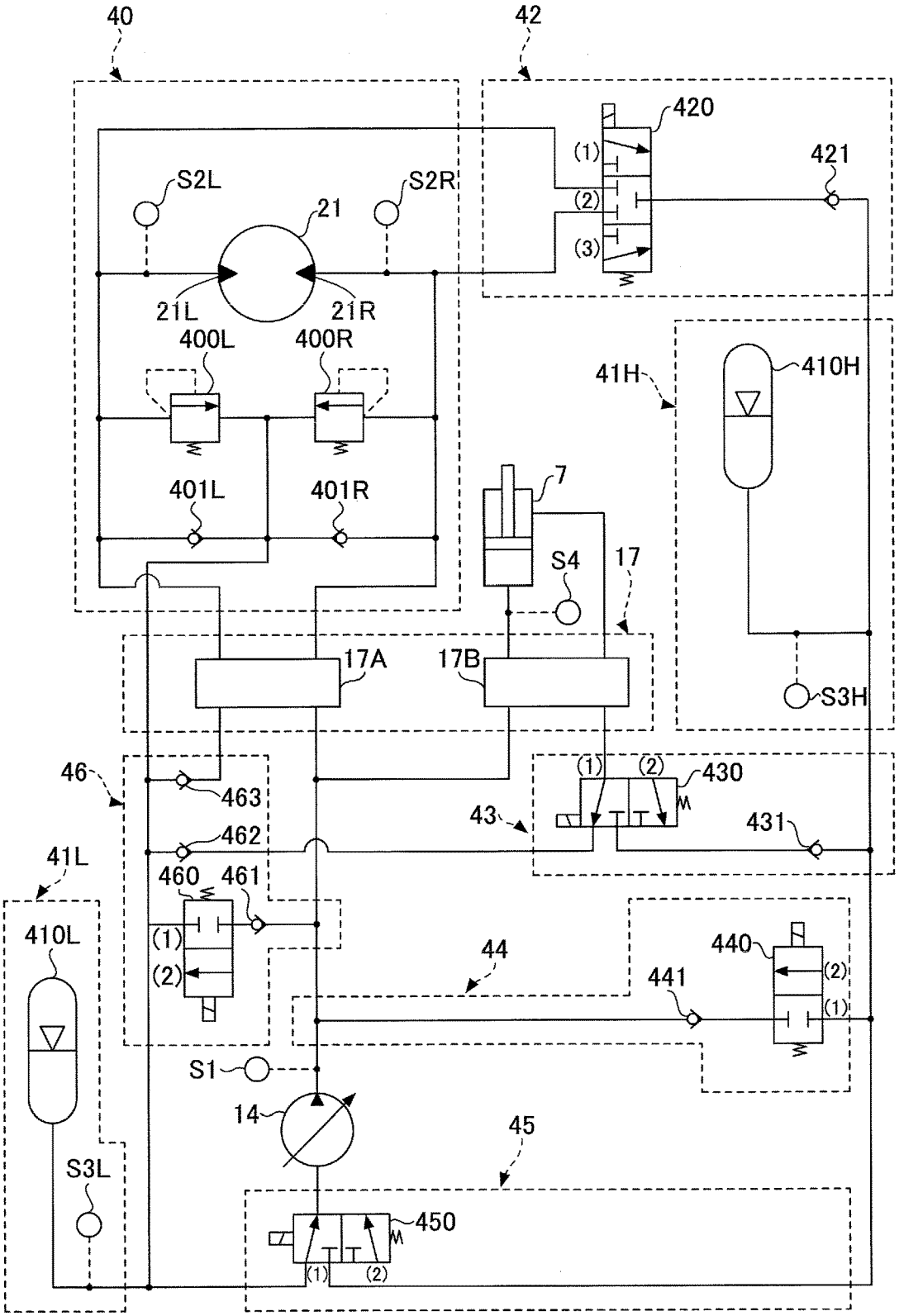
FIG. 19 is a diagram illustrating a configuration of part of a hydraulic circuit.

Next, a description is given, with reference to FIG. 19, of the pressure storing and the pressure discharge of the low-pressure accumulator part 41L and the high-pressure accumulator part 41H provided in the hydraulic shovel of FIG. 1. FIG. 19 illustrates a configuration of part of the hydraulic circuit provided in the hydraulic shovel of FIG. 1.

The hydraulic circuit illustrated in FIG. 19 mainly includes the turning control part 40, the low-pressure accumulator part 41L, the high-pressure accumulator part 41H, the first pressure storage part 42, the second pressure storage part 43, the first pressure discharge part 44, the second pressure discharge part 45, and the third pressure storage part 46.

The turning control part 40 mainly includes the turning hydraulic motor 21, the relief valves 400L and 400R, and the check valves 401L and 401R.

The relief valve 400L is a valve for preventing the pressure of hydraulic oil on the first port 21L side of the turning hydraulic motor 21 from exceeding a predetermined turning relief pressure. Specifically, when the pressure of hydraulic oil on the first port 21L side reaches a predetermined relief pressure, the relief valve 400L discharges the hydraulic oil on the first port 21L side to the low-pressure accumulator part 41L.

Likewise, the relief valve 400R is a valve for preventing the pressure of hydraulic oil on the second port 21R side of the turning hydraulic motor 21 from exceeding a predetermined turning relief pressure. Specifically, when the pressure of hydraulic oil on the second port 21R side reaches a predetermined relief pressure, the relief valve 400R discharges the hydraulic oil on the second port 21R side to the low-pressure accumulator part 41L.

The check valve 401L is a valve for preventing the pressure of hydraulic oil on the first port 21L side from falling below a low-pressure accumulator pressure. Specifically, when the pressure of hydraulic oil on the first port 21L side decreases to the low-pressure accumulator pressure, the check valve 401L supplies hydraulic oil in the low-pressure accumulator part 41L to the first port 21L side.

Likewise, the check valve 401R is a valve for preventing the pressure of hydraulic oil on the second port 21R side from falling below the low-pressure accumulator pressure. Specifically, when the pressure of hydraulic oil on the second port 21R side decreases to the low-pressure accumulator pressure, the check valve 401R supplies hydraulic oil in the low-pressure accumulator part 41L to the second port 21R side.

The low-pressure accumulator part 41L is a hydraulic circuit element that stores hydraulic oil in the hydraulic circuit and discharges the stored hydraulic oil toward the main pump 14. For example, when a power running operation such as a turning speed increasing operation or a boom raising operation is being performed, the low-pressure accumulator part 41L stores hydraulic oil discharged from a hydraulic actuator, and discharges the stored hydraulic oil to the upstream side (intake side) of the main pump 14.

According to this embodiment, the low-pressure accumulator part 41L mainly includes a low-pressure accumulator 410L. The low-pressure accumulator 410L is a device that stores hydraulic oil in the hydraulic circuit and discharges the stored hydraulic oil. According to this embodiment, the low-pressure accumulator 410L is a spring accumulator that uses the restoring force of a spring.

The high-pressure accumulator part 41H is a hydraulic circuit element that stores hydraulic oil in the hydraulic circuit and discharges the stored hydraulic oil as required. Specifically, the high-pressure accumulator part 41H stores hydraulic oil on the braking side (discharge side) of the turning hydraulic motor 21 during turning speed reduction. Furthermore, the high-pressure accumulator part 41H stores hydraulic oil that the boom cylinder 7 discharges during a boom lowering operation. The high-pressure accumulator part 41H discharges the stored hydraulic oil to the upstream side (intake side) or the downstream side (discharge side) of the main pump 14 when a hydraulic actuator is operated.

According to this embodiment, the high-pressure accumulator part 41H mainly includes a high-pressure accumulator 410H. The high-pressure accumulator 410H is a device that stores hydraulic oil in the hydraulic circuit, and discharges the stored hydraulic oil as required. According to this embodiment, the high-pressure accumulator 410H is a spring accumulator that uses the restoring force of a spring.

The first pressure storage part 42 is a hydraulic circuit element that controls a flow of hydraulic oil between the turning control part 40 (the turning hydraulic motor 21) and the high-pressure accumulator part 41H. According to this embodiment, the first pressure storage part 42 mainly includes the first selector valve 420 and the first check valve 421.

The first selector valve 420 is a valve that controls a flow of hydraulic oil from the turning control part 40 to the high-pressure accumulator part 41H at the time of the pressure storing (regenerative) operation of the high-pressure accumulator part 41H. According to this embodiment, the first selector valve 420 is a three-port, three-position selector valve, for which a solenoid valve that switches valve positions in accordance with a control signal from the controller 30 is used. Alternatively, a proportional valve using a pilot pressure may be used. Specifically, the first selector valve 420 has a first position, a second position, and a third position as valve positions. In the drawing, parenthesized numbers indicate the numbers of valve positions. The same is the case with other selector valves.

The first position is a valve position that causes the first port 21L to communicate with the high-pressure accumulator part 41H. The second position is a valve position that interrupts the communication between the turning control part 40 and the high-pressure accumulator part 41H. The third position is a valve position that causes the second port 21R to communicate with the high-pressure accumulator part 41H.

The first check valve 421 is a valve that prevents hydraulic oil from flowing from the high-pressure accumulator part 41H to the turning control part 40.

The second pressure storage part 43 is a hydraulic circuit element that controls a flow of hydraulic oil between the control valve 17 and the high-pressure accumulator part 41H. According to this embodiment, the second pressure storage part 43 is disposed among the boom cylinder flow control valve 17B, the low-pressure accumulator part 41L, and the high-pressure accumulator part 41H, and mainly includes the second selector valve 430 and the second check valve 431. The boom cylinder flow control valve 17B may be one or more of the other flow control valves such as an arm cylinder flow control valve.

The second selector valve 430 is a valve that controls a flow of hydraulic oil from a hydraulic actuator to the high-pressure accumulator part 41H at the time of the pressure storing (regenerative) operation of the high-pressure accumulator part 41H. According to this embodiment, the second selector valve 430 is a three-port, two-position selector valve, for which a solenoid valve that switches valve positions in accordance with a control signal from the controller 30 is used. Alternatively, a proportional valve using a pilot pressure may be used. Specifically, the second selector valve 430 has a first position and a second position as valve positions. The first position is a valve position that causes the discharge port of the boom cylinder flow control valve 17B to communicate with the low-pressure accumulator part 41L and interrupts the communication between the discharge port of the boom cylinder flow control valve 17B and the high-pressure accumulator part 41H. Furthermore, the second position is a valve position that causes the discharge port of the boom cylinder flow control valve 17B to communicate with the high-pressure accumulator part 41H and interrupts the communication between the discharge port of the boom cylinder flow control valve 17B and the low-pressure accumulator part 41L.

The second check valve 431 is a valve that prevents hydraulic oil from flowing from the high-pressure accumulator part 41H to the second selector valve 430.

The first pressure discharge part 44 is a hydraulic circuit element that controls a flow of hydraulic oil among the main pump 14, the control valve 17, and the high-pressure accumulator part 41H. According to this embodiment, the first pressure discharge part 44 mainly includes the third selector valve 440 and the third check valve 441.

The third selector valve 440 is a valve that controls a flow of hydraulic oil from the high-pressure accumulator part 41H to a junction on the downstream side of the main pump 14 at the time of the pressure discharge (power running) operation of the high-pressure accumulator part 41H. According to this embodiment, the third selector valve 440 is a two-port, two-position selector valve, for which a solenoid valve that switches valve positions in accordance with a control signal from the controller 30 is used. Alternatively, a proportional valve using a pilot pressure may be used. Specifically, the third selector valve 440 has a first position and a second position as valve positions. The first position is a valve position that interrupts the communication between the junction on the downstream side of the main pump 14 and the high-pressure accumulator part 41H. Furthermore, the second position is a valve position that causes the junction on the downstream side of the main pump 14 to communicate with the high-pressure accumulator part 41H.

The third check valve 441 is a valve that prevents hydraulic oil from flowing from the main pump 14 to the high-pressure accumulator part 41H.

The second pressure discharge part 45 is a hydraulic circuit element that controls a flow of hydraulic oil among the low-pressure accumulator part 41L, the main pump 14, and the high-pressure accumulator part 41H. According to this embodiment, the second pressure discharge part 45 mainly includes the fourth selector valve 450.

The fourth selector valve 450 is a valve that controls a flow of hydraulic oil from the high-pressure accumulator part 41H to a junction on the upstream side of the main pump 14 at the time of the pressure discharge (power running) operation of the high-pressure accumulator part 41H. According to this embodiment, the fourth selector valve 450 is a three-port, two-position selector valve, for which a solenoid valve that switches valve positions in accordance with a control signal from the controller 30 is used. Alternatively, a proportional valve using a pilot pressure may be used. Specifically, the fourth selector valve 450 has a first position and a second position as valve positions. The first position is a valve position that causes the main pump 14 to communicate with the low-pressure accumulator part 41L and interrupts the communication between the main pump 14 and the high-pressure accumulator part 41H. Furthermore, the second position is a valve position that interrupts the communication between the main pump 14 and the low-pressure accumulator part 41L and causes the main pump 14 to communicate with the high-pressure accumulator part 41H.

The third pressure storage part 46 is a hydraulic circuit element that controls a flow of hydraulic oil among the main pump 14, the control valve 17, and the low-pressure accumulator part 41L. According to this embodiment, the third pressure storage part 46 mainly includes a fifth selector valve 460, a fifth check valve 461, a sixth check valve 462, and a seventh check valve 463.

The fifth selector valve 460 is a valve that controls a flow of hydraulic oil from the main pump 14 to the low-pressure accumulator part 41L at the time of the pressure storing (regenerative) operation of the low-pressure accumulator part 41L. According to this embodiment, the fifth selector valve 460 is a two-port, two-position selector valve, for which a solenoid valve that switches valve positions in accordance with a control signal from the controller 30 is used. Alternatively, a proportional valve using a pilot pressure may be used. Specifically, the fifth selector valve 460 has a first position and a second position as valve positions. The first position is a valve position that interrupts the communication between the junction on the downstream side of the main pump 14 and the low-pressure accumulator part 41L. Furthermore, the second position is a valve position that causes the junction on the downstream side of the main pump 14 to communicate with the low-pressure accumulator part 41L.

The fifth check valve 461 is a valve that prevents hydraulic oil from flowing from the low-pressure accumulator part 41L to the junction on the downstream side of the main pump 14.

The sixth check valve 462 is a valve that prevents hydraulic oil from flowing from the low-pressure accumulator part 41L to the boom cylinder flow control valve 17B.

The seventh check valve 463 is a valve that prevents hydraulic oil from flowing from the low-pressure accumulator part 41L to a turning hydraulic motor flow control valve 17A.

Figure 20:
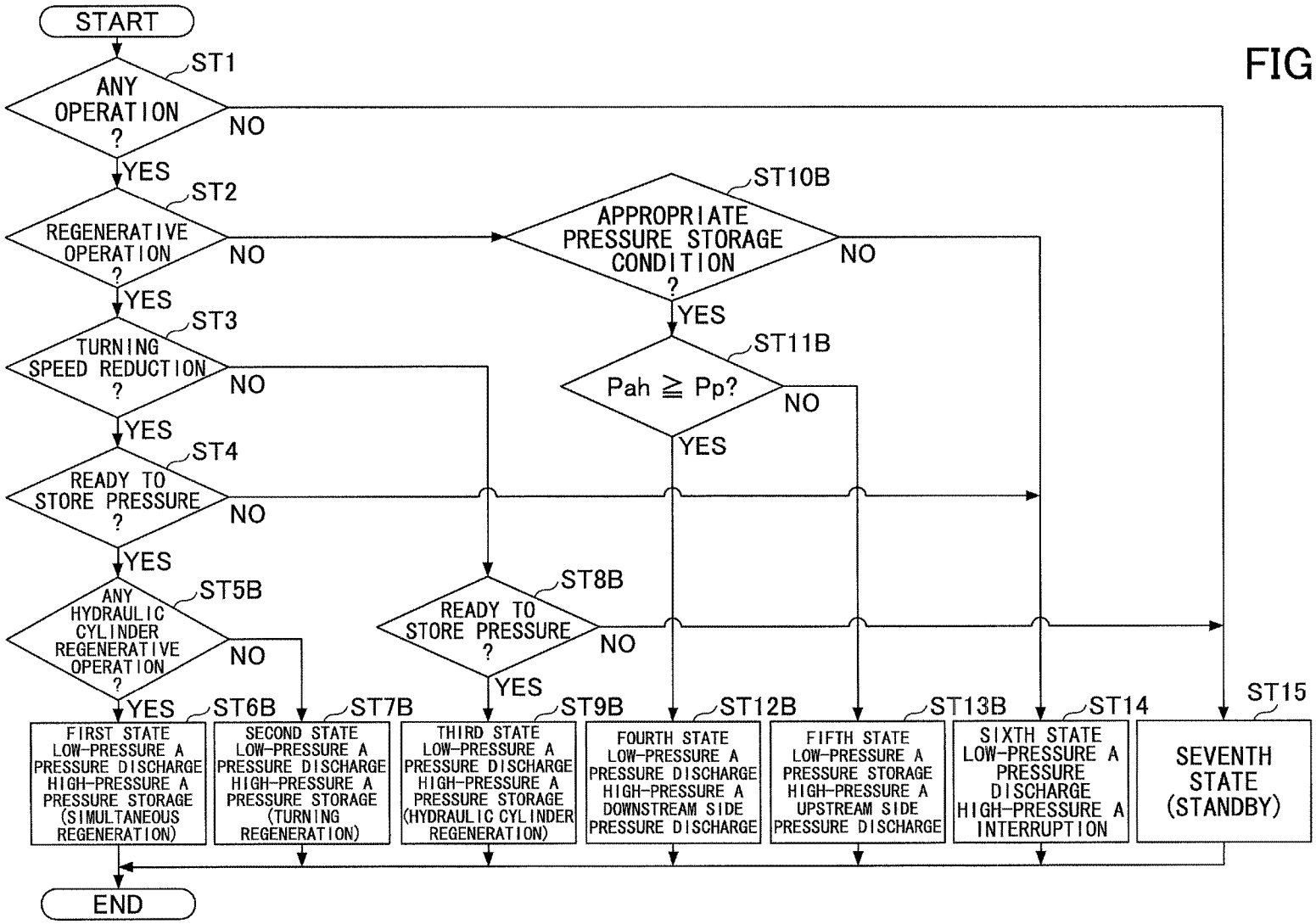
FIG. 20 is a flowchart illustrating a flow of the pressure storing and pressure discharge operation.

Here, a description is given, with reference to FIGS. 20 and 21, of the controller 30's operation of controlling the pressure storing and the pressure discharge of the low-pressure accumulator part 41L and the high-pressure accumulator part 41H (hereinafter, "pressure storing and pressure discharge operation"). FIG. 20 is a flowchart illustrating a flow of the pressure storing and pressure discharge operation, and the controller 30 repeatedly executes this pressure storing and pressure discharge operation at predetermined intervals. FIG. 21 is a correspondence table illustrating the correspondence between the state of the hydraulic circuit of FIG. 19 and the state of the selector valves.

First, the controller 30 determines whether a hydraulic actuator has been operated based on the outputs of various sensors for detecting the condition of the shovel (step ST1). According to this embodiment, the controller 30 determines whether a hydraulic actuator has been operated based on the outputs of the pressure sensor 29.

In response to determining that a hydraulic actuator is being operated (YES at step ST1), the controller 30 determines whether the operation is a regenerative operation or a power running operation (step ST2). According to this embodiment, the controller 30 determines, based on the outputs of the pressure sensor 29, whether a regenerative operation such as a turning speed reduction operation or a boom lowering operation has been performed or a power running operation such as a turning speed increasing operation or a boom raising operation has been performed. For example, the controller 30 determines that a regenerative operation is being performed when a pressure Pc of hydraulic oil discharged by the hydraulic actuator is more than or equal to a predetermined pressure Pc0.

In response to determining that a regenerative operation has been performed (YES at step ST2), the controller 30 determines whether the regenerative operation is a turning speed reduction operation or a regenerative operation other than that (step ST3).

In response to determining that the regenerative operation is a turning speed reduction operation (YES at step ST3), the controller 30 determines whether the high-pressure accumulator part 41H is ready to store pressure (step ST4). According to this embodiment, the controller 30 determines whether the high-pressure accumulator part 41H is ready to store pressure based on the pressure Pso on the braking side (discharge side) of the turning hydraulic motor 21, output by the pressure sensor S2L or the pressure sensor S2R, and a high-pressure accumulator pressure Pah output by the pressure sensor S3H. Specifically, the controller 30 determines that the high-pressure accumulator part 41H is ready to store pressure if the pressure Pso exceeds the high-pressure accumulator pressure Pah, and determines that the high-pressure accumulator part 41H is not ready to store pressure if the pressure Pso is less than or equal to the high-pressure accumulator pressure Pah.

In response to determining that the high-pressure accumulator part 41H is ready to store pressure (YES at step ST4), the controller 30 determines whether the hydraulic actuator is in a regenerative operation (step ST5B). According to this embodiment, the controller 30 determines, based on the outputs of the pressure sensor 29, whether a boom lowering operation is being performed, that is, whether the boom cylinder 7 is in a regenerative operation.

In response to determining that the hydraulic actuator is in a regenerative operation (YES at step ST5B), the controller 30 sets the state of the hydraulic circuit to a "first state" (step ST6B). According to this embodiment, the controller 30 sets the state of the hydraulic circuit to the "first state" when a turning speed reduction operation and a boom lowering operation are being performed.

As illustrated in FIG. 21, in the "first state," the controller 30 sets the first selector valve 420 to the first position or the second position so as to cause the turning control part 40 to communicate with the high-pressure accumulator part 41H through the first pressure storage part 42. Furthermore, the controller 30 sets the second selector valve 430 to the second position so as to cause the discharge port of the boom cylinder flow control valve 17B to communicate with the high-pressure accumulator part 41H and interrupt the communication between the discharge port of the boom cylinder flow control valve 17B and the low-pressure accumulator part 41L. Furthermore, the controller 30 sets the third selector valve 440 to the first position so as to interrupt the communication between the junction on the downstream side of the main pump 14 and the high-pressure accumulator part 41H. Furthermore, the controller 30 sets the fourth selector valve 450 to the first position so as to cause the main pump 14 to communicate with the low-pressure accumulator part 41L and interrupt the communication between the main pump 14 and the high-pressure accumulator part 41H. Furthermore, the controller 30 sets the fifth selector valve 460 to the first position so as to interrupt the communication between the junction on the downstream side of the main pump 14 and the low-pressure accumulator part 41L.

As a result, in the "first state" where a turning speed reduction operation and a boom lowering operation are simultaneously performed, the high-pressure accumulator part 41H receives hydraulic oil from the turning hydraulic motor 21 and the boom cylinder 7. On this basis, hydraulic oil in the low-pressure accumulator part 41L is discharged at the junction on the upstream side of the main pump 14 through the second pressure discharge part 45. "First State Low-Pressure A Pressure Discharge High-Pressure A Pressure Storage (Simultaneous Regeneration)" (where "A" means an accumulator) in FIG. 20 represents such a state of the hydraulic circuit.

Furthermore, in response to determining at step ST5B that no hydraulic cylinder is in a regenerative operation (NO at step ST5B), the controller 30 sets the state of the hydraulic circuit to a "second state" (step ST7B). According to this embodiment, the controller 30 sets the state of the hydraulic circuit to the "second state" when a turning speed reduction operation is being performed but a boom lowering operation is not being performed.

As illustrated in FIG. 21, in the "second state," the controller 30 sets the second selector valve 430 to the first position so as to cause the discharge port of the boom cylinder flow control valve 17B to communicate with the low-pressure accumulator part 41L and interrupt the communication between the discharge port of the boom cylinder flow control valve 17B and the high-pressure accumulator part 41H. A description of the states of the first selector valve 420, the third selector valve 440, the fourth selector valve 450, and the fifth selector valve 460, which are the same as in the "first state," is omitted.

As a result, in the "second state" where a turning speed reduction operation is performed and a boom lowering operation is not performed, the high-pressure accumulator part 41H receives hydraulic oil from the turning hydraulic motor 21. On this basis, hydraulic oil in the low-pressure accumulator part 41L is discharged at the junction on the upstream side of the main pump 14 through the second pressure discharge part 45. "Second State Low-Pressure A Pressure Discharge High-Pressure A Pressure Storage (Turning Regeneration)" in FIG. 20 represents such a state of the hydraulic circuit.

Furthermore, in response to determining at step ST3 that the regenerative operation is a regenerative operation other than the turning speed reduction operation (NO at step ST3), the controller 30 determines whether the high-pressure accumulator part 41H is ready to store pressure (step ST8B). According to this embodiment, the controller 30 determines whether the high-pressure accumulator part 41H is ready to store pressure based on the pressure Pbb of the bottom-side oil chamber of the boom cylinder 7, output by the pressure sensor S4, and the high-pressure accumulator pressure Pah output by the pressure sensor S3H. Specifically, the controller 30 determines that the high-pressure accumulator part 41H is ready to store pressure if the pressure Pbb exceeds the high-pressure accumulator pressure Pah, and determines that the high-pressure accumulator part 41H is not ready to store pressure if the pressure Pbb is less than or equal to the high-pressure accumulator pressure Pah.

In response to determining that the high-pressure accumulator part 41H is ready to store pressure (YES at step ST8B), the controller 30 sets the state of the hydraulic system to a "third state" (step ST9B).

As illustrated in FIG. 21, in the "third state," the controller 30 sets the first selector valve 420 to the second position so as to interrupt the communication between the turning control part 40 and the high-pressure accumulator part 41H. A description of the states of the second selector valve 430, the third selector valve 440, the fourth selector valve 450, and the fifth selector valve 460, which are the same as in the "first state," is omitted.

As a result, in the "third state" where a turning speed reduction operation is not performed and a boom lowering operation is performed, the high-pressure accumulator part 41H receives hydraulic oil from the boom cylinder 7. On this basis, hydraulic oil in the low-pressure accumulator part 41L is discharged at the junction on the upstream side of the main pump 14 through the second pressure discharge part 45. "Third State Low-Pressure A Pressure Discharge High-Pressure A Pressure Storage (Hydraulic Cylinder Regeneration)" in FIG. 20 represents such a state of the hydraulic circuit.

Furthermore, in response to determining at step ST2 that no regenerative operation is being performed (NO at step ST2), the controller 30 determines whether the pressure storage condition of the high-pressure accumulator part 41H is appropriate for pressure discharge (step ST10B). According to this embodiment, the controller 30 determines whether the high-pressure accumulator pressure Pah is less than the predetermined pressure Pa0 based on the output of the pressure sensor S3H.

In response to determining that the pressure storage condition of the high-pressure accumulator part 41H is appropriate for pressure discharge (YES at step ST10B), the controller 30 determines whether the high-pressure accumulator pressure Pah is more than or equal to the discharge pressure Pp that is the output of the pressure sensor S1 (step ST11B). According to this embodiment, in response to determining that the high-pressure accumulator pressure Pah is more than or equal to the predetermined pressure Pa0, the controller determines whether the high-pressure accumulator pressure Pah is more than or equal to the discharge pressure Pp.

In response to determining that the high-pressure accumulator pressure Pah is more than or equal to the discharge pressure Pp (YES at step ST11B), the controller 30 sets the state of the hydraulic circuit to a "fourth state" (step ST12B).

As illustrated in FIG. 21, in the "fourth state," the controller 30 sets the first selector valve 420 to the second position so as to interrupt the communication between the turning control part 40 and the high-pressure accumulator part 41H. Furthermore, the controller 30 sets the second selector valve 430 to the first position so as to cause the discharge port of the boom cylinder flow control valve 17B to communicate with the low-pressure accumulator part 41L and interrupt the communication between the discharge port of the boom cylinder flow control valve 17B and the high-pressure accumulator part 41H. Furthermore, the controller 30 sets the third selector valve 440 to the second position so as to cause the junction on the downstream side of the main pump 14 to communicate with the high-pressure accumulator part 41H. A description of the states of the fourth selector valve 450 and the fifth selector valve 460, which are the same as in the "first state," is omitted.

As a result, in the "fourth state," the low-pressure accumulator part 41L receives hydraulic oil from the turning hydraulic motor 21 and the boom cylinder 7. On this basis, hydraulic oil in the low-pressure accumulator part 41L is discharged at the junction on the upstream side of the main pump 14 through the second pressure discharge part 45. Furthermore, hydraulic oil in the high-pressure accumulator part 41H is discharged at the junction on the downstream side of the main pump 14 through the first pressure discharge part 44. "Fourth State Low-Pressure A Pressure Discharge High-Pressure A Downstream Side Pressure Discharge" in FIG. 20 represents such a state of the hydraulic circuit.

Furthermore, in response to determining at step ST11B that the high-pressure accumulator pressure Pah is less than the discharge pressure Pp (NO at step ST11B), the controller 30 sets the state of the hydraulic circuit to a "fifth state" (step ST13B).

As illustrated in FIG. 21, in the "fifth state," the controller 30 sets the third selector valve 440 to the first position so as to interrupt the communication between the junction on the downstream side of the main pump 14 and the high-pressure accumulator part 41H. Furthermore, the controller 30 sets the fourth selector valve 450 to the second position so as to cause the main pump 14 to communicate with the high-pressure accumulator part 41H and interrupt the communication between the main pump 14 and the low-pressure accumulator part 41L. Furthermore, the controller 30 sets the fifth selector valve 460 to the first position so as to interrupt the communication between the junction on the downstream side of the main pump 14 and the low-pressure accumulator part 41L. A description of the states of the first selector valve 420 and the second selector valve 430, which are the same as in "fourth state," is omitted.

As a result, in the "fifth state," the low-pressure accumulator part 41L receives hydraulic oil from the turning hydraulic motor 21 and the boom cylinder 7. Furthermore, hydraulic oil in the high-pressure accumulator part 41H is discharged at the junction on the upstream side of the main pump 14 through the second pressure discharge part 45. "Fifth State Low-Pressure A Pressure Storage High-Pressure A Upstream Side Pressure Discharge" in FIG. 20 represents such a state of the hydraulic circuit.

Furthermore, in response to determining at step ST10B that the pressure storage condition of the high-pressure accumulator part 41H is not appropriate for pressure discharge (NO at step ST10B), the controller 30 sets the state of the hydraulic circuit to a "sixth state" (step ST14).

As illustrated in FIG. 21, in the "sixth state," the controller 30 sets the fourth selector valve 450 to the first position so as to cause the main pump 14 to communicate with the low-pressure accumulator part 41L and interrupt the communication between the main pump 14 and the high-pressure accumulator part 41H. A description of the states of the first selector valve 420, the second selector valve 430, the third selector valve 440, and the fifth selector valve 460, which are the same as in the "fifth state," is omitted.

As a result, in the "sixth state," the high-pressure accumulator 41H neither receives hydraulic oil from the turning hydraulic motor 21 and the boom cylinder 7 nor discharges hydraulic oil at the junction on the upstream side and the junction on the downstream side of the main pump 14. Furthermore, the low-pressure accumulator part 41L discharges hydraulic oil at the junction on the upstream side of the main pump 14 through the second pressure discharge part 45. Then, the main pump 14 supplies hydraulic oil drawn in from the low-pressure accumulator part 41L to a hydraulic actuator in operation. "Sixth State Low-Pressure A Pressure Storage High-Pressure A Interruption" in FIG. 20 represents such a state of the hydraulic circuit.

Furthermore, in response to determining at step ST1 that no hydraulic actuator is being operated (NO at step ST1), the controller 30 sets the state of the hydraulic circuit to a "seventh state" (step ST15).

As illustrated in FIG. 21, in the "seventh state," the controller 30 sets the fifth selector valve 460 to the second position so as to cause the junction on the downstream side of the main pump 14 to communicate with the low-pressure accumulator part 41L. A description of the states of the valves other than the fifth selector valve 460, which are the same as in the "sixth state," is omitted.

As a result, in the "seventh state," while receiving hydraulic oil from the junction on the downstream side of the main pump 14, the low-pressure accumulator part 41L discharges the hydraulic oil at the junction on the upstream side of the main pump 14 through the second pressure discharge part 45. "Seventh State (Standby)" in FIG. 20 represents such a state of the hydraulic circuit.

Furthermore, also in response to determining at step ST4 that the high-pressure accumulator part 41H is not ready to store pressure (NO at step ST4), the controller 30 sets the state of the hydraulic circuit to the "seventh state" (step ST15). In this case, because the first selector valve 420 is at the second position, hydraulic oil on the braking side (discharge side) of the turning hydraulic motor 21 is discharged to the low-pressure accumulator part 41L via the relief valve 400L or the relief valve 400R.

Furthermore, also in response to determining at step ST8B that the high-pressure accumulator part 41H is not ready to store pressure (NO at step ST8B), the controller 30 sets the state of the hydraulic system to the "seventh state" (step ST15). In this case, because the second selector valve 420 is at the first position, the hydraulic oil of the bottom-side oil chamber of the boom cylinder 7 is discharged to the low-pressure accumulator part 41L via the boom cylinder flow control valve 17B and the second selector valve 430.

According to the above-described configuration, the low-pressure accumulator part 41L operates as a tank, and is able to discharge hydraulic oil to the upstream side of the main pump 14 and store hydraulic oil discharged from a hydraulic actuator. Therefore, according to the shovel of the embodiment of the present invention, it is possible to omit a tank. Furthermore, it is possible to accommodate the low-pressure accumulator part 41L, the high-pressure accumulator part 41H, etc., in a space where a tank has been accommodated.

Furthermore, according to the above-described hydraulic circuit, it is possible to store hydraulic oil with regenerable energy discharged from a hydraulic actuator in the high-pressure accumulator 410H and reuse the stored hydraulic oil. Furthermore, according to the above-described hydraulic circuit, it is made possible to use hydraulic oil in the high-pressure accumulator part 41H not only when the high-pressure accumulator pressure Pah is more than or equal to the discharge pressure Pp but also when the high-pressure accumulator pressure Pah is less than the discharge pressure Pp. Therefore, according to the above-described circuit, it is possible to more efficiently use hydraulic energy stored in the high-pressure accumulator part 41H.

Specifically, according to the above-described hydraulic circuit, it is possible to cause the high-pressure accumulator part 41H to perform a pressure discharge (power running) operation even when the pressure of the high-pressure accumulator part 41H is lower than the drive-side pressure of a hydraulic actuator to be operated.

Furthermore, according to the above-described hydraulic circuit, a hydraulic actuator is driven using hydraulic oil discharged by the main pump 14 or using both hydraulic oil discharged by the main pump 14 and hydraulic oil stored in the high-pressure accumulator part 41H. According to the above-described hydraulic circuit, however, it is also possible to allow hydraulic oil to flow from the main pump 14 to the high-pressure accumulator part 41H by omitting the third check valve 441, so that hydraulic oil discharged by the main pump 14 may be stored in the high-pressure accumulator part 41H. Furthermore, according to the above-described hydraulic circuit, it is also possible to allow a hydraulic actuator to be driven using only hydraulic oil stored in the high-pressure accumulator part 41H.

Furthermore, according to the above-described hydraulic circuit, hydraulic oil from the high-pressure accumulator part 41H is caused to merge at the junction on the upstream side or the junction on the downstream side of the main pump 14. The present invention, however, is not limited to this configuration. For example, a hydraulic circuit according to an embodiment of the present invention may have a configuration that allows the high-pressure accumulator part 41H to discharge hydraulic oil directly to a hydraulic actuator (without intervention of the control valve 17) instead of the configuration of causing hydraulic oil from the high-pressure accumulator part 41H to merge at the junction on the downstream side of the main pump 14. On this basis, the above-described hydraulic circuit may be configured to cause hydraulic oil from the high-pressure accumulator part 41H to merge at the junction on the upstream side of the main pump 14.

Furthermore, according to the above-described hydraulic circuit, it is made possible to discharge hydraulic oil from the high-pressure accumulator part 41H at the junction on the upstream side of the main pump 14. Therefore, compared with the case of drawing in relatively low-pressure hydraulic oil from the low-pressure accumulator part 41L and discharging the drawn-in hydraulic oil, it is possible for the main pump 14 to reduce absorbed horsepower (a torque necessary to discharge a predetermined amount of hydraulic oil) and promote energy saving. Furthermore, it is possible for the main pump 14 to increase the responsiveness of discharge quantity control.

Furthermore, according to the above-described hydraulic circuit, the low-pressure accumulator part 41L is used instead of a tank. That is, it is possible to use hydraulic oil having a low-pressure accumulator pressure that is higher than a tank pressure. Therefore, compared with the case of drawing in hydraulic oil from a tank and discharging the drawn-in hydraulic oil, it is possible for the main pump 14 to reduce absorbed horsepower (a torque necessary to discharge a predetermined amount of hydraulic oil) and promote energy saving. Furthermore, it is possible for the main pump 14 to increase the responsiveness of discharge quantity control.

Furthermore, according to the above-described hydraulic circuit, the low-pressure accumulator part 41L includes the single low-pressure accumulator 410L and the high-pressure accumulator part 41H includes the single high-pressure accumulator 410H. The present invention, however, is not limited to this configuration. For example, each of the low-pressure accumulator part 41L and the high-pressure accumulator part 41H may include two or more accumulators connected in parallel. In this case, in each of the low-pressure accumulator part 41L and the high-pressure accumulator part 41H, each accumulator may have any capacity, and the accumulators may have the same capacity or capacities different from each other. Furthermore, the accumulators may have different maximum discharge pressures in order to make it possible to select an accumulator as a supply source or a storage destination of hydraulic oil from among the accumulators that are different in maximum discharge pressure in accordance with a required discharge pressure. Furthermore, the accumulators may store or discharge pressure at respective different times. Two or more of the accumulators may store or discharge pressure at respective times that overlap or coincide with each other.

Figure 22:
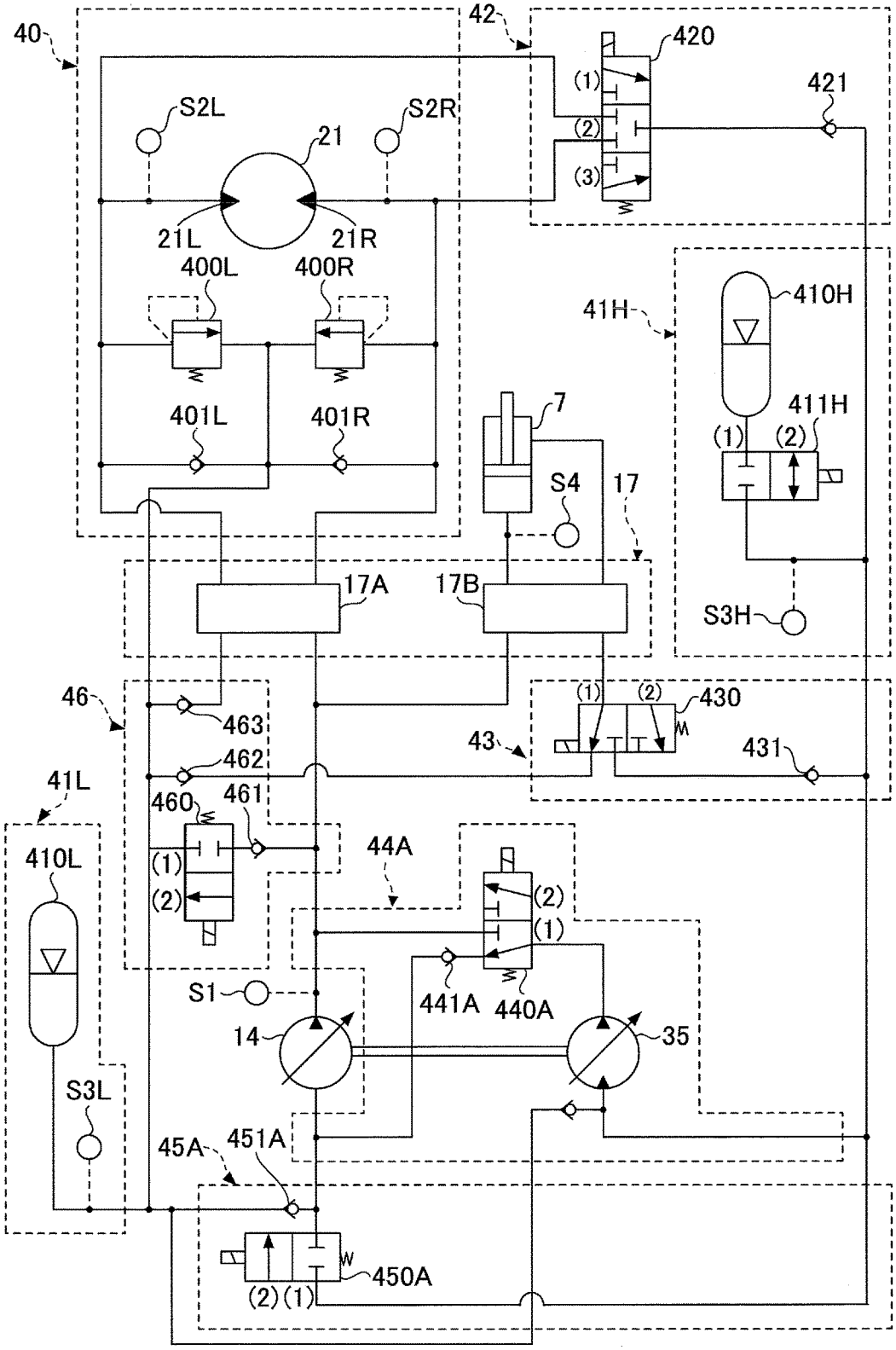
FIG. 22 is a diagram illustrating a configuration of part of a hydraulic circuit.
Figure 23:
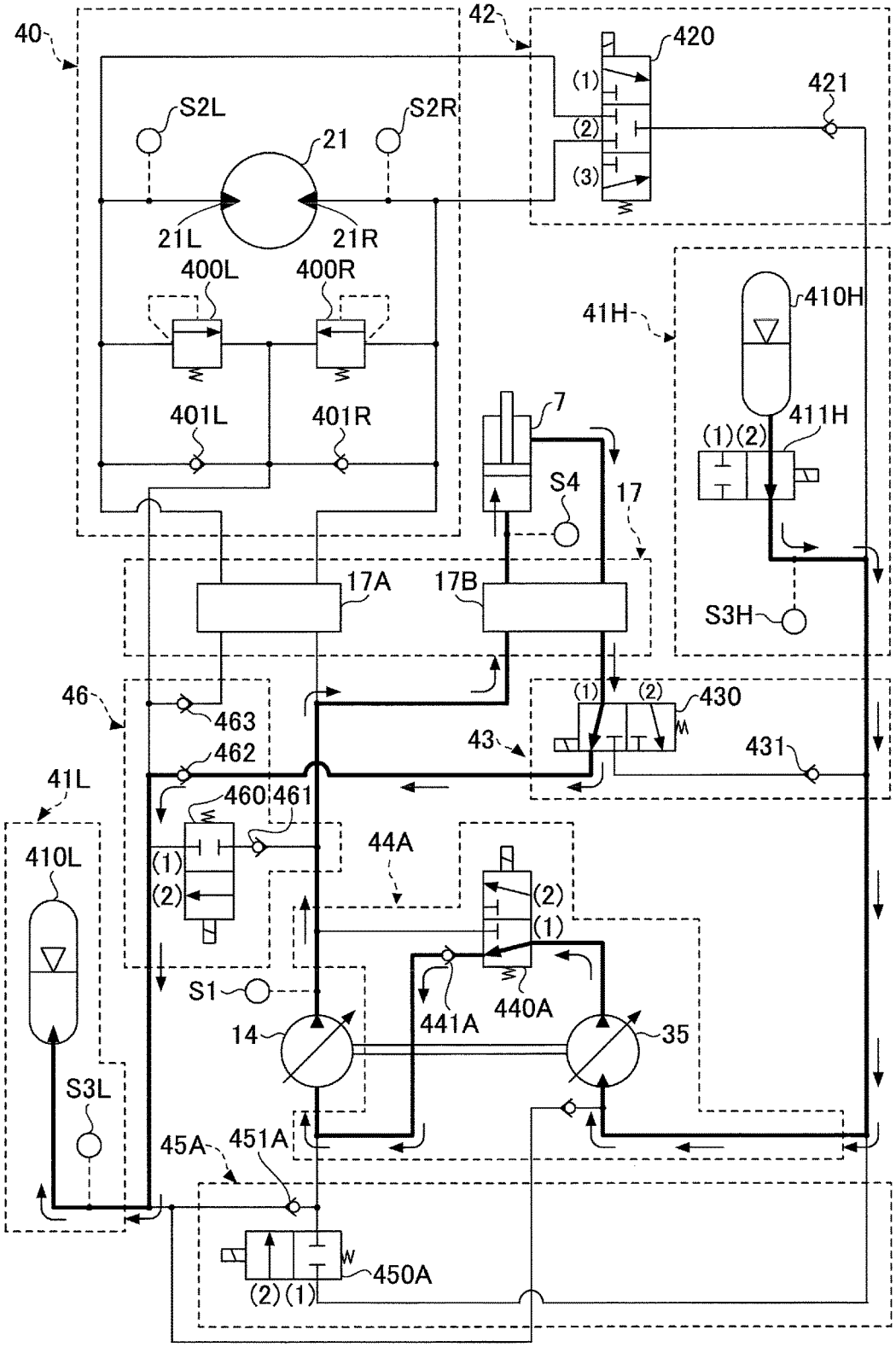
FIG. 23 is a diagram illustrating a "fourth state" of the hydraulic circuit of FIG. 22.
Figure 24:
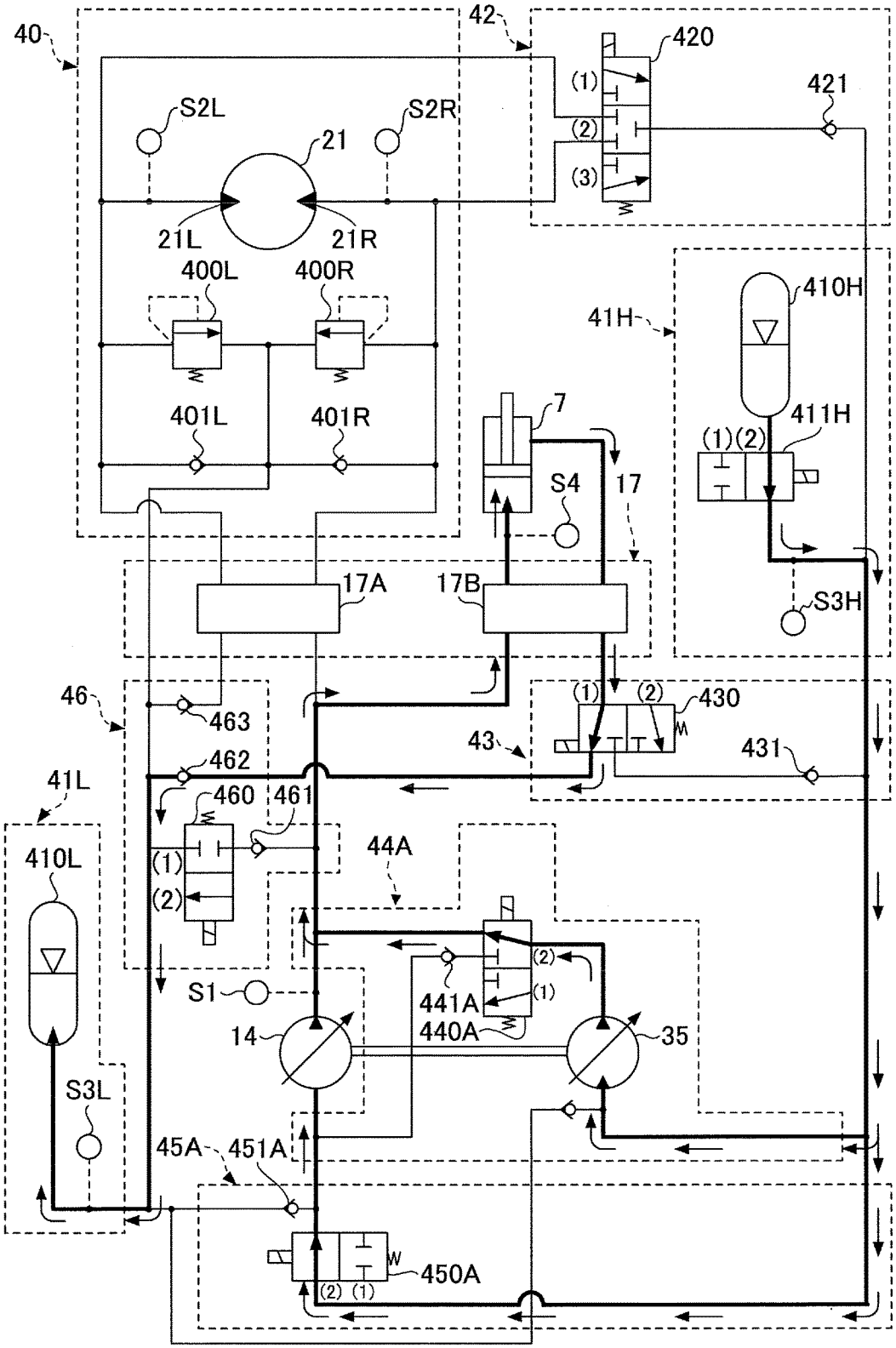
FIG. 24 is a diagram illustrating a "fifth state" of the hydraulic circuit of FIG. 22.

Next, a description is given, with reference to FIGS. 22 through 24, of the pressure storage and the pressure discharge of an accumulator in still another hydraulic circuit provided in the hydraulic shovel according to an embodiment of the present invention. FIG. 22 illustrates a configuration of part of still another hydraulic circuit provided in the hydraulic shovel of FIG. 1. FIG. 23 illustrates a flow of hydraulic oil from the high-pressure accumulator part 41H to the boom cylinder 7 in the "fourth state" of the hydraulic circuit of FIG. 22. FIG. 24 illustrates a flow of hydraulic oil from the high-pressure accumulator part 41H to the boom cylinder 7 in the "fifth state" of the hydraulic circuit of FIG. 22.

Furthermore, the hydraulic circuit of FIG. 22 is different from the hydraulic circuit of FIG. 19 in including an accumulator selector valve 411H and including the first pressure discharge part 44A and the second pressure discharge part 45A in place of the first pressure discharge part 44 and the second pressure discharge part 45, but otherwise is the same as the hydraulic circuit of FIG. 19. Therefore, a description of common points is omitted, and a description is given in detail of differences.

The accumulator selector valve 411H is a valve that controls the communication and interruption between the high-pressure accumulator 410H and other parts of the hydraulic circuit. According to this embodiment, the accumulator selector valve 411H is a two-port, two-position selector valve, for which a solenoid valve that switches valve positions in accordance with a control signal from the controller 30 is used. Alternatively, a proportional valve using a pilot pressure may be used. Specifically, the accumulator selector valve 411H has a first position and a second position as valve positions. The first position is a valve position that interrupts the communication between the high-pressure accumulator 410H and other parts of the hydraulic circuit. The second position is a valve position that causes the high-pressure accumulator 410H to communicate with other parts of the hydraulic circuit.

The first pressure discharge part 44A is a hydraulic circuit element that controls a flow of hydraulic oil among the main pump 14, the control valve 17, and the high-pressure accumulator part 41H. According to this embodiment, the first pressure discharge part 44A mainly includes the pump motor 35, the third selector valve 440A, and the third check valve 441A.

The pump motor 35 is a variable displacement hydraulic pump motor whose discharge flow rate varies in accordance with a control signal from the controller 30, and the minimum flow rate of the pump motor 35 can be set to be extremely small, preferably, to substantially zero. According to this embodiment, the rotating shaft of the pump motor 35 is connected to the drive shaft of the engine 11. Furthermore, the pump motor 35 is connected to the main pump 14 so that rotation may be transmitted between the pump motor 35 and the main pump 14 via the drive shaft of the engine 11. Specifically, the rotating shaft of the pump motor 35 is connected to the rotating shaft of the main pump 14 via the drive shaft of the engine 11. Alternatively, the rotating shaft of the pump motor 35 may be connected to the drive shaft of the engine 11 via a clutch mechanism, a continuously variable transmission mechanism (such as an infinitely variable transmission), or the like. In this case, the pump motor 35 does not have to be one whose minimum flow rate can be set to substantially zero. Furthermore, a makeup circuit for preventing cavitation in the pump motor 35 during its stoppage is provided on the upstream side of the pump motor 35. Alternatively, the rotating shaft of the pump motor 35 may be connected directly or connected via a clutch mechanism, a continuously variable transmission mechanism (such as an infinitely variable transmission), or the like to the rotating shaft of the main pump 14 without intervention of the drive shaft of the engine 11.

Furthermore, the pump motor 35 may operate as either a hydraulic pump or a hydraulic motor as required. According to this embodiment, the pump motor 35 operates as a hydraulic motor when the high-pressure accumulator pressure Pah is more than or equal to the discharge pressure Pp of the main pump 14 and operates as a hydraulic pump when the high-pressure accumulator pressure Pah is less than the discharge pressure Pp.

Specifically, the pump motor 35 operating as a hydraulic motor assists the rotation of the engine 11 using hydraulic oil in the high-pressure accumulator part 41H that is at a pressure level higher than or equal to the discharge pressure Pp. Then, the pump motor 35 discharges hydraulic oil at a pressure level lower than the discharge pressure Pp, and causes the hydraulic oil to merge at a junction on the upstream side of the main pump 14. Even in the case of operating as a hydraulic motor, however, the pump motor 35 may discharge hydraulic oil at a pressure level higher than or equal to the discharge pressure Pp, and cause the hydraulic oil to merge at a junction on the downstream side of the main pump 14.

Furthermore, the pump motor 35 operating as a hydraulic pump draws in hydraulic oil in the high-pressure accumulator part 41H at a pressure level lower than the discharge pressure Pp using the driving force of the engine 11. Then, the pump motor 35 discharges hydraulic oil at a pressure level higher than or equal to the discharge pressure Pp, and causes the hydraulic oil to merge at the junction on the downstream side of the main pump 14. Even in the case of operating as a hydraulic pump, however, the pump motor 35 may discharge hydraulic oil at a pressure level lower than the discharge pressure Pp, and cause the hydraulic oil to merge at the junction on the upstream side of the main pump 14.

The third selector valve 440A is a valve that controls a flow of hydraulic oil from the pump motor 35 to the junction on the upstream side or the junction on the downstream side of the main pump 14 at the time of the pressure discharge (power running) operation of the high-pressure accumulator part 41H. According to this embodiment, the third selector valve 440A is a three-port, two-position selector valve, for which a solenoid valve that switches valve positions in accordance with a control signal from the controller 30 is used. Alternatively, a proportional valve using a pilot pressure may be used. Specifically, the third selector valve 440A has a first position and a second position as valve positions. The first position is a valve position that causes the junction on the upstream side of the main pump 14 to communicate with the discharge port of the pump motor 35 and interrupts the communication between the junction on the downstream side of the main pump 14 and the discharge port of the pump motor 35. Furthermore, the second position is a valve position that causes the junction on the downstream side of the main pump 14 to communicate with the discharge port of the pump motor 35 and interrupts the communication between the junction on the upstream side of the main pump 14 and the discharge port of the pump motor 35.

The third check valve 441A is a valve that prevents hydraulic oil from flowing from the upstream side of the main pump 14 to the discharge port of the pump motor 35.

The second pressure discharge part 45A is a hydraulic circuit element that controls a flow of hydraulic oil among the main pump 14, the low-pressure accumulator part 41L, and the high-pressure accumulator part 41H. According to this embodiment, the second pressure discharge part 45A mainly includes the fourth selector valve 450A and the fourth check valve 451A.

The fourth selector valve 450A is a valve that controls a flow of hydraulic oil from the high-pressure accumulator part 41H to the junction on the upstream side of the main pump 14 at the time of the pressure discharge (power running) operation of the high-pressure accumulator part 41H. According to this embodiment, the fourth selector valve 450A is a two-port, two-position selector valve, for which a solenoid valve that switches valve positions in accordance with a control signal from the controller 30 is used. Alternatively, a proportional valve using a pilot pressure may be used. Specifically, the fourth selector valve 450A has a first position and a second position as valve positions. The first position is a valve position that interrupts the communication between the junction on the upstream side of the main pump 14 and the high-pressure accumulator part 41H. Furthermore, the second position is a valve position that causes the junction on the upstream side of the main pump 14 to communicate with the high-pressure accumulator part 41H.

The fourth check valve 451A is a valve that prevents hydraulic oil from flowing from the junction on the upstream side of the main pump 14 and the high-pressure accumulator part 41H to the low-pressure accumulator part 41L.

According to this configuration, in the "fourth state" illustrated in FIG. 20, the controller 30 sets the third selector valve 440A to the first position so as to cause the junction on the upstream side of the main pump 14 to communicate with the discharge port of the pump motor 35. Furthermore, the controller 30 sets the fourth selector valve 450A to the first position so as to interrupt the communication between the upstream side of the main pump 14 and the high-pressure accumulator part 41H. Furthermore, the controller 30 sets the accumulator selector valve 411H to the second position so as to cause the high-pressure accumulator 410H to communicate with other parts of the hydraulic circuit. Then, the controller 30 causes the pump motor 35 to operate as a hydraulic motor. A description of the states of the first selector valve 420, the second selector valve 430, and the fifth selector valve 460, which are the same as in the "fourth state" and "fifth state" of the above-described hydraulic circuit, is omitted.

As a result, as illustrated in FIG. 23, in the "fourth state," hydraulic oil in the high-pressure accumulator part 41H has its pressure reduced to be less than the discharge pressure Pp by the pump motor 35, and is discharged at the junction on the upstream side of the main pump 14 through the third selector valve 440A. Furthermore, because each of the first selector valve 420, the second selector valve 430, and the fourth selector valve 450A is closed relative to the high-pressure accumulator part 41H, hydraulic oil in the high-pressure accumulator part 41H is prevented from being discharged at locations other than the junction on the upstream side of the main pump 14.

Furthermore, in the "fourth state," the pump motor 35 operates as a hydraulic motor so as to assist the engine 11. Therefore, it is possible for the engine 11 to allow greater absorbed horsepower (in the main pump 14), so that it is possible for the main pump 14 to increase a maximum dischargeable flow rate. Specifically, it is possible for the main pump 14 to realize a maximum allowable discharge flow rate Q2 ($=\eta\times(Te+Tm)\times N/Pp$) that is greater than a maximum allowable discharge flow rate Q1 ($=\eta\times Te\times N/Pp$) in the case without an assist from the pump motor 35, where $\eta$, Te, Tm, N, and Pp indicate efficiency, engine torque, pump motor torque, main pump rotational speed, and discharge pressure, respectively.

Furthermore, in the "fifth state" illustrated in FIG. 20, the controller 30 sets the third selector valve 440A to the second position so as to cause the junction on the downstream side of the main pump 14 to communicate with the discharge port of the pump motor 35. Furthermore, the controller 30 sets the fourth selector valve 450A to the second position so as to cause the junction on the upstream side of the main pump 14 to communicate with the high-pressure accumulator part 41H. Then, the controller 30 causes the pump motor 35 to operate as a hydraulic pump. A description of the states of the first selector valve 420, the second selector valve 430, and the fifth selector valve 460, which are the same as in the "fifth state" of the above-described hydraulic circuit, is omitted.

As a result, as illustrated in FIG. 24, in the "fifth state," part of the hydraulic oil in the high-pressure accumulator part 41H has its pressure increased to be more than or equal to the discharge pressure Pp by the pump motor 35 and is discharged at the junction on the downstream side of the main pump 14 through the third selector valve 440A. Furthermore, another part of the hydraulic oil in the high-pressure accumulator part 41H is discharged at the junction on the upstream side of the main pump 14 through the second pressure discharge part 45A, and has its pressure increased to be more than or equal to the discharge pressure Pp by the main pump 14. The hydraulic oil discharged by the main pump 14 merges with hydraulic oil from the third selector valve 440A so as to flow toward the control valve 17. Furthermore, because each of the first selector valve 420 and the second selector valve 430 is closed relative to the high-pressure accumulator part 41H, hydraulic oil in the high-pressure accumulator part 41H is prevented from being discharged at locations other than the junction on the upstream side and the junction on the downstream side of the main pump 14.

Furthermore, in the "sixth state" illustrated in FIG. 20, the controller 30 sets the accumulator selector valve 411H to the second position so as to cause the high-pressure accumulator 410H to communicate with other parts of the hydraulic circuit. Furthermore, the controller 30 sets the third selector valve 440A to the first position so as to cause the junction on the upstream side of the main pump 14 to communicate with the discharge port of the pump motor 35. Furthermore, the controller 30 sets the fourth selector valve 450A to the first position so as to interrupt the communication between the junction on the upstream side of the main pump 14 and the high-pressure accumulator part 41H. Then, the controller 30 stops the pump motor 35 so as to interrupt the communication between the third selector valve 440A and the high-pressure accumulator part 41. Here, stopping the pump motor 35 includes setting the minimum flow rate (for example, substantially zero), or disengaging a clutch mechanism or switching to such a transmission gear ratio as to cause the output rotational speed of a continuously variable transmission mechanism to be substantially zero. That is, the controller 30 prevents the pump motor 35 from supplying hydraulic oil in the high-pressure accumulator part 41H to the upstream side and the downstream side of the main pump 14. A description of the states of the first selector valve 420, the second selector valve 430, and the fifth selector valve 460, which are the same as in the "sixth state" of the above-described hydraulic circuit, is omitted.

As a result, in the "sixth state," hydraulic oil is discharged at neither the junction on the upstream side nor the junction on the downstream side of the main pump 14. Meanwhile, the low-pressure accumulator part 41L discharges hydraulic oil at the junction on the upstream side of the main pump 14 through the second pressure discharge part 45A. Then, the main pump 14 supplies hydraulic oil drawn in from the low-pressure accumulator part 41L to a hydraulic actuator in operation.

Furthermore, in the "seventh state" illustrated in FIG. 20, the controller 30 sets the accumulator selector valve 411H to the first position so as to interrupt the communication between the high-pressure accumulator 410H and other parts of the hydraulic circuit. Furthermore, the controller 30 sets the fourth selector valve 450A to the first position so as to interrupt the communication between the junction on the upstream side of the main pump 14 and the high-pressure accumulator part 41H. Then, the controller 35 stops the pump motor 35 so as to interrupt the communication between the third selector valve 440A and the high-pressure accumulator part 41H. Furthermore, the controller 30 sets the fifth selector valve 460 to the second position so as to cause the junction on the downstream side of the main pump 14 to communicate with the low-pressure accumulator part 41L. A description of the states of the first selector valve 420 and the second selector valve 430, which are the same as in the "fourth state" or the "fifth state," is omitted.

As a result, in the "seventh state," while receiving hydraulic oil from the junction on the downstream side of the main pump 14, the low-pressure accumulator part 41L discharges the hydraulic oil at the junction on the upstream side of the main pump 14 through the second pressure discharge part 45A.

Furthermore, in the "first state" or the "second state" illustrated in FIG. 20, the presence of the accumulator selector valve 411H makes it possible for the controller 30 to cause hydraulic oil flowing out from the turning control part 40 through the first selector valve 420 to merge with the junction on the upstream side or the junction on the downstream side of the main pump 14 without being stored in the high-pressure accumulator 410H.

Specifically, while setting the accumulator selector valve 411H to the first position and setting the first selector valve 420 to the first position or the third position, the controller 30 causes the pump motor 35 to operate as a hydraulic pump or a hydraulic motor, or sets the fourth selector valve 450A to the second position. As a result, it is possible for the controller 30 to cause hydraulic oil flowing out from the braking side of the turning hydraulic motor 21 to merge with the junction on the upstream side or the downstream side of the main pump 14.

Likewise, it is possible for the controller 30 to cause hydraulic oil flowing out from the boom cylinder flow control valve 17B through the second selector valve 430 to merge with the junction on the upstream side or the downstream side of the main pump 14 without being stored in the high-pressure accumulator 410H.

Specifically, while setting the accumulator selector valve 411H to the first position and setting the second selector valve 430 to the second position, the controller 30 causes the pump motor 35 to operate as a hydraulic pump or a hydraulic motor, or sets the fourth selector valve 450A to the second position. As a result, it is possible for the controller 30 to cause hydraulic oil flowing out from the bottom-side oil chamber of the boom cylinder 7 to merge with the junction on the upstream side or the downstream side of the main pump 14 without being stored in the high-pressure accumulator 410H.

According to the above-described configuration, the hydraulic circuit of FIG. 22 produces the effect that hydraulic oil with regenerable energy discharged from a hydraulic actuator may be reused without being stored in the high-pressure accumulator 410H, in addition to the effect by the hydraulic circuit of FIG. 19. Furthermore, according to the hydraulic circuit of FIG. 22, it is possible to reuse the hydraulic oil regardless of whether its pressure is greater than the discharge pressure of the main pump 14 or not.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. A shovel has been described based on embodiments of the present invention. It should be understood, however, that various changes, substitutions, and alterations could be made hereto without departing from the spirit and scope of the invention.

For example, according to the above-described embodiments, the high-pressure accumulator 410H stores hydraulic oil from the turning hydraulic motor 21 and the boom cylinder 7. The present invention, however, is not limited to this configuration. For example, the high-pressure accumulator 410H may be configured to store only hydraulic oil from the turning hydraulic motor 21. In this case, the second pressure storage part 43 may be omitted. Furthermore, the high-pressure accumulator 410H may also be configured to store only hydraulic oil from one or more hydraulic actuators other than the turning hydraulic motor 21. In this case, the first pressure storage part 42 may be omitted, and the turning hydraulic motor 21 may be an electric motor.

What is claimed is:

1. A shovel, comprising:

an engine;

a main pump connected to the engine;

a first pressure sensor configured to detect a discharge pressure of the main pump;

a hydraulic actuator configured to be driven with hydraulic oil discharged by the main pump;

an accumulator part configured to store the hydraulic oil discharged from the hydraulic actuator and discharge the hydraulic oil to an intake side of the main pump;

a second pressure sensor configured to detect a pressure of the hydraulic oil in the accumulator part; and a controller configured to determine whether the pressure of the hydraulic oil in the accumulator part detected by the second pressure sensor is less than the discharge pressure of the main pump detected by the first pressure sensor, wherein the accumulator part is configured to discharge the hydraulic oil in the accumulator part to the intake side of the main pump in response to the controller determining that the pressure of the hydraulic oil in the accumulator part detected by the second pressure sensor is less than the discharge pressure of the main pump detected by the first pressure sensor.

2. The shovel as claimed in claim 1, wherein the accumulator part is further configured to discharge the hydraulic oil to the intake side or a discharge side of the main pump while the hydraulic actuator is being driven.

3. The shovel as claimed in claim 1, wherein the accumulator part is further configured to discharge the hydraulic oil in the accumulator part to the intake side or a discharge side of the main pump when the pressure of the hydraulic oil in the accumulator part detected by the second pressure sensor is more than or equal to a predetermined pressure.

4. The shovel as claimed in claim 1, wherein the accumulator part is further configured to discharge the hydraulic oil in the accumulator part to a discharge side of the main pump when the pressure of the hydraulic oil in the accumulator part detected by the second pressure sensor is more than or equal to the discharge pressure of the main pump detected by the first pressure sensor.

5. The shovel as claimed in claim 1, wherein the accumulator part is further configured to be prevented from discharging the hydraulic oil in the accumulator part when the pressure of the hydraulic oil in the accumulator part detected by the second pressure sensor is less than a predetermined pressure.

6. The shovel as claimed in claim 1, wherein the accumulator part includes a valve configured to control an outflow of the hydraulic oil from and an inflow of the hydraulic oil to the accumulator part.

7. The shovel as claimed in claim 1, further comprising:

a hydraulic pump motor configured to transmit a rotation to the main pump and supply the hydraulic oil stored in the accumulator part to the intake side of the main pump.

8. The shovel as claimed in claim 7, wherein the hydraulic pump motor is further configured to supply the hydraulic oil stored in the accumulator part to the intake side or a discharge side of the main pump while the hydraulic actuator is being driven.

9. The shovel as claimed in claim 7, wherein the hydraulic pump motor is further configured to supply the hydraulic oil in the accumulator part to the intake side or a discharge side of the main pump when the pressure of the hydraulic oil in the accumulator part detected by the second pressure sensor is more than or equal to a predetermined pressure.

10. The shovel as claimed in claim 7, wherein the hydraulic pump motor is further configured to operate as a hydraulic motor and supply the hydraulic oil in the accumulator part to the intake side of the main pump when the pressure of the hydraulic oil in the accumulator part detected by the second pressure sensor is more than or equal to the discharge pressure of the main pump detected by the first pressure sensor.

11. The shovel as claimed in claim 7, wherein the hydraulic pump motor is further configured to operate as a hydraulic pump and supply the hydraulic oil in the accumulator part to a discharge side of the main pump when the pressure of the hydraulic oil in the accumulator part detected by the second pressure sensor is less than the discharge pressure of the main pump detected by the first pressure sensor.

12. The shovel as claimed in claim 7, wherein the hydraulic pump motor is further configured to prevent the hydraulic oil in the accumulator part from being discharged to the intake side and a discharge side of the main pump when the pressure of the hydraulic oil in the accumulator part detected by the second pressure sensor is less than a predetermined pressure.

13. The shovel as claimed in claim 7, wherein the hydraulic pump motor is further configured to operate as a hydraulic motor using the hydraulic oil discharged by the accumulator part so as to assist a power source, or to operate as a hydraulic pump using a driving force of the power source so as to supply the hydraulic oil discharged by the accumulator part to the hydraulic actuator.

14. The shovel as claimed in claim 1, wherein the accumulator part includes a low-pressure accumulator part configured to store the hydraulic oil discharged from the hydraulic actuator and discharge the hydraulic oil to the intake side of the main pump; and a high-pressure accumulator part configured to store the hydraulic oil discharged from the hydraulic actuator and discharge the hydraulic oil toward the hydraulic actuator, and the high-pressure accumulator part has a higher maximum discharge pressure than the low-pressure accumulator part.

15. The shovel as claimed in claim 14, wherein the high-pressure accumulator part is further configured to discharge the hydraulic oil to the intake side or a discharge side of the main pump while the hydraulic actuator is being driven.

16. The shovel as claimed in claim 14, further comprising:

a hydraulic pump motor configured to transmit a rotation to the main pump and supply the hydraulic oil stored in the high-pressure accumulator part to the intake side of the main pump.

17. The shovel as claimed in claim 16, wherein the hydraulic pump motor is further configured to supply the hydraulic oil stored in the high-pressure accumulator part to the intake side or a discharge side of the main pump while the hydraulic actuator is being driven.

18. The shovel as claimed in claim 16, wherein the hydraulic pump motor is further configured to operate as a hydraulic motor and supply the hydraulic oil in the high-pressure accumulator part to the intake side of the main pump when a pressure of the hydraulic oil in the high-pressure accumulator part is more than or equal to the discharge pressure of the main pump detected by the first pressure sensor.

19. The shovel as claimed in claim 16, wherein the hydraulic pump motor is further configured to operate as a hydraulic pump and supply the hydraulic oil in the high-pressure accumulator part to a discharge side of the main pump when a pressure of the hydraulic oil in the high-pressure accumulator part is less than the discharge pressure of the main pump detected by the first pressure sensor.

* * * * *